US009824631B2

(12) United States Patent
Yamazaki et al.

(10) Patent No.: US 9,824,631 B2
(45) Date of Patent: Nov. 21, 2017

(54) DISPLAY DEVICE

(71) Applicant: SEMICONDUCTOR ENERGY LABORATORY CO., LTD., Atsugi-shi, Kanagawa-ken (JP)

(72) Inventors: Shunpei Yamazaki, Tokyo (JP); Hajime Kimura, Kanagawa (JP); Atsushi Umezaki, Kanagawa (JP); Yasunori Yoshida, Kanagawa (JP); Hideaki Shishido, Kanagawa (JP); Takuya Kimishima, Kanagawa (JP); Yasuyuki Arai, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 209 days.

(21) Appl. No.: 14/819,594

(22) Filed: Aug. 6, 2015

(65) Prior Publication Data

US 2015/0339980 A1 Nov. 26, 2015

Related U.S. Application Data

(60) Continuation of application No. 14/273,596, filed on May 9, 2014, now abandoned, which is a division of (Continued)

(30) Foreign Application Priority Data

Aug. 12, 2005 (JP) ..... 2005-234649

(51) Int. Cl.
*G09G 3/3233* (2016.01)
*G09G 3/00* (2006.01)

(Continued)

(52) U.S. Cl.
CPC ..... *G09G 3/3233* (2013.01); *G09G 3/006* (2013.01); *G09G 3/20* (2013.01); *G09G 3/2022* (2013.01);

(Continued)

(58) Field of Classification Search
CPC ..... G09G 3/3233; G09G 2320/043; G09G 3/3208; G09G 3/3225

(Continued)

(56) References Cited

U.S. PATENT DOCUMENTS 5,929,843 A 7/1999 Tanioka
6,718,104 B2 4/2004 Lowry (Continued)

FOREIGN PATENT DOCUMENTS

CN 001399243 A 2/2003
CN 001573878 A 2/2005

(Continued)

OTHER PUBLICATIONS

Chinese Office Action (Application No. 200610110963.2) dated Aug. 17, 2010.

(Continued)

*Primary Examiner* — Koosha Sharifi-Tafreshi
(74) *Attorney, Agent, or Firm* — Fish & Richardson P.C.

(57) ABSTRACT

In a display element such as an organic EL element, deterioration progresses due to light emission, and emission luminance is lowered even if the same voltage is applied to the display element. Therefore, use over time causes variations in luminance of each pixel, thereby a so-called "image burn-in" phenomenon occurs. Given this factor, the invention provides a display device which can reduce the difference in deterioration of a display element in each pixel and suppress variations in light emission of a display element in a pixel. It is prevented that only a specific pixel has a long (Continued)

accumulated lighting time. For that purpose, a gray scale of a display pattern is changed to prevent the difference in deterioration of display element in pixels from increasing. Alternatively, a specific display pattern is prevented from being fixedly displayed in a specific region. Further alternatively, a pixel lagging behind in deterioration is deteriorated so that the accumulated lighting time of pixels is equal to each other.

10 Claims, 57 Drawing Sheets

Related U.S. Application Data application No. 11/462,829, filed on Aug. 7, 2006, now abandoned.

(51) Int. Cl.
*G09G 3/20* (2006.01)
*G09G 3/3225* (2016.01)

(52) U.S. Cl.
CPC ... *G09G 3/3225* (2013.01); *G09G 2300/0809* (2013.01); *G09G 2300/0819* (2013.01); *G09G 2300/0842* (2013.01); *G09G 2310/0272* (2013.01); *G09G 2310/0275* (2013.01); *G09G 2320/0233* (2013.01); *G09G 2320/0295* (2013.01); *G09G 2320/046* (2013.01); *G09G 2320/048* (2013.01); *G09G 2330/022* (2013.01); *G09G 2340/145* (2013.01)

(58) Field of Classification Search
USPC ..... 345/76, 77, 82, 92; 315/169.3
See application file for complete search history.

(56) References Cited

U.S. PATENT DOCUMENTS

| | | | |
|---|---|---|---|
| 6,865,405 | B2 | 3/2005 | Lin |
| 6,930,680 | B2 | 8/2005 | Miyazawa |
| 7,002,593 | B2 | 2/2006 | Milch et al. |
| 7,138,967 | B2 | 11/2006 | Kimura |
| 7,158,148 | B2 | 1/2007 | Toji et al. |
| 7,173,582 | B2 | 2/2007 | Nishitoba et al. |
| 7,339,552 | B2 | 3/2008 | Seki et al. |
| 7,561,127 | B2 | 7/2009 | Mori et al. |
| 7,714,810 | B2 | 5/2010 | Kasai et al. |
| 7,859,520 | B2 | 12/2010 | Kimura |
| 7,969,389 | B2 | 6/2011 | Miyazawa |
| 7,973,810 | B2 | 7/2011 | Ueda et al. |
| 8,130,176 | B2 | 3/2012 | Kasai et al. |
| 8,188,943 | B2 | 5/2012 | Kasai et al. |
| 2003/0146888 | A1 | 8/2003 | Yamazaki et al. |
| 2003/0214679 | A1 | 11/2003 | Ishikawa |
| 2004/0150594 | A1 | 8/2004 | Koyama et al. |
| 2004/0201583 | A1 | 10/2004 | Burroughes et al. |
| 2004/0252135 | A1 | 12/2004 | Ono |
| 2005/0057189 | A1* | 3/2005 | Kimura ..... G05F 3/242 315/291 |
| 2005/0062680 | A1 | 3/2005 | Lee et al. |
| 2005/0093850 | A1 | 5/2005 | Mori et al. |
| 2005/0110728 | A1 | 5/2005 | Cok |
| 2005/0204313 | A1 | 9/2005 | Enoki et al. |
| 2006/0022992 | A1 | 2/2006 | Tsuji et al. |
| 2006/0130105 | A1 | 6/2006 | Simmons, Jr. et al. |
| 2007/0236410 | A1 | 10/2007 | Shimizu |
| 2009/0170564 | A1 | 7/2009 | Mori et al. |
| 2011/0134163 | A1 | 6/2011 | Kimura |
| 2012/0206508 | A1 | 8/2012 | Kasai et al. |

FOREIGN PATENT DOCUMENTS

| | | | |
|---|---|---|---|
| CN | 001639762 | A | 7/2005 |
| EP | 1071071 | A | 1/2001 |
| EP | 1284471 | A | 2/2003 |
| EP | 1308921 | A | 5/2003 |
| EP | 1321922 | A | 6/2003 |
| EP | 1457955 | A | 9/2004 |
| EP | 1489589 | A | 12/2004 |
| EP | 1777692 | A | 4/2007 |
| EP | 1921596 | A | 5/2008 |
| JP | 09-114418 | A | 5/1997 |
| JP | 2000-221908 | A | 8/2000 |
| JP | 2000-227775 | A | 8/2000 |
| JP | 2000-352953 | A | 12/2000 |
| JP | 2002-511608 | | 4/2002 |
| JP | 2002-199078 | A | 7/2002 |
| JP | 2003-177709 | A | 6/2003 |
| JP | 2003-186434 | A | 7/2003 |
| JP | 2003-216092 | A | 7/2003 |
| JP | 2004-069816 | A | 3/2004 |
| JP | 2004-198809 | A | 7/2004 |
| JP | 2004-348088 | A | 12/2004 |
| JP | 2005-004174 | A | 1/2005 |
| JP | 2005-148558 | A | 6/2005 |
| JP | 2005-202050 | A | 7/2005 |
| JP | 2007-271678 | A | 10/2007 |
| WO | WO-99/53472 | | 10/1999 |
| WO | WO-03/027997 | | 4/2003 |

OTHER PUBLICATIONS

Chinese Office Action (Application No. 201210385103.5) dated Apr. 3, 2015.
Chinese Office Action (Application No. 201210385103.5) dated Mar. 23, 2016.

* cited by examiner

DISPLAY DEVICE

CROSS-REFERENCE TO RELATED APPLICATIONS

This application is a continuation of U.S. application Ser. No. 14/273,596, filed May 9, 2014, which is a divisional of U.S. application Ser. No. 11/462,829, filed Aug. 7, 2006, now abandoned, which claims the benefit of a foreign priority application filed in Japan as Serial No. 2005-234649 on Aug. 12, 2005, all of which are incorporated by reference.

BACKGROUND OF THE INVENTION

1. Field of the Invention

The present invention relates to a display device and a displaying method thereof. In particular, the invention relates to a technique for suppressing an image burn-in phenomenon caused by deterioration of a pixel in an active matrix display device in which a plurality of pixels are arranged in matrix.

2. Description of the Related Art

A liquid crystal display (LCD) which is a display device formed of a display element such as a liquid crystal is widely used. On the other hand, in recent years, a so-called self-light emitting display device having a pixel which is comprised of a display element such as a light emitting diode (LED), namely, a light emitting device has been attracting attention. As a display element used for such a self-light emitting display device, an organic light emitting diode (OLED, also referred to as an organic EL element, an electroluminescence (EL) element, or the like) has been attracting attention, and has been used for an EL display and the like. A display element such as an OLED is self-luminous; therefore, it has advantages such as higher visibility of pixels, no requirement of backlight, and higher response compared to a liquid crystal display.

SUMMARY OF THE INVENTION

In a display element such as an organic EL element, deterioration progresses due to light emission, and emission luminance is lowered even if the same voltage is applied to the display element. Therefore, use over time causes variations in luminance of pixels, thereby a so-called "image burn-in" phenomenon occurs.

The invention provides a display device which can reduce the difference in deterioration of display elements in pixels and suppress variations in light emission of display elements in pixels. Further, the invention provides a displaying method thereof.

It is prevented that only a specific pixel has a long accumulated lighting time. For that purpose, a gray scale of a display pattern is changed to prevent the difference in deterioration of display elements in pixels from increasing. Alternatively, a specific display pattern is prevented from being fixedly displayed in a specific region. Further alternatively, a pixel lagging behind in deterioration is deteriorated so that the accumulated lighting time of pixels is equal to each other.

First, a concrete structure where a gray scale of a display pattern is changed to prevent the difference in deterioration of pixels from expanding is described below.

A display device of the invention includes an image processing circuit capable of switching between a black text mode and a white text mode, and a control circuit for controlling the switching of the image processing circuit.

Note that in the black text mode, text is displayed in black and a background is displayed in white, whereas in the white text mode, text is displayed in white and a background is displayed in black.

Further, in the display device of the invention having the aforementioned structure, the control circuit switches between the modes depending on ambient brightness.

Further, in the display device of the invention having the aforementioned structure, the control circuit switches between the modes per day.

Further, in the display device of the invention having the aforementioned structure, the control circuit switches between the modes per hour.

Further, in the display device of the invention having the aforementioned structure, the control circuit switches between the modes depending on battery power.

Further, in the display device of the invention having the aforementioned structure, the control circuit switches between the modes when the display device remains unoperated for a certain period.

Further, in the display device of the invention having the aforementioned structure, the control circuit switches between the modes each time a power source is turned on.

Further, in the display device of the invention having the aforementioned structure, the control circuit switches between the modes depending on whether an e-mail is received or sent.

A display device of the invention includes an image processing circuit capable of switching between a black text mode and a black-rimmed white text mode, and a control circuit for controlling the switching of the image processing circuit. Note that in the black text mode, text is displayed in black and a background is displayed in white, whereas in the black-rimmed white text mode, a core of text is displayed in white, an outline thereof is displayed in black, and a background is displayed in white.

Further, in the display device of the invention having the aforementioned structure, the control circuit switches between the modes per day.

Further, in the display device of the invention having the aforementioned structure, the control circuit switches between the modes per hour.

Further, in the display device of the invention having the aforementioned structure, the control circuit switches between the modes when the display device remains unoperated for a certain period.

Further, in the display device of the invention having the aforementioned structure, the control circuit switches between the modes each time a power source is turned on.

Further, in the display device of the invention having the aforementioned structure, the control circuit switches between the modes depending on whether an e-mail is received or sent.

In a displaying method of the invention, switching between a black text mode and a white text mode is carried out depending on ambient brightness. Note that in the black text mode, text is displayed in black and a background is displayed in white, whereas in the white text mode, text is displayed in white and a background is displayed in black.

Further, in the displaying method of the invention, the switching between a black text mode and a white text mode is carried out per day.

Further, in the displaying method of the invention, the switching between a black text mode and a white text mode is carried out per hour.

Further, in the displaying method of the invention, the switching between a black text mode and a white text mode is carried out depending on battery power.

Further, in the displaying method of the invention, the switching between a black text mode and a white text mode is carried out when a display device remains unoperated for a certain period.

Further, in the displaying method of the invention, the switching between a black text mode and a white text mode is carried out each time a power source is turned on.

Further, in the displaying method of the invention, the switching between a black text mode and a white text mode is carried out depending on whether an e-mail is received or sent.

In a displaying method of the invention, switching between a black text mode and a black-rimmed white text mode is carried out per day. Note that in the black text mode, text is displayed in black and a background is displayed in white, whereas in the black-rimmed white text mode, a core of text is displayed in white, an outline thereof is displayed in black, and a background is displayed in white.

In the displaying method of the invention, the switching between a black text mode and a black-rimmed white text mode is carried out per hour.

In the displaying method of the invention, the switching between a black text mode and a black-rimmed white text mode is carried out when a display device remains unoperated for a certain period.

In the displaying method of the invention, the switching between a black text mode and a black-rimmed white text mode is carried out each time a power source is turned on.

In the displaying method of the invention, the switching between a black text mode and a black-rimmed white text mode is carried out depending on whether an e-mail is received or sent.

Further, a concrete structure of the invention for preventing a specific display pattern from being fixedly displayed in a specific region is described below.

A display device of the invention includes an image processing circuit capable of processing an image so as to change a font type of text, and a control circuit for controlling operation of the image processing circuit.

Further, in the display device of the invention having the aforementioned structure, the control circuit changes a font type of text per day.

Further, in the display device of the invention having the aforementioned structure, the control circuit changes a font type of text per hour.

Further, in the display device of the invention having the aforementioned structure, the control circuit changes a font type of text when the display device remains unoperated for a certain period.

Further, in the display device of the invention having the aforementioned structure, the control circuit changes a font type of text each time a power source is turned on.

Further, in the display device of the invention having the aforementioned structure, the control circuit changes a font type of text depending on whether an e-mail is received or sent.

A display device of the invention includes an image processing circuit capable of processing an image so as to shift text, and a control circuit for controlling operation of the image processing circuit.

Further, in the display device of the invention having the aforementioned structure, the control circuit shifts text per day.

Further, in the display device of the invention having the aforementioned structure, the control circuit shifts text per hour.

Further, in the display device of the invention having the aforementioned structure, the control circuit shifts text when the display device remains unoperated for a certain period.

Further, in the display device of the invention having the aforementioned structure, the control circuit shifts text each time a power source is turned on.

Further, in the display device of the invention having the aforementioned structure, the control circuit shifts text each time text is inputted.

Further, in the display device of the invention having the aforementioned structure, the control circuit shifts text each time text of one row is inputted.

Further, in the display device of the invention having the aforementioned structure, a rectangular pixel block for forming the text has a horizontal length a and a vertical length b. When horizontal direction and vertical direction of a movement region to be shifted are denoted by x and y respectively, $a<x\leq 3a$ and $b<x\leq 3b$ are satisfied.

A display device of the invention includes an image processing circuit capable of processing an image so as to shift an icon, and a control circuit for controlling operation of the image processing circuit.

Further, in the display device of the invention having the aforementioned structure, the control circuit shifts an icon per day.

Further, in the display device of the invention having the aforementioned structure, the control circuit shifts an icon per hour.

Further, in the display device of the invention having the aforementioned structure, the control circuit shifts an icon when the display device remains unoperated for a certain period.

Further, in the display device of the invention having the aforementioned structure, the control circuit shifts an icon each time a power source is turned on.

A display device of the invention includes a counter for counting the accumulated displaying time of an icon and the accumulated lighting time of a pixel in which an icon is not displaying an icon; a memory circuit portion in which data counted by the counter is stored; and a correcting circuit for correcting an image signal with the use of the data stored in the memory circuit portion so that luminance of a pixel in the icon portion is equal to that of the pixel in which an icon is not displayed.

A display device of the invention includes an image processing circuit capable of processing an image so as to shift a pictogram, and a control circuit for controlling operation of the image processing circuit.

Further, in the display device of the invention having the aforementioned structure, the control circuit shifts a pictogram per day.

Further, in the display device of the invention having the aforementioned structure, the control circuit shifts a pictogram per hour.

Further, in the display device of the invention having the aforementioned structure, the control circuit shifts a pictogram when the display device remains unoperated for a certain period.

Further, in the display device of the invention having the aforementioned structure, the control circuit shifts a pictogram each time a power source is turned on.

In a displaying method of the invention, a font type of text is changed per day.

Further, in a displaying method of the invention, a font type of text is changed per hour.

Further, in a displaying method of the invention, a font type of text is changed when a display device remains unoperated for a certain period.

Further, in a displaying method of the invention, a font type of text is changed each time a power source is turned on.

Further, in a displaying method of the invention, a font type of text is changed depending on whether an e-mail is received or sent.

Further, in a displaying method of the invention, text is shifted per day.

Further, in a displaying method of the invention, text is shifted per hour.

Further, in a displaying method of the invention, text is shifted when a display device remains unoperated for a certain period.

Further, in a displaying method of the invention, text is shifted each time a power source is turned on.

Further, in a displaying method of the invention, text is shifted each time text is inputted.

Further, in a displaying method of the invention, text is shifted each time text of one row is inputted.

Further, in the displaying method of the invention having the aforementioned structure, a block of the text has a horizontal length a and a vertical length b. When horizontal direction and vertical direction of a movement region to be shifted are denoted by x and y respectively, $a<x\leq 3a$ and $b<x\leq 3b$ are satisfied.

Further, in a displaying method of the invention, an icon is shifted per day.

Further, in a displaying method of the invention, an icon is shifted per hour.

Further, in a displaying method of the invention, an icon is shifted when a display device remains unoperated for a certain period.

Further, in a displaying method of the invention, an icon is shifted each time a power source is turned on.

Further, in a displaying method of the invention, a pictogram is shifted per day.

Further, in a displaying method of the invention, a pictogram is shifted per hour.

Further, in a displaying method of the invention, a pictogram is shifted when a display device remains unoperated for a certain period.

It is to be noted that a pictogram described in this specification corresponds to a predetermined pattern of a figure, a picture, text, or the like, and a pictogram display region corresponds to a region in which pixels contributing to display of the pattern are arranged.

A switch used in the invention may be any switch such as an electrical switch or a mechanical switch. That is, it may be anything as long as it can control a current flow and is not limited to a particular type. It may be, for example, a transistor, a diode (PN diode, PIN diode, Schottky diode, diode-connected transistor, or the like), a thyristor, or a logic circuit configured with them. Therefore, in the case of using a transistor as a switch, polarity (conductivity) thereof is not particularly limited because the transistor operates just as a switch. However, when an off current is preferred to be small, a transistor of polarity with a small off current is preferably used. For example, a transistor which has an LDD region or a multi-gate structure has a small off current. Further, it is desirable that an n-channel transistor be employed when a potential of a source terminal of the transistor operating as a switch is closer to a low potential side power source (Vss, GND, 0 V or the like), and a p-channel transistor be employed when a potential of the source terminal is closer to a high potential side power source (Vdd or the like). This helps the switch operate efficiently since the absolute value of the gate-source voltage of the transistor can be increased.

It is to be noted that a CMOS switch can also be applied by using both n-channel and p-channel transistors. In the case of such a CMOS switch, a current can be applied when a switch of either the p-channel transistor or the n-channel transistor is conductive, which helps the switch operate efficiently. For example, even when a voltage of an input signal to a switch is high or low, an appropriate voltage can be outputted. In addition, a voltage amplitude value of a signal for turning on or off a switch can be made small; therefore, power consumption can be lowered. It is to be noted that when a transistor is used as a switch, the transistor includes an input terminal (one of a source terminal and a drain terminal), an output terminal (the other of the source terminal and the drain terminal), and a terminal for controlling conduction (gate terminal). On the other hand, when a diode is used as a switch, there is a case where a terminal for controlling conduction is not included. Thus, the number of wires for controlling terminals can be reduced.

It is to be noted in the invention that "being connected" means "being electrically connected". Therefore, another element, switch, or the like may be additionally arranged between the predetermined elements.

Note that various modes can be applied to a display element, a display device, a light emitting element, and a light emitting device, and they can have various elements. For example, a display medium in which contrast is changed by an electromagnetic effect can be used as a display element, a display device, a light emitting element, or a light emitting device, such as an EL element (an organic EL element, an inorganic EL element, an EL element containing an organic material and an inorganic material), an electron discharging element, a liquid crystal element, an electron ink, a grating light valve (GLV), a plasma display (PDP), a digital micromirror device (DMD), a piezoelectric ceramic display, or a carbon nanotube. It is to be noted that a display device using an EL element includes an EL display; a display device using an electron discharging element includes a field emission display (FED), an SED type flat panel display (Surface-conduction Electron-emitter Display), and the like; a display device using a liquid crystal element includes a liquid crystal display, a transmissive liquid crystal display, a semi-transmissive liquid crystal display, and a reflective liquid crystal display; a display device using an electron ink includes electronic paper.

It is to be noted in the invention that kinds of transistors applicable to the invention are not limited. Accordingly, the following transistors are applicable to the invention: a thin film transistor (TFT) using a non-single crystalline semiconductor film typified by amorphous silicon and polycrystalline silicon; a MOS transistor which is formed using a semiconductor substrate or an SOI substrate; a junction transistor; a bipolar transistor; a transistor using an organic semiconductor or a carbon nanotube; and other transistors. Further, kinds of substrates over which a transistor is provided are not limited. Therefore, a transistor can be provided over a single crystalline substrate, an SOI substrate, a glass substrate, a plastic substrate, or the like.

It is to be noted that any type of transistor can be used as a transistor of the invention and formed over any substrate as described above. Therefore, all of the circuits may be formed over a glass substrate, a plastic substrate, a single crystalline substrate, an SOI substrate, or any substrate. Alternatively, a part of the circuits may be formed over a certain substrate and another part of the circuits may be formed over another substrate. That is, not all of the circuits are required to be formed over the same substrate. For example, a part of the circuits may be formed over a glass substrate using a TFT and another part of the circuits may be formed over a single crystalline substrate into an IC chip which may be provided over the glass substrate by COG (Chip On Glass). Alternatively, the IC chip may be connected to a glass substrate using TAB (Tape Auto Bonding) or a printed substrate.

It is to be noted in the invention that one pixel corresponds to the smallest unit of an image. Accordingly, in the case of a full color display device formed of color elements of R (red), G (green), and B (blue), one pixel is formed of a dot of an R color element, a dot of a G color element, and a dot of a B color element. It is to be noted that a color element is not limited to be formed of three colors, and may be formed of more than three colors or a color other than RGB. For example, RGB to which white is added (RGBW) or RGB to which one or more colors selected from yellow, cyan, magenta, emerald green, vermilion, and the like are added can be employed. Alternatively, a similar color to at least one of RGB may be added to RGB, for example, R, G, B1, B2 may be employed. Although B1 and B2 are both blue, they have slightly different frequencies. By using such a color element, an image closer to a real thing can be displayed and power consumption can be reduced. It is to be noted that one pixel may include a plurality of dots of a certain color element. In this case, each of the plurality of dots of the color element may have a different size of region which contributes to display. Further, a gray scale may be expressed by controlling each of the plurality of dots of the color element. This method is referred to as an area gray scale method. Alternatively, the viewing angle may be expanded by supplying each of a plurality of dots of a certain color element with a slightly different signal.

It is to be noted in the invention that pixels may be arranged in matrix. Here, the case where pixels are arranged in matrix corresponds to a case where pixels are arranged on a straight line or a jagged line in vertical direction and horizontal direction. Therefore, the case where pixels are arranged in matrix also corresponds to a case where pixels are arranged in a stripe state or a case where dots of three color elements are arranged in what is called a delta pattern or in a Bayer pattern when full color display is carried out using the three color elements (for example, RGB). It is to be noted that a color element is not limited to be formed of three colors and may be formed of more than three colors such as RGBW (W is white) or RGB to which one or more of yellow, cyan, magenta, and the like are added. The size of a display region may be different depending on the dot of the color element. Accordingly, reduction in power consumption and longer lifetime of a display element can be achieved.

A transistor is an element having at least three terminals including a gate electrode, a drain region, and a source region. A channel forming region is provided between the drain region and the source region. Here, it is difficult to determine the source region or the drain region since they depend on the structure, operating condition, and the like of the transistor. Therefore, in this specification, each of the region functioning as a source region and the region functioning as a drain region may be referred to as a first terminal or a second terminal.

It is to be noted in the invention that a semiconductor device corresponds to a device including a circuit having a semiconductor element (transistor, diode, or the like). Further, a semiconductor device may be a general device which can function by using semiconductor characteristics.

Further, a display device corresponds to a device including a display element (liquid crystal element, EL element, or the like). It is to be noted that a display device may be a main body of a display panel in which a plurality of pixels including display elements such as liquid crystal elements and EL elements and a peripheral driver circuit for driving the pixels are formed over the same substrate. Further, a display device may include a peripheral driver circuit disposed over a substrate by wire bonding or a bump, that is, a so-called chip on glass (COG). Furthermore, a display device may include the one provided with a flexible printed circuit (FPC) or a printed wiring board (PWB) (IC, resistor, capacitor, inductor, transistor, or the like). Moreover, a display device may include an optical sheet such as a polarizing plate or a retardation film. In addition, a backlight unit (such as light guide plate, prism sheet, diffusion sheet, reflection sheet, light source (LED, cold-cathode tube, or the like)) may be included.

A light emitting device corresponds to a display device including a self-light emitting display element such as an EL element or an element used for an FED in particular. A liquid crystal display device corresponds to a display device including a liquid crystal element.

The invention can suppress variations in light emission of a display element in each pixel, which suppresses a so-called "image burn-in" phenomenon.

BRIEF DESCRIPTION OF DRAWINGS

FIG. 56 is a flow chart showing a process for correcting image burn-in.

FIG. 57 is a flow chart showing a process for correcting image burn-in.

DETAILED DESCRIPTION OF THE INVENTION

Although the invention will be fully described by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein.

Figure 36:
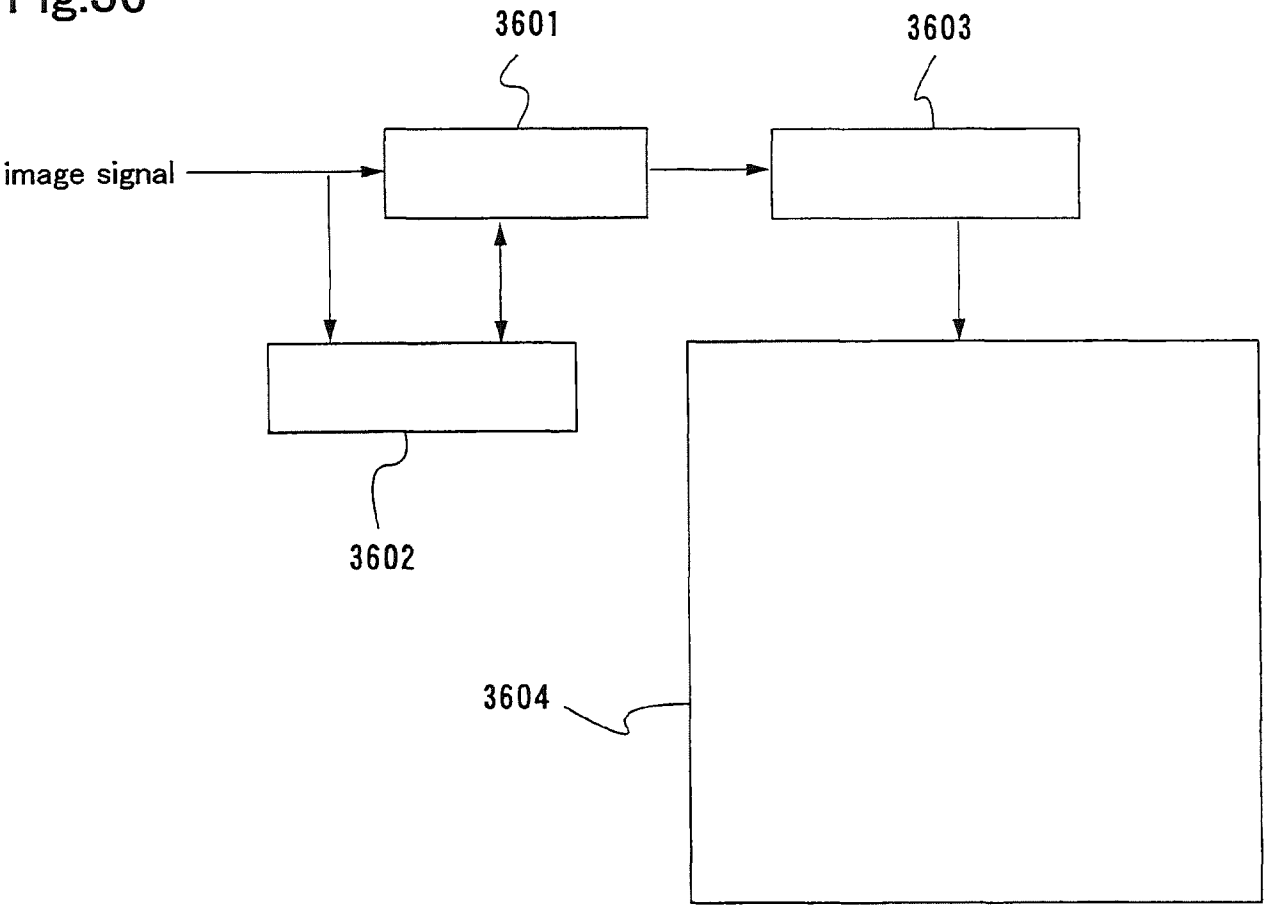
FIG. 36 is a block diagram of a display device of the invention.

FIG. 36 shows a block diagram of a main structure of a display device of the invention.

The display device of the invention includes an image processing circuit 3601, a control circuit 3602, a controller 3603, and a display panel 3604.

An image signal is inputted to the image processing circuit 3601 and the control circuit 3602. The control circuit 3602 controls operation of the image processing circuit 3601. Then, the image processing circuit 3601 converts the inputted image signal into a signal for which image processing is carried out in accordance with the control circuit 3602.

Subsequently, an outputted signal from the image processing circuit 3601 is inputted to the controller 3603, and the signal is inputted to the display panel 3604.

Here, image processing is carried out in the image processing circuit 3601, thereby processing for reducing the difference in deterioration of display elements in pixels can be carried out.

In embodiment modes below, description is made of a displaying method for reducing the difference in deterioration of display elements in pixels, that is, a displaying method which is realized by carrying out image processing in the image processing circuit 3601.

Embodiment Mode 1

In this embodiment mode, a condition is set, and a gray scale of a displayed image is inverted when the condition is fulfilled. That is, a contrasting of a display image is inverted. The difference in deterioration of display elements in pixels is reduced, thereby suppressing variations in luminance of pixels.

For example, in the case where a gray scale is inverted in a display device for displaying 64 gray scales, pixels emitting light with gray scale levels of 0, 1, 2, 3, . . . , 62, and 63 before gray scale inversion are set so as to emit light with gray scale levels of 63, 62, 61, 60, . . . , 1, and 0. That is to say, when a display device for displaying N gray scales has a gray scale level of X before gray scale inversion and a gray scale level of Y after gray scale inversion, $Y=N-X$ is satisfied.

Figure 2B:
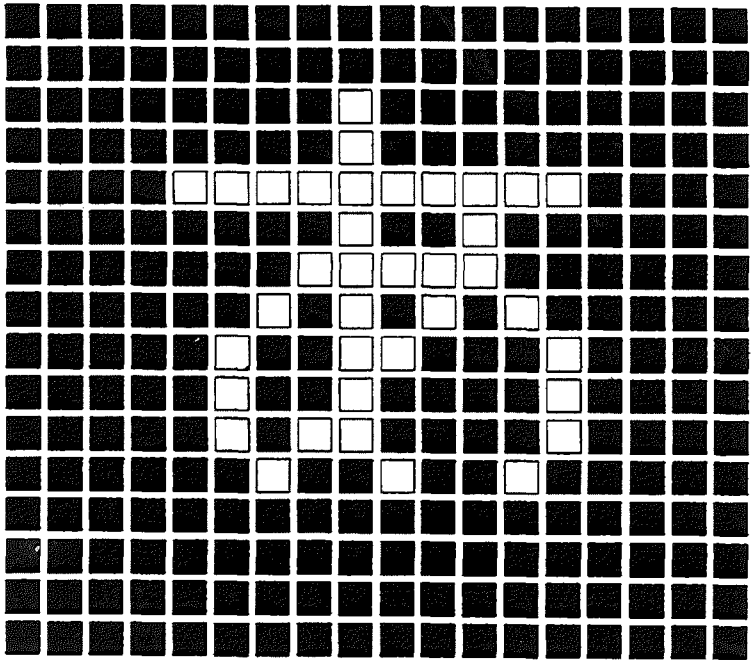
FIGS. 2 A and 2B are diagrams showing a black text mode and a white text mode respectively.
Figure 2A:
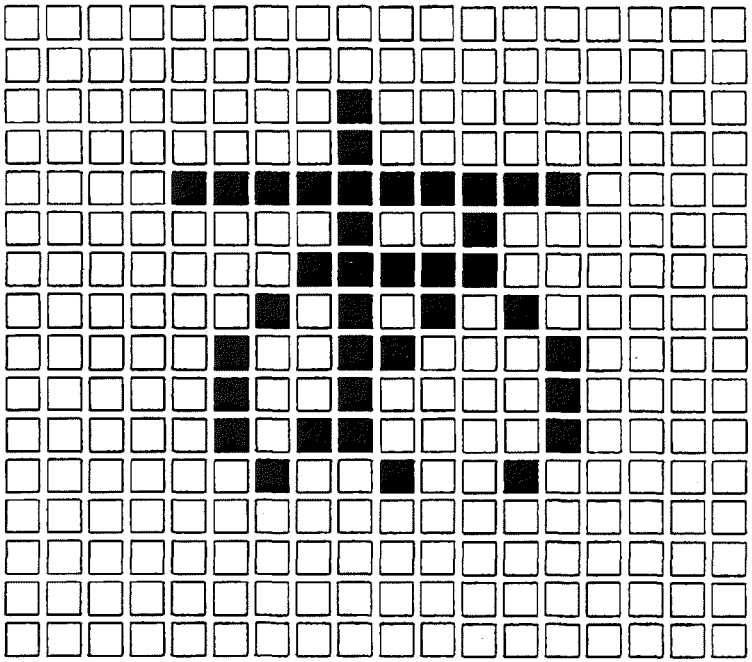

Further, in the case where text (such as hiragana, katakana, kanji character, numerical character, or the Roman alphabet) is displayed in a display screen, switching between a white text mode where text is displayed in white and a black text mode where text is displayed in black is carried out each time the set condition is fulfilled. FIG. 2A shows "one kana character" as an example of the black text mode. FIG. 2B shows "one kana character" as an example of the white text mode. It is to be noted that the number of pixels forming a character and a font type of the character are examples and are not limited to these.

It is to be noted in FIGS. 2A and 2B that one square corresponds to one pixel. The shape of a light emitting region of a display element in a pixel is not limited to such a square shape and may be another polygon or a round shape. Further, one pixel may be formed of a plurality of dots of a color element.

It is to be noted that white display described here is not required to be carried out with a gray scale level of the highest luminance. That is, it may be carried out with a gray scale level of luminance higher than that in the case of black display. Further, black display is not required to be carried out with a gray scale level of the lowest luminance. That is, it may be carried out with a gray scale level of luminance lower than that in the case of white display.

For example, in the case where text is displayed on a portable terminal such as a mobile phone, a background is displayed in black and text is displayed in white as shown in FIG. 2B when ambient brightness is high (when outside light or indoor light can be obtained). Meanwhile, a background is displayed in white and text is displayed in black as shown in FIG. 2A when ambient brightness is low (in darkness at night). It is to be noted that a view in which gray scale levels of the text and the background are inverted is shown here; however, only a gray scale level of the text or the background may be inverted.

Accordingly, in a bright place where outside light, indoor light, or the like can be obtained, the white text mode is selected, thereby power consumption can be lowered and an image burn-in phenomenon can be suppressed at the same time. In other words, since a background is displayed in black, an image burn-in phenomenon does not occur in the background, and since a lighting region for displaying text in a pixel is small, an image burn-in phenomenon is not sensed easily in the text.

Further, in darkness at night, a background is displayed in white and text is displayed in black, thereby the text can be seen easily. A pixel in a different region from that used in the white text mode (a region such as a space between rows of text or a space between characters) is displayed in white, thereby the difference in deterioration of display elements in pixels can be reduced. As a result, an image burn-in phenomenon can be suppressed.

After switching from the white text mode to the black text mode, the luminance of white display in the background may be lowered by gradation or by stages. That is to say, since when eyes are adjusted to darkness, text can be seen even if contrast is low. Accordingly, the luminance of white display is lowered to reduce power consumption.

It is to be noted that the condition of inverted gray scale display is not limited to the aforementioned. Switching between a black text mode and a white text mode may be carried out per day. For example, white text display may be carried out on odd days, whereas black text display may be carried out on even days. Switching may be carried out per hour. For example, white text display may be carried out in odd hours, whereas black text display may be carried out in even hours. Switching may be carried out depending on battery power. When enough power remains, black text display may be carried out, whereas when less power remains, white text display may be carried out. Switching may be carried out when an electronic appliance remains unoperated for a certain period; each time a power source is turned on; or depending on whether an e-mail is received or sent.

Figure 1A:
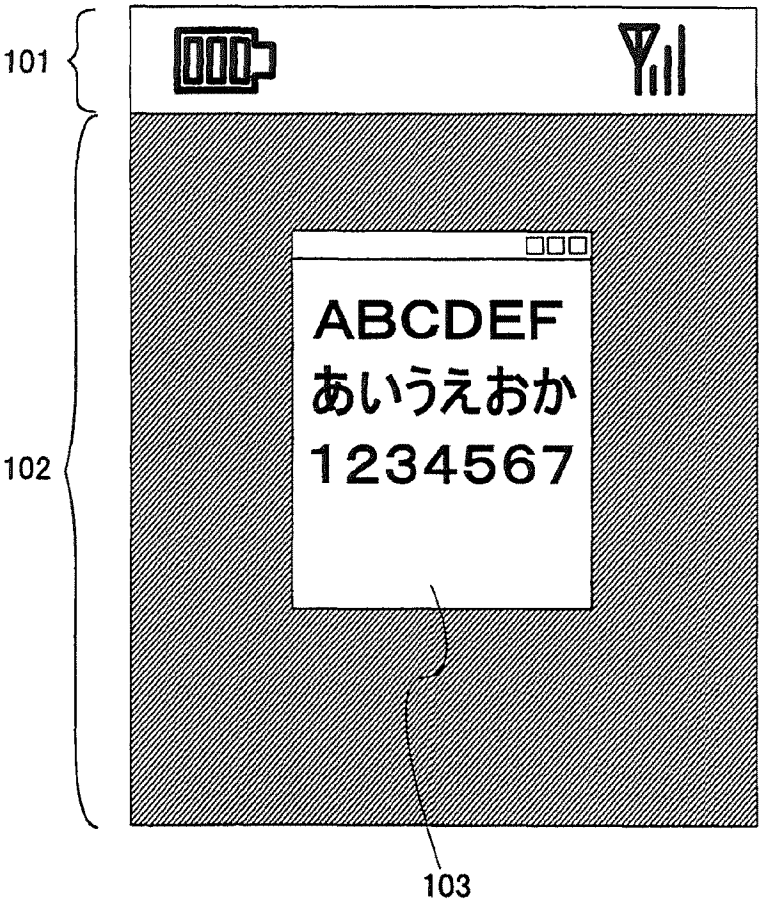
FIGS. 1A and 1B are diagrams showing a black text mode and a white text mode respectively.
Figure 1B:
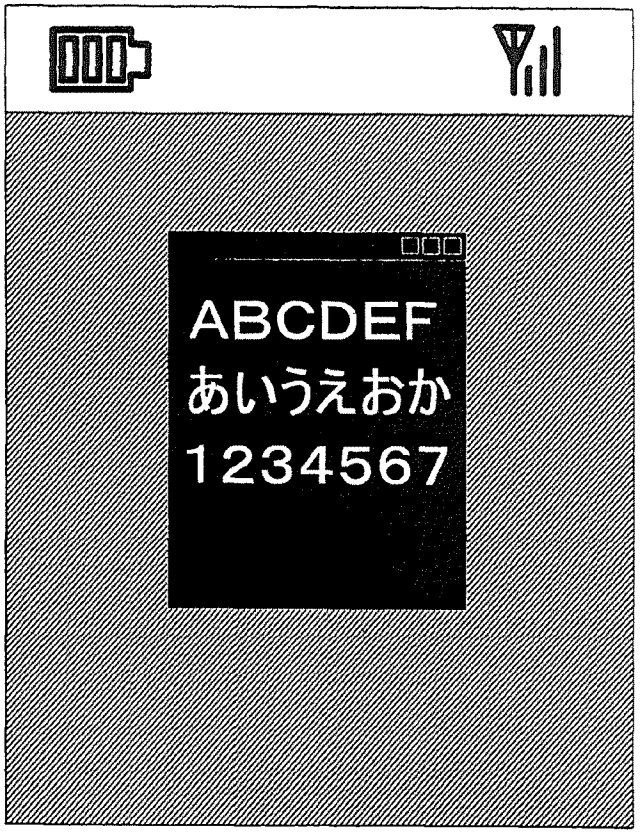

It is to be noted that such inverted gray scale display may be carried out in a certain window appearing on a display screen or in the whole display screen. FIGS. 1A and 1B show an example of the case where inverted gray scale display is carried out in a window on a display screen. In FIG. 1A, a display screen includes a pictogram display region 101 and a main display region 102 in which a window 103 is displayed. Note that in the pictogram display region 101, a pictogram for indicating a state of a portable terminal (battery power, radio wave receiving state, or the like), and the like are displayed. The main display region 102 corresponds to a main display region where a moving image, a still image, and the like can be displayed by operating the portable terminal. The window 103 corresponds to a region where different information can be displayed in an operation screen and has a function of displaying an image or a document. Note that the pictogram display region 101 and the main display region 102 are not required to be differentiated. That is, a pictogram may be displayed in the main display region 102.

FIG. 1A shows the window 103 in the black text mode where text is displayed in black and a background is displayed in white. On the other hand, FIG. 1B shows the window 103 in the white text mode where text is displayed in white and a background is displayed in black. Here, an image displayed in the main display region 102 outside the window 103 is not required to be changed between the black text mode and the white text mode, and gray scale levels may be inverted. Further, an image displayed in the pictogram display region 101 is not required to be changed between the black text mode and the white text mode, and gray scale levels may be inverted.

Figure 21A:
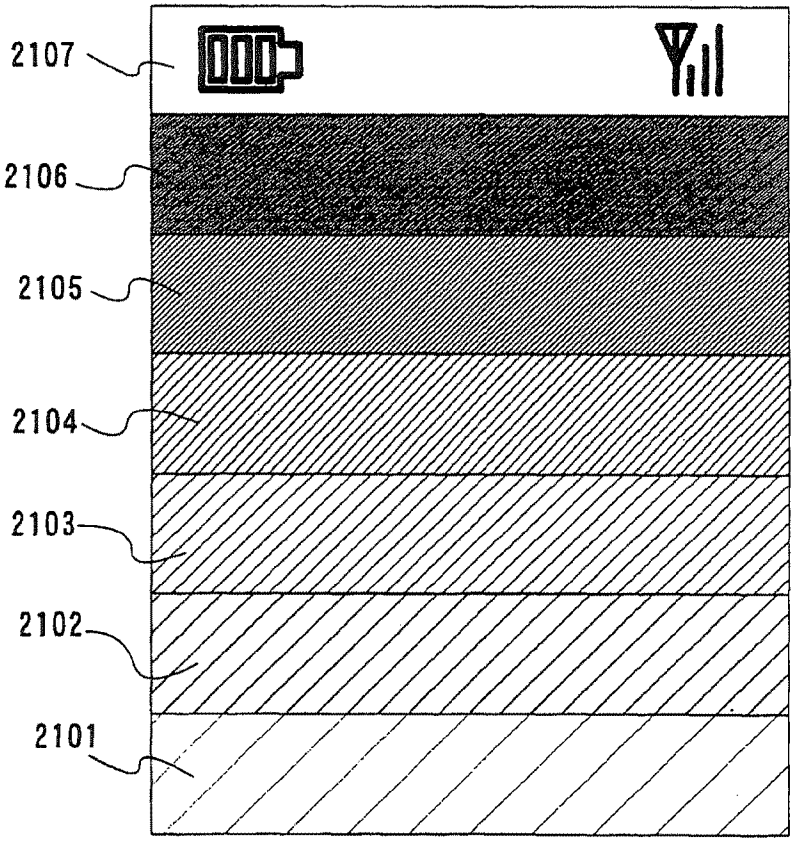
FIGS. 21A and 21B are diagrams each showing a displaying method of the invention.
Figure 21B:
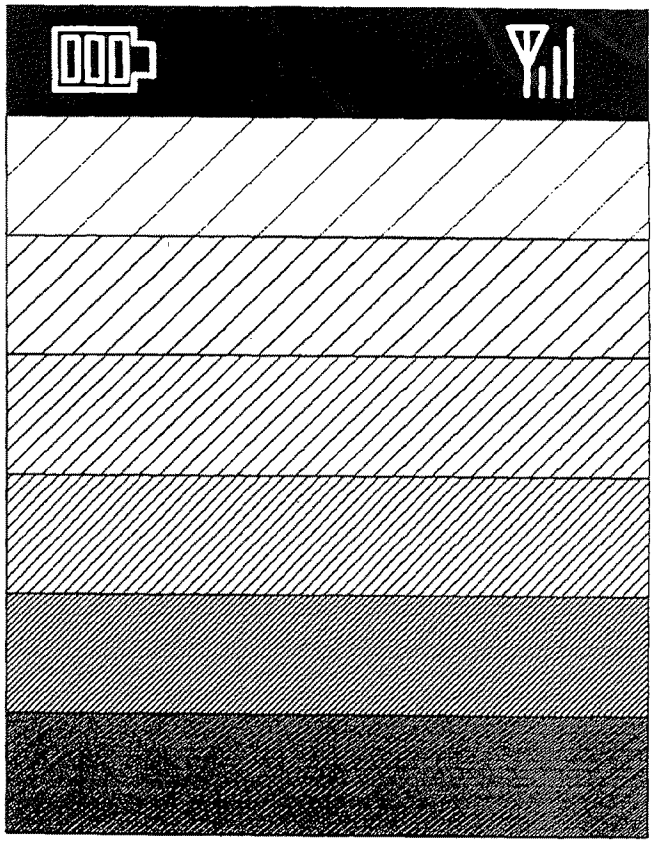

When a gray scale of an image other than text is inverted, it is inverted at the middle of the gray scale levels. For example, description is made using gradation with 8 gray scales (gradual change in contrast) for simplification. In FIG. 21A, a first region 2101, a second region 2102, a third region 2103, a fourth region 2104, a fifth region 2105, and a sixth region 2106 are displayed with gray scale levels of 6, 5, 4, 3, 2, and 1 respectively, and in a seventh region 2107, a background is displayed with a gray scale level of 7 and a pictogram is displayed with a gray scale level of 0. On the other hand, inverted gray scale display of FIG. 21A is shown in FIG. 21B. The first region 2101, the second region 2102, the third region 2103, the fourth region 2104, the fifth region 2105, and the sixth region 2106 are displayed with gray scale levels of 1, 2, 3, 4, 5, and 6 respectively, and in the seventh region 2107, a background is displayed with a gray scale level of 0 and a pictogram is displayed with a gray scale level of 7.

Figure 28A:
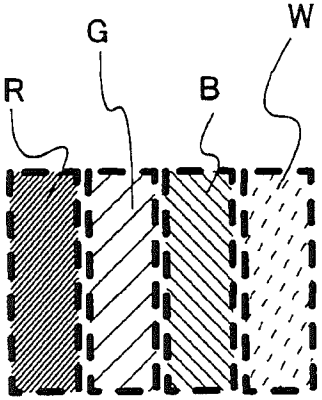
FIGS. 28A to 28 C are diagrams each showing dots of a pixel.
Figure 28B:
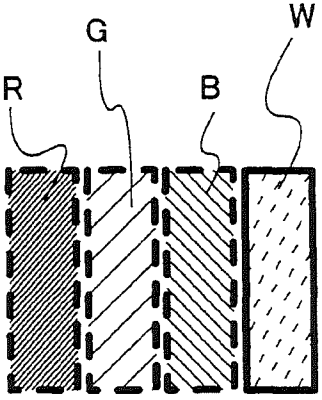
Figure 28C:
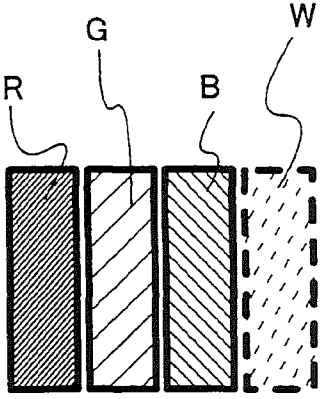

In the case where full color display is carried out using color elements of R (red), G (green), and B (blue), inverted display can also be carried out. In this case, in a pixel where only a dot of R emits light before the inversion, dots of G and B light emit light and a dot of R does not emit light after the inversion. In the case where full color display is carried out using color elements of R (red), G (green), B (blue), and W (white), white display may be carried out by switching between dots of RGB emitting light and a dot of W emitting light depending on a condition. For example, when image burn-in is defined sharply as in the case of displaying text, or the like, white display is carried out by emitting light in a dot of a color element which is difficult to be deteriorated. Alternatively, lighting of dots of RGB may be used for half of the luminance of white display, and lighting of a dot of W may be used for the other half. FIGS. 28A to 28C show three different patterns for white display in a pixel formed of dots of R, G, B, and W. Note that a lighting dot is indicated with a dotted line and a non-lighting dot is indicated with a line. In the case of a case shown in FIG. 28A, white display is carried out by making dots of RGB or a dot of W light. In the case of a case shown in FIG. 28B, white display is carried out by making dots of RGB light while a dot of W is in a non-lighting state. In the case shown in FIG. 28C, white display is carried out by emitting light in a dot of W while emitting no light in dots of RGB.

Accordingly, when an inverted gray scale display is carried out as described in this embodiment mode, the difference in deterioration of display element in pixels can be reduced, and thus variations in light emission of pixels can be suppressed. That is, image burn-in can be suppressed.

It is to be noted that such a displaying method as shown in this embodiment mode can be realized using hardware or software. As hardware, there is a function circuit such as a CPU or a memory. As software, there is a program including data such as a procedure or an instruction, which is stored in a memory or the like.

Embodiment Mode 2

Figure 4B:
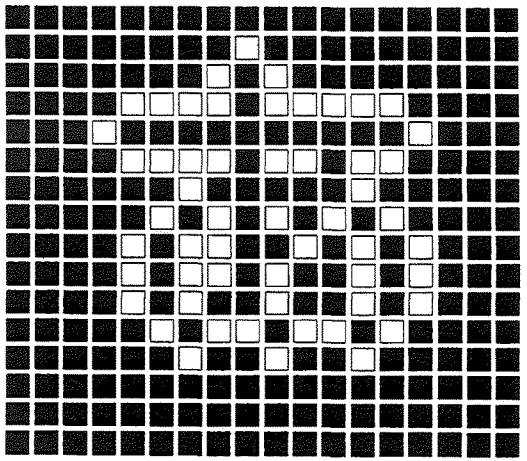
FIGS. 4A and 4B are diagrams showing a black-rimmed white text mode and a white-rimmed black text mode respectively.
Figure 4A:
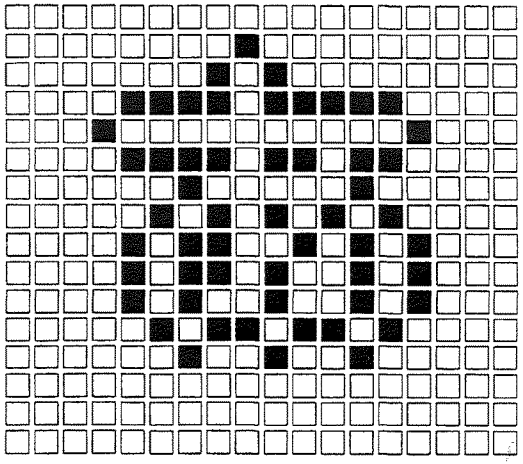

In this embodiment mode, in the case where text (such as hiragana, katakana, kanji character, numerical character, or the Roman alphabet) is displayed in a display screen, a condition is set and switching between a black text mode where text is displayed in black and a black-rimmed white text mode where a core of text is displayed in white and an outline thereof is displayed in black is carried out each time the set condition is fulfilled. Alternatively, switching between a white text mode where text is displayed in white and a white-rimmed black text mode where a core of text is displayed in black and an outline thereof is displayed in white is carried out. FIG. 4A shows "one kana character" as an example of the black-rimmed white text mode. FIG. 4B shows "one kana character" as an example of the white-rimmed black text mode.

By switching between the modes in this manner, the difference in deterioration of display elements in pixels can be reduced. This is because text displayed in black in the black text mode can be displayed in white when switching from the black text mode to the black-rimmed white text mode as shown in FIGS. 2A and 4A. Further, text displayed in white in the white text mode can be displayed in black when switching from the white text mode to the white-rimmed black text mode as shown in FIGS. 2B and 4B. That is to say, pixels of the text can be inverted between white and black; therefore, an image burn-in phenomenon can be suppressed.

Figure 3A:
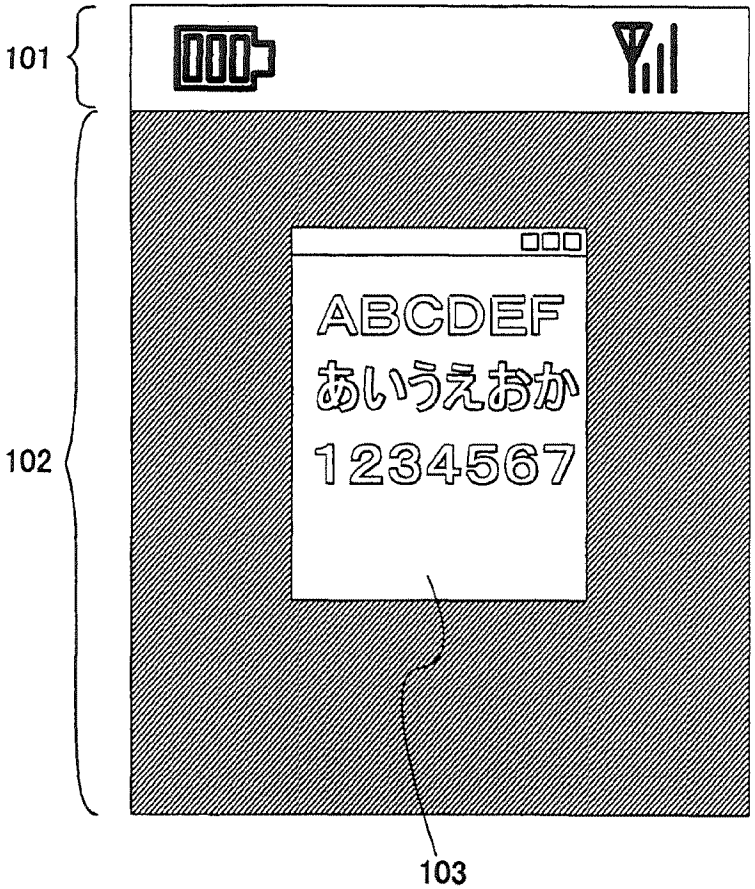
FIGS. 3A and 3B are diagrams showing a black-rimmed white text mode and a white-rimmed black text mode respectively.
Figure 3B:
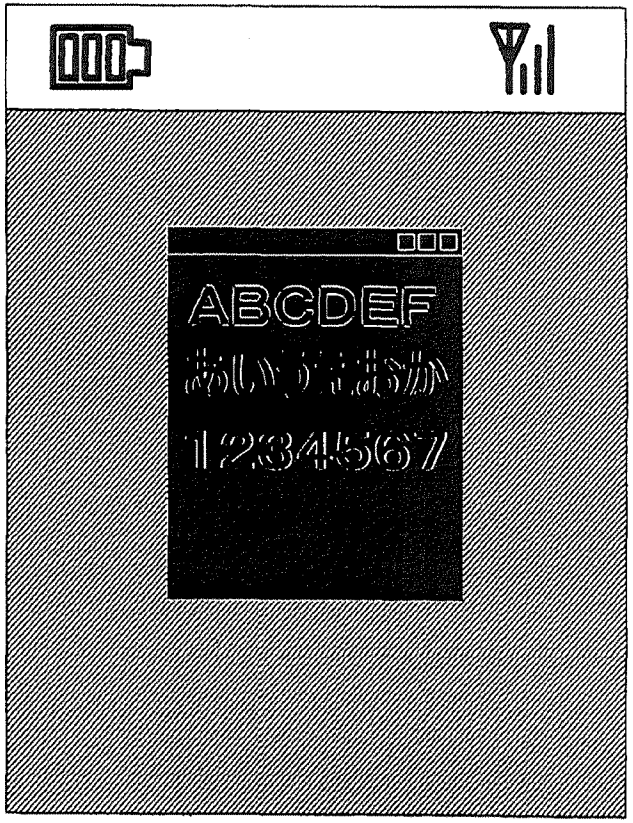

Further, such switching between the modes may be carried out in a certain window appearing on a display screen or in the whole display screen. FIGS. 3A and 3B show an example of the case where black-and-white inverted display is carried out in a window on a display screen. In FIG. 3A, a display screen includes the pictogram display region 101 and the main display region 102 in which the window 103 is displayed. FIG. 3A shows an example of the black-rimmed white text display in the window 103, and FIG. 3B shows an example of the white-rimmed black text display in the window 103.

It is to be noted that the condition of switching between the modes is not limited to the aforementioned. Switching between the modes may be carried out per day. For example, the white text mode may be selected on odd days, whereas the white-rimmed black text mode may be selected on even days; alternatively, the black text mode may be selected on odd days, whereas the black-rimmed white text mode may be selected on even days. Switching may be carried out per hour. For example, the white text mode may be selected in odd hours, whereas the white-rimmed black text mode may be selected in even hours; alternatively, the black text mode may be selected in odd hours, whereas the black-rimmed white text mode may be selected in even hours. Switching may be carried out depending on battery power. When enough power remains, the black-rimmed white text mode may be selected, whereas when less power remains, the white-rimmed black text mode may be selected. When an electronic appliance remains unoperated for a certain period, switching from the black-rimmed white text mode to the white-rimmed black text mode may be carried out.

Embodiment Mode 3

In this embodiment mode, an image burn-in phenomenon is suppressed by shifting an image. This is particularly effective in the case where a displayed image is text (such as hiragana, katakana, kanji character, numerical character, or the Roman alphabet) or the like, which has a definite boundary of gradations.

Figure 5:
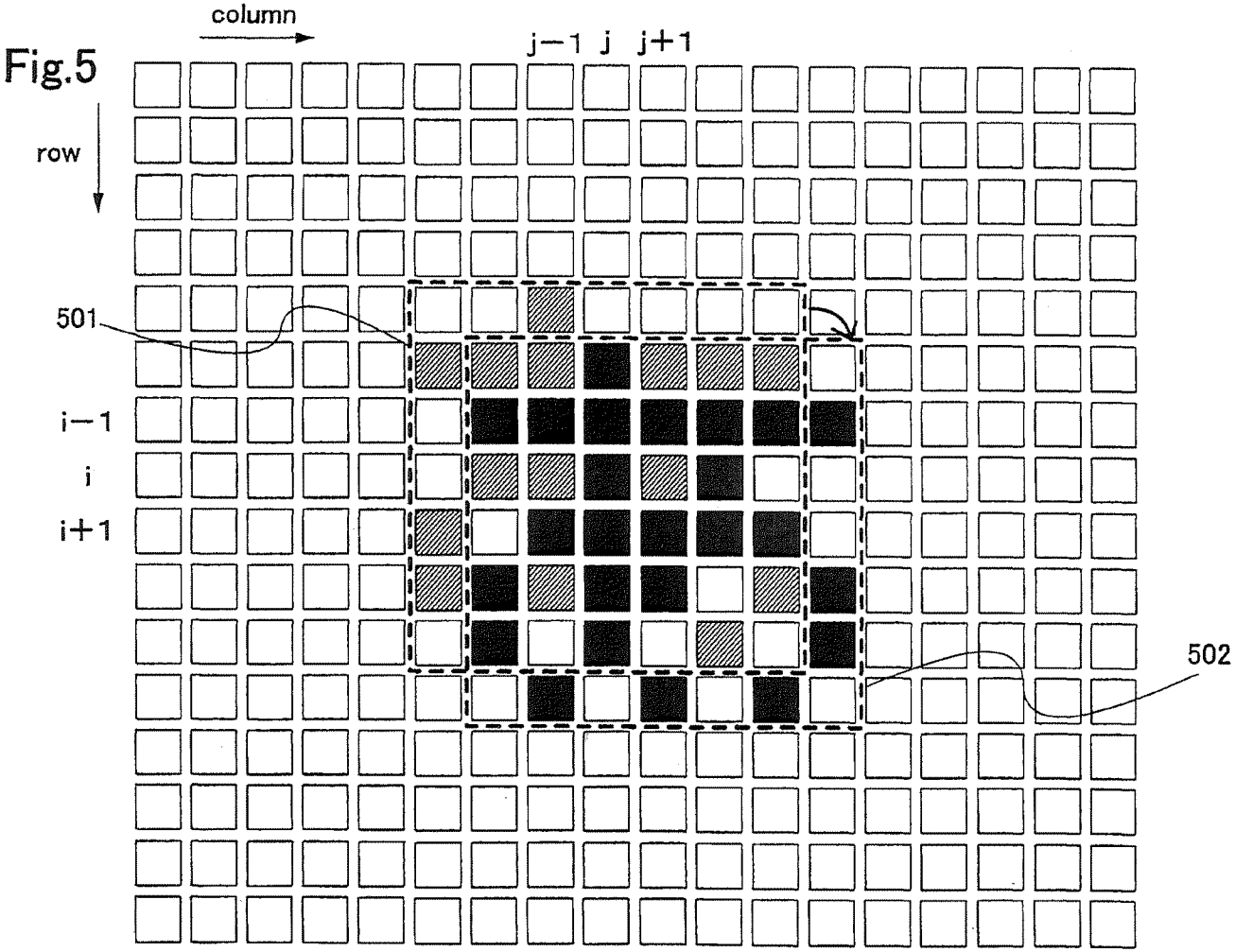
FIG. 5 is a diagram showing a shift of text.

FIG. 5 shows a diagram in the case where a character "one kana character" is shifted by one pixel in the right direction and the down direction. The character "one kana character" before shifted is indicated by shaded pixels, and the character "one kana character" after shifted is indicated by black pixels. As an example, a text block for forming one character corresponds to pixels arranged so as to have a rectangular shape with 7×7 pixels. Note that the text block corresponds to a collection of the smallest rectangular pixels which can display any kind of character which has the same font type and size. The character "one kana character" before shifted is formed by a text block 501, and the character "one kana character" after shifted is formed by a text block 502. That is, the central pixel of the text block 501 before the character is shifted is located in an i-th row and a j-th column, and a central pixel of the text block 502 after the character is shifted is located in an (i+1)th row and a (j+1)th column.

It is to be noted that there is a space (a pixel in which black-and-white inverted display is carried out on the basis of a pixel for forming text) between a character (text block) and a character (text block). The space does not form text in the black; therefore, it is displayed in white mostly. Needless to say, when text is displayed in white, the space is displayed in black mostly. Further, also in a text block, black display or white display is disproportionately carried out in pixels of the center part and four corners.

Figure 6:
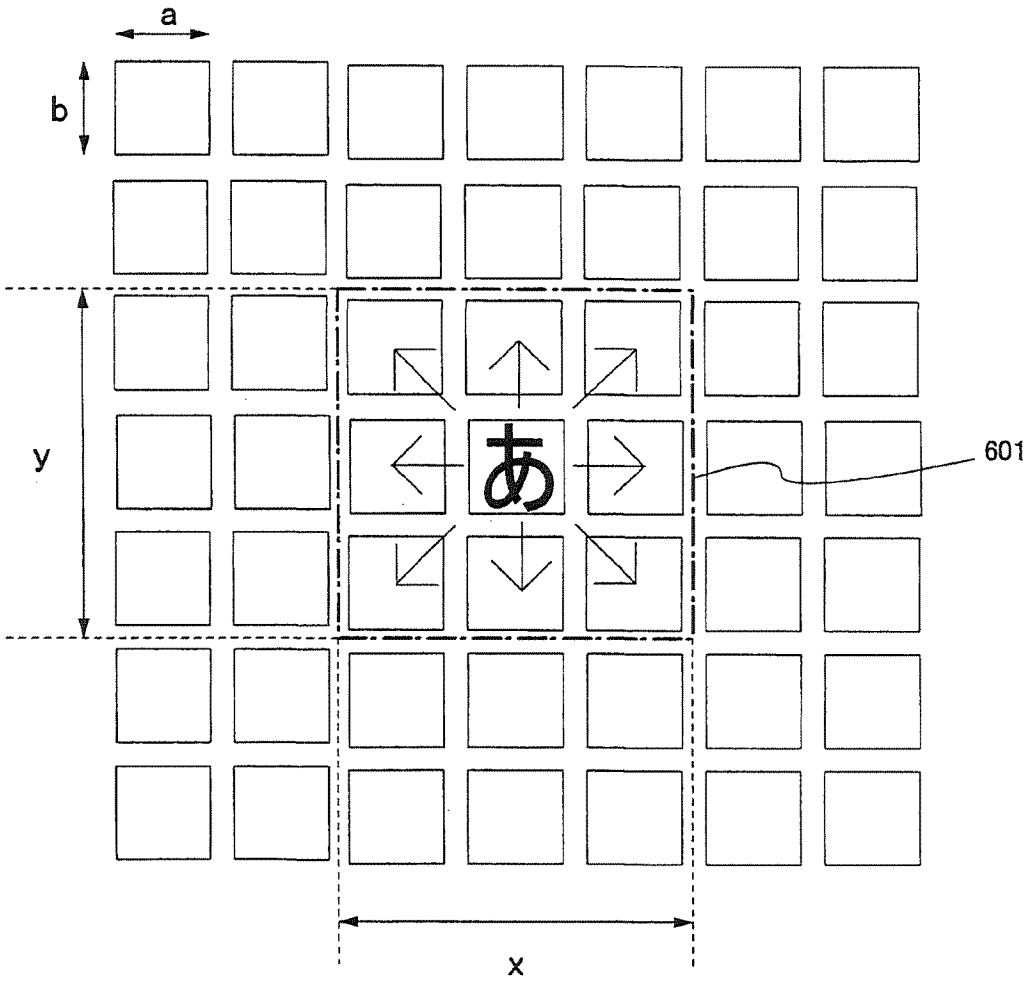
FIG. 6 is a diagram showing a shift of text.
Figure 7:
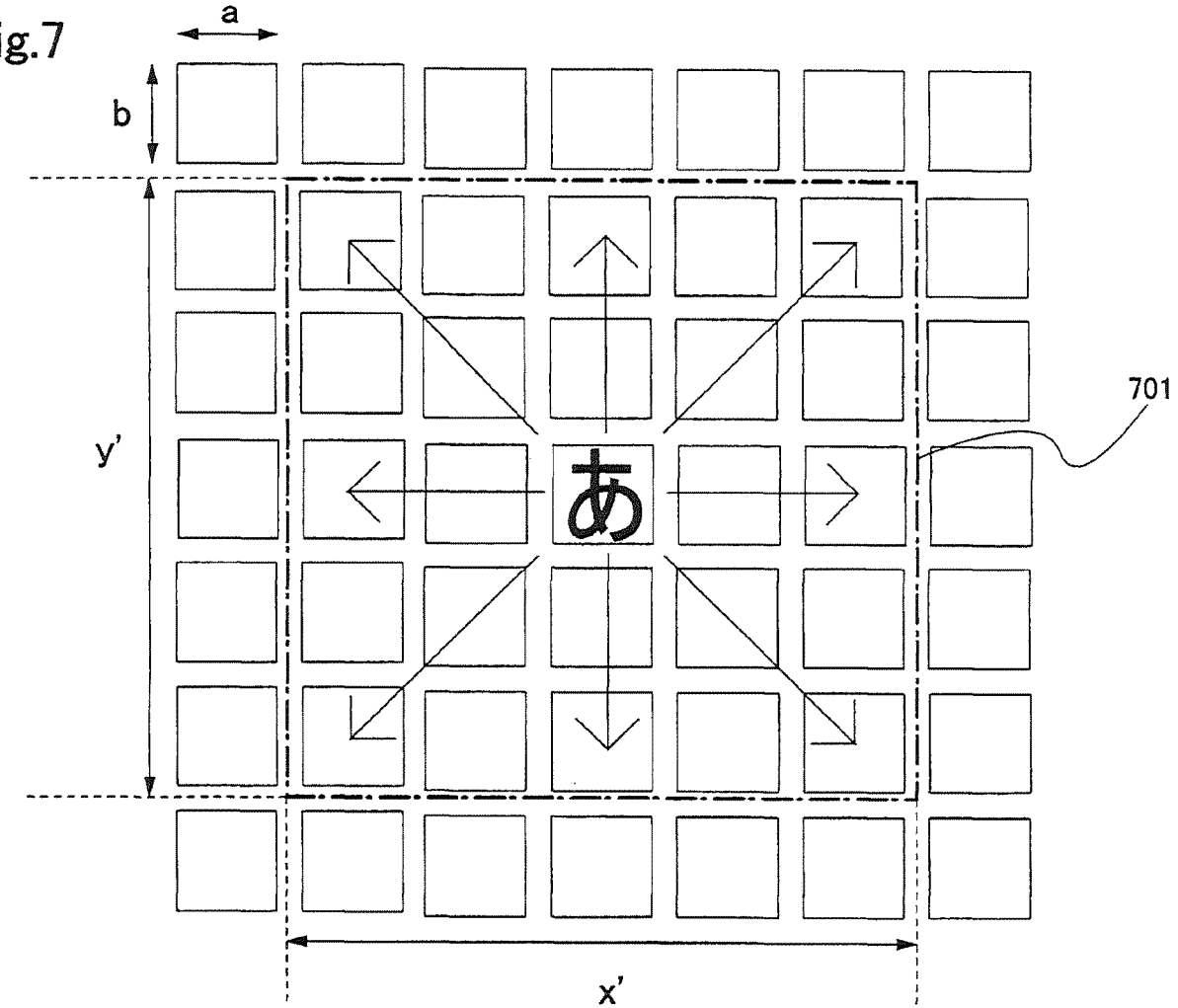
FIG. 7 is a diagram showing a shift of text.

By shifting the character as shown in FIG. 5, the difference in deterioration of display elements in pixels can be reduced and variations in light emission of pixels can be prevented. It is to be noted that a character may be shifted to an adjacent text block in every direction as shown in FIG. 6. Further, a character may be shifted by two text blocks as shown in FIG. 7.

That is to say, when a horizontal length and a vertical length of a text block are respectively denoted by a and b, a horizontal movement width x and a vertical movement width y of a movement region 601 of the character "one kana character" in the case of FIG. 6 satisfy $a<x\leq 3a$ and $b<y\leq 3b$, respectively. Accordingly, when the character is shifted to the maximum in a movement region as shown in FIG. 6, the character before shifted and the character after shifted do not overlap; therefore, the accumulated lighting time of a pixel is easily averaged. Further, a horizontal movement width x' and a vertical movement width y' of a movement region 601 of the character "one kana character" in the case of FIG. 7 satisfy $a<x'\leq 5a$ and $b<y'\leq 5b$, respectively. In such a movement region as shown in FIG. 7, the accumulated lighting time of a pixel is more easily averaged.

A character may be shifted by a color element (1 dot), by a pixel, or by several pixels. For example, in the case where a pixel is formed of color elements of R (red), G (green), and B (blue), a character may be shifted by 1 dot in the right direction and by one pixel in the down direction. That is, when a lighting region before the character is shifted and a lighting region after the character is shifted are denoted by 801 and 802 respectively, one pixel is formed of RGB from the left before the character is shifted, whereas one pixel is formed of GBR from the left after the character is shifted.

It is to be noted that the condition for shifting an image is not limited to the aforementioned. For example, an image may be shifted per day, per hour, or when an electronic appliance remains unoperated for a certain period.

Further, text may be shifted by varying a position coordinate of text data while a background image of the text is not moved by using software. Alternatively, an image may be shifted by windows. That is, an image may be shifted by windows on which text is displayed.

In a pixel portion, an extra pixel may be provided in addition to pixels necessary in a display screen, and a pixel region used for the display screen in the pixel portion is changed, thereby the display screen itself may be shifted.

In the case where text is shifted in a window in which text can be inputted, the text may be shifted each time the text is inputted or the whole text may be shifted after text of one row is inputted. Further, when a plurality of windows are displayed, text may be shifted each time any one of the plurality of windows is selected.

Embodiment Mode 4

In this embodiment mode, in the case where text (such as hiragana, katakana, kanji character, numerical character, or the Roman alphabet) is displayed in a display screen, a condition is set and a font type or a size of text is changed each time the set condition is fulfilled. Text is formed by using as few overlapping pixels as possible before and after the font type is changed, thereby the difference in deterioration of display elements in pixels can be reduced. Accordingly, variations in light emission of pixels can be prevented.

Figure 23:
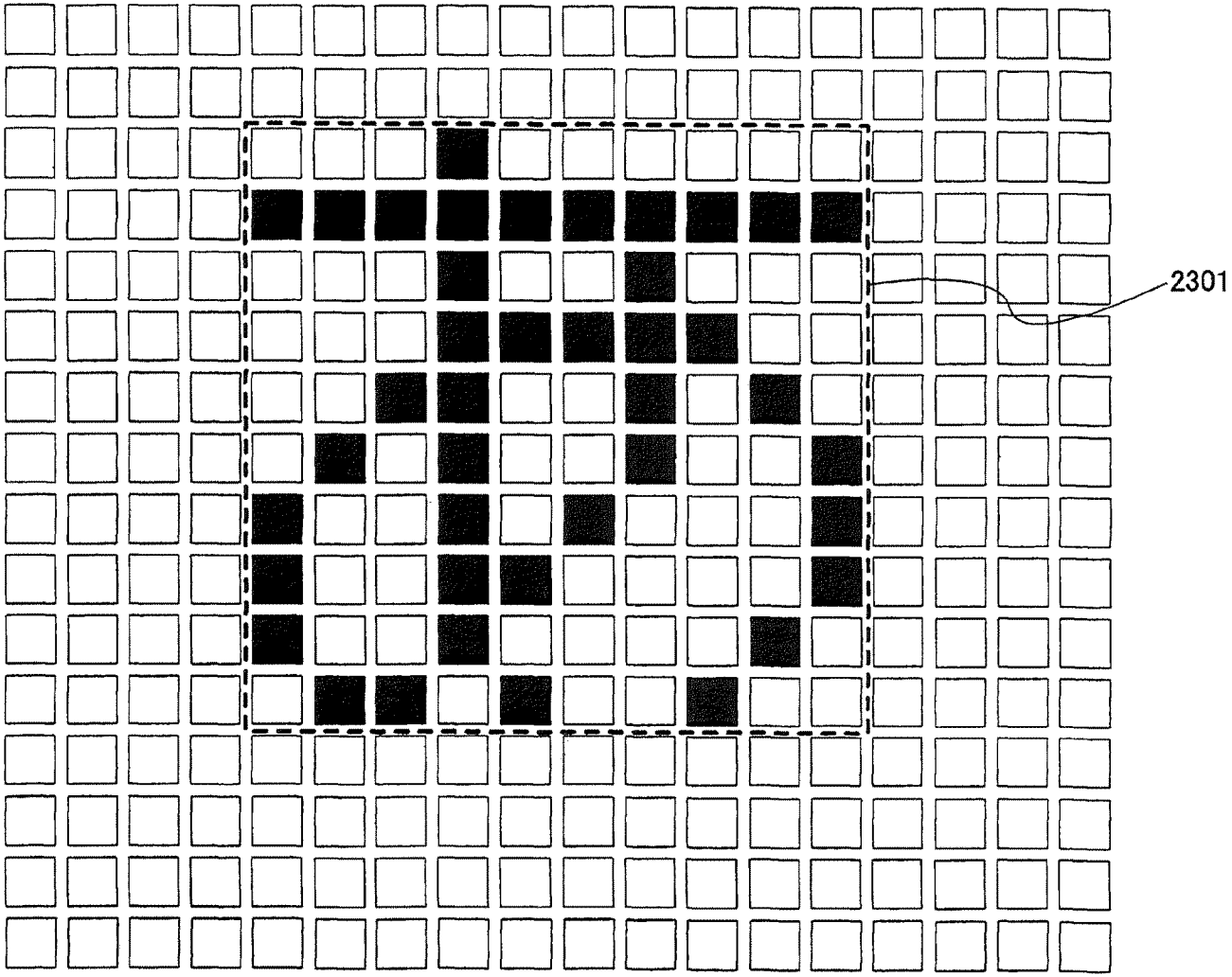
FIG. 23 is a diagram showing a font type of text.
Figure 24:
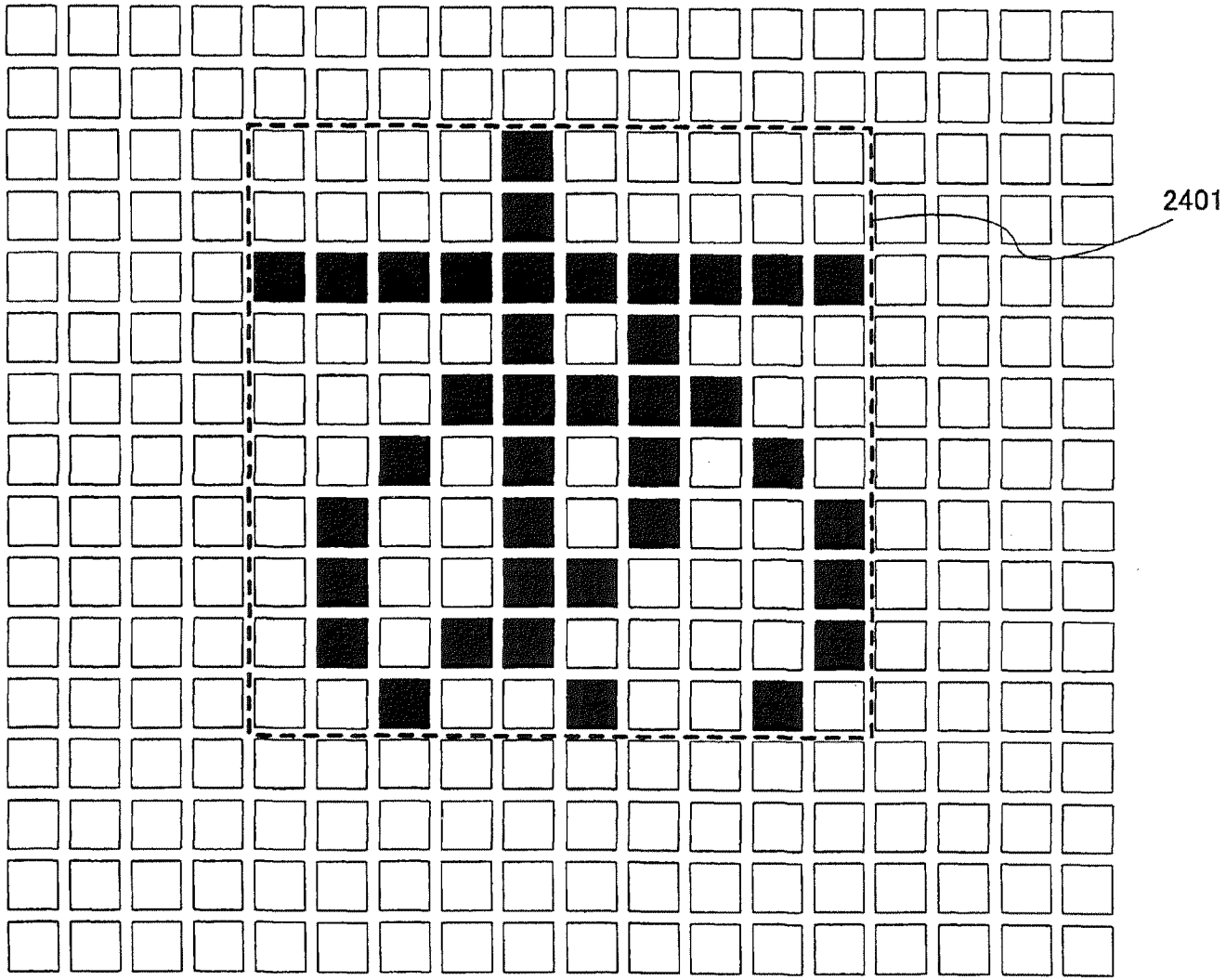
FIG. 24 is a diagram showing a font type of text.
Figure 25:
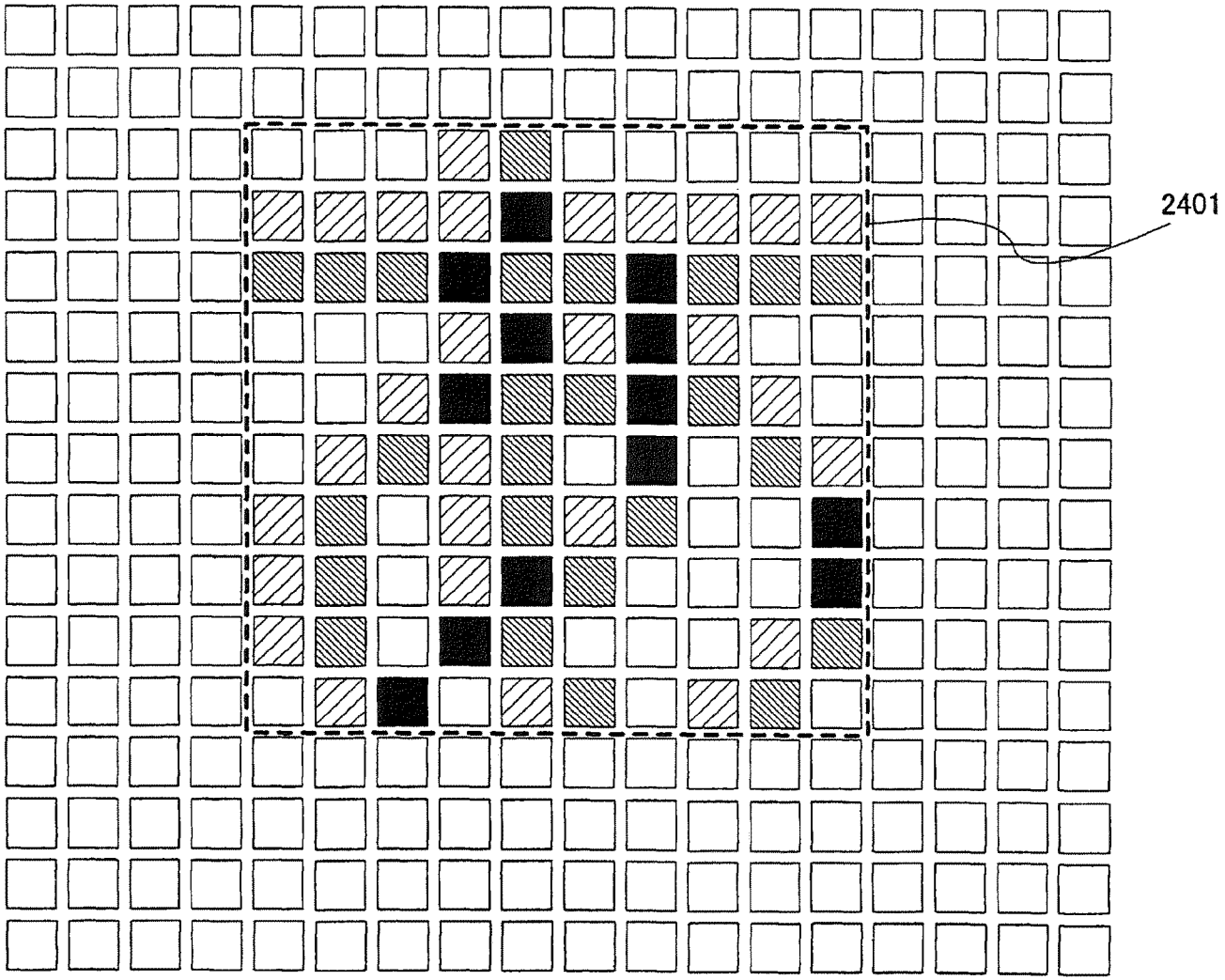
FIG. 25 is a diagram showing a change of a font type of text.

First, description is made of a case where a font type of text is changed. As an example, description is made of the case where a character "one kana character" is displayed when a text block is formed of 10×10 pixels. In some cases, "one kana character" having such a font as shown in FIG. 23 is displayed. Then, when a certain condition is fulfilled, the font of the character "one kana character" is changed to a such a font as shown in FIG. 24. In the case of the font shown in FIG. 23, black display is carried out in 41 pixels for forming the character "one kana character". Further, in the case of the font shown in FIG. 24, black display is carried out in 38 pixels for forming the character "one kana character". In FIG. 25, the character "one kana character" having the font of FIG. 23 is formed by pixels filled with rising diagonal strokes from bottom left to top right, and the character "one kana character" having the font of FIG. 24 is formed by pixels filled with falling diagonal strokes from top left to bottom right. Pixels which are used in both cases are blackened. That is to say, when the certain condition is fulfilled and the font of "one kana character" is changed from the one shown in FIG. 23 to the one shown in FIG. 24, 13 pixels are used for forming text in both cases. In other words, the number of pixels that are deteriorated easily is reduced and pixels used for forming text are dispersed. As a result, the difference in deterioration of display elements in pixels can be reduced and an image burn-in phenomenon can be suppressed.

Figure 10:
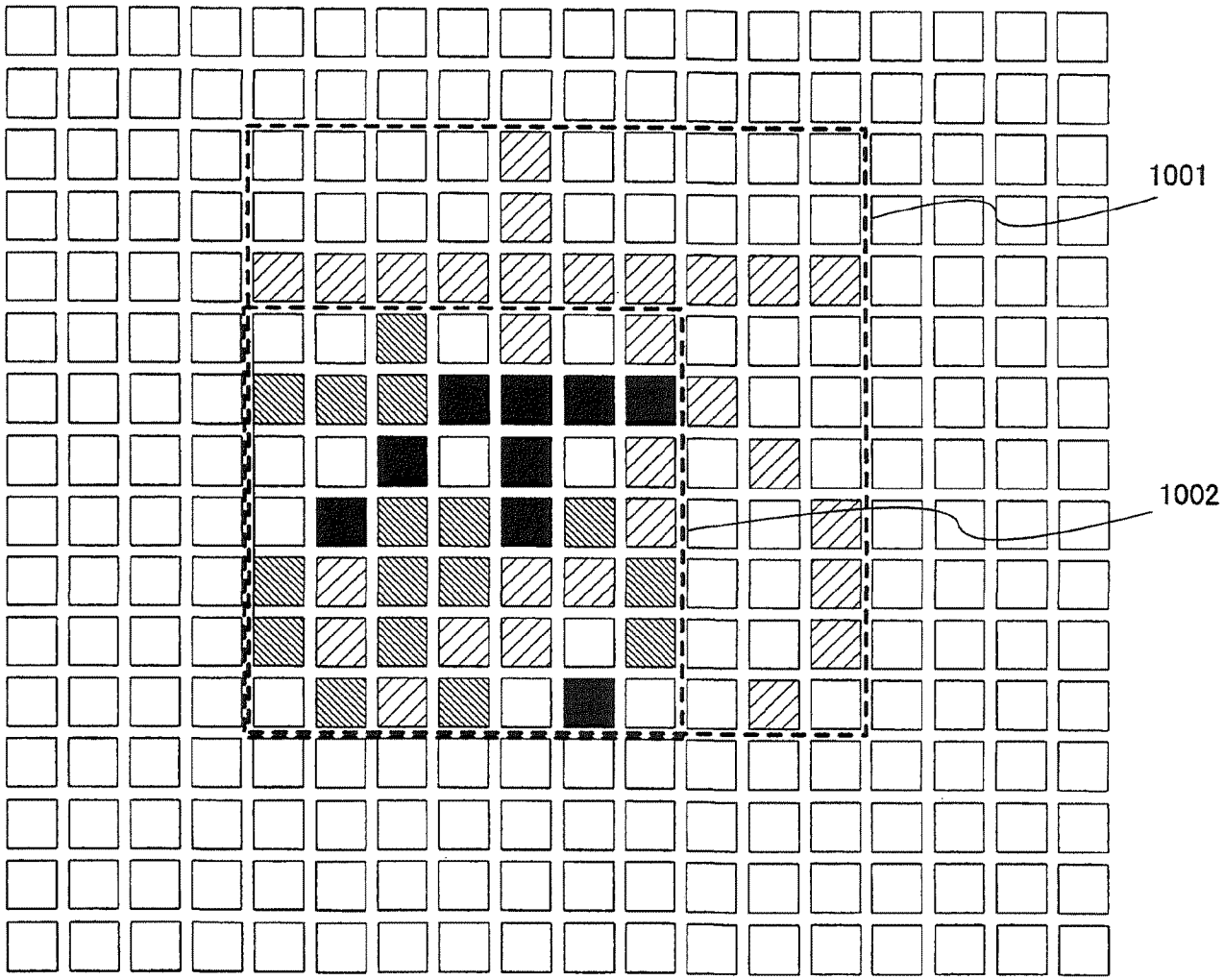
FIG. 10 is a diagram showing a change of a size of text.

Subsequently, description is made of a case where a size of text is changed. As an example, FIG. 10 shows a change from the case where a text block 1001 is formed of 10×10 pixels to the case where a text block 1002 is formed of 7×7 pixels. The character "one kana character" having the size of the text block 1001 is formed by pixels filled with rising diagonal strokes from bottom left to top right, and the character "one kana character" having the size of the text block 1002 is formed by pixels filled with falling diagonal strokes from top left to bottom right. Pixels which are used in both cases are blackened. In the case of the character "one kana character" having the size of the text block 1001, black display is carried out in 38 pixels. Further, in the case of the character "one kana character" having the size of the text block 1002, black display is carried out in 25 pixels. That is to say, when the certain condition is fulfilled and the size of the character "one kana character" in the text block 1001 is changed to that of the character "one kana character" in the text block 1002, 9 pixels are used for forming text in both cases. This means that the number of pixels that are deteriorated easily is reduced and pixels used for forming text are dispersed. As a result, the difference in deterioration of display elements in pixels can be reduced and an image burn-in phenomenon can be suppressed.

Figure 9A:
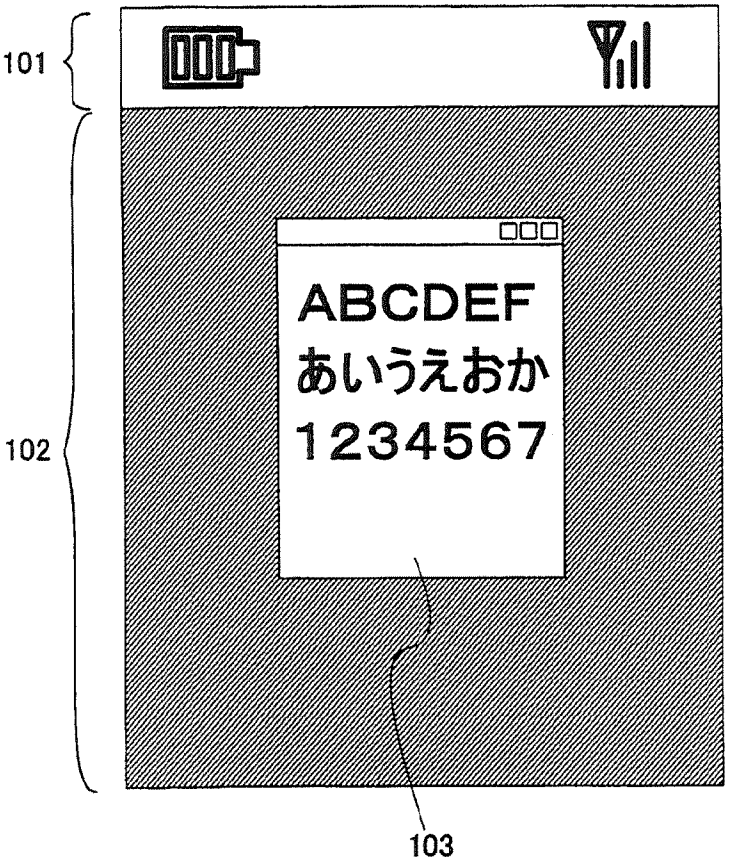
FIGS. 9A and 9B are diagrams each showing a change of a font type of text.
Figure 9B:
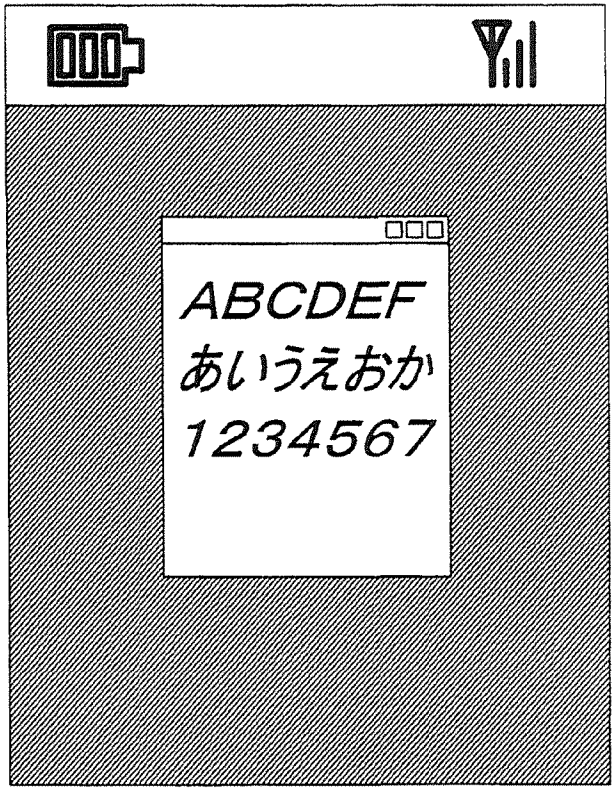

For example, a font type or a size of text may be changed in a window. In FIG. 9A, a display screen includes the pictogram display region 101 and the main display region 102 in which the window 103 is displayed. In FIG. 9A, text is displayed in the window 103 in the black text mode. When a certain condition is fulfilled, a font type of the text displayed in the window 103 is changed as shown in FIG. 9B. Accordingly, the number of pixels that are deteriorated easily is reduced and pixels used for forming text are dispersed. As a result, the difference in deterioration of a display element in each pixel can be reduced and an image burn-in phenomenon can be suppressed.

Further, the accumulated lighting time of a pixel in a display screen is preferably set so as to be almost equivalent by considering the size.

It is to be noted that the condition for changing a font type or a size is not limited to the aforementioned. For example, a font type or a size may be shifted per day (depending on whether on odd days or even days), per hour (depending on whether in odd hours or even hours), or when an electronic appliance remains unoperated for a certain period.

Embodiment Mode 5

In this embodiment mode, description is made of a method for suppressing image burn-in of a specific pattern displayed on a display screen, such as a small picture or symbol (hereinafter referred to as an icon) expressing a content of processing or an object to be processed.

Figure 11:
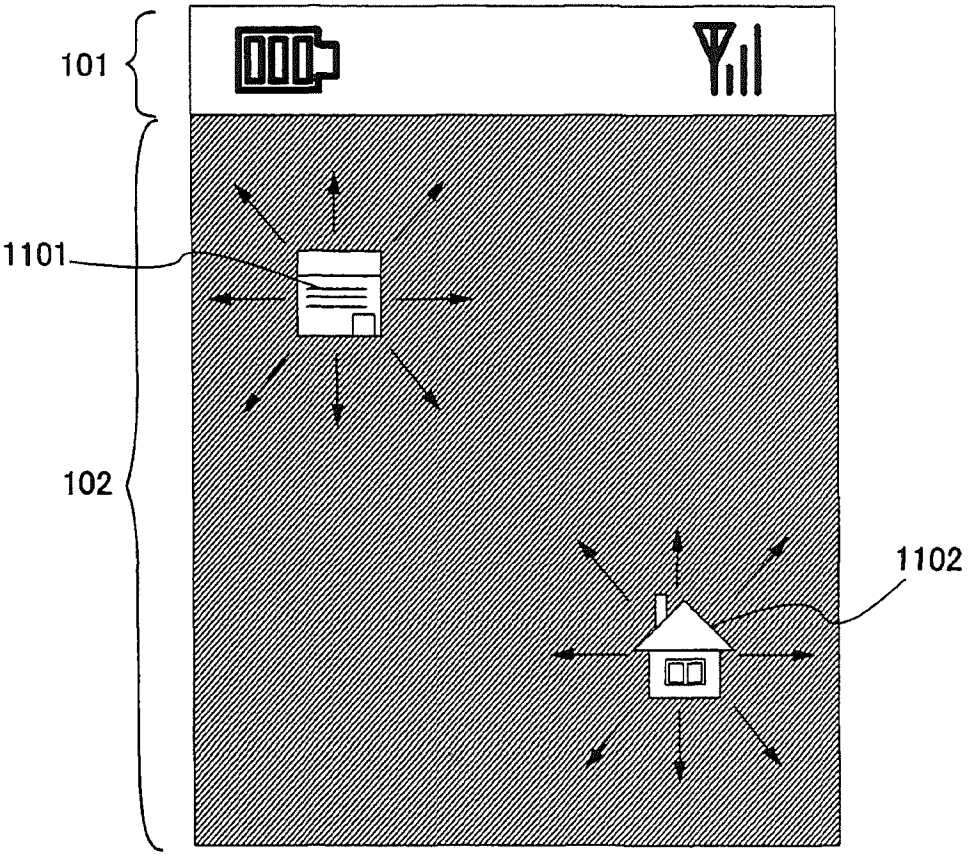
FIG. 11 is a diagram showing a shift of an icon.

As shown in FIG. 11, a display screen includes the pictogram display region 101 and the main display region 102 in which an icon 1101 and an icon 1102 are displayed. It is to be noted that a background image may be displayed behind the icon 1101 and the icon 1102 in the main display region 102. When a certain condition is fulfilled, the icon 1101 and the icon 1102 are moved in the vertical, horizontal, or oblique direction.

Figure 13:
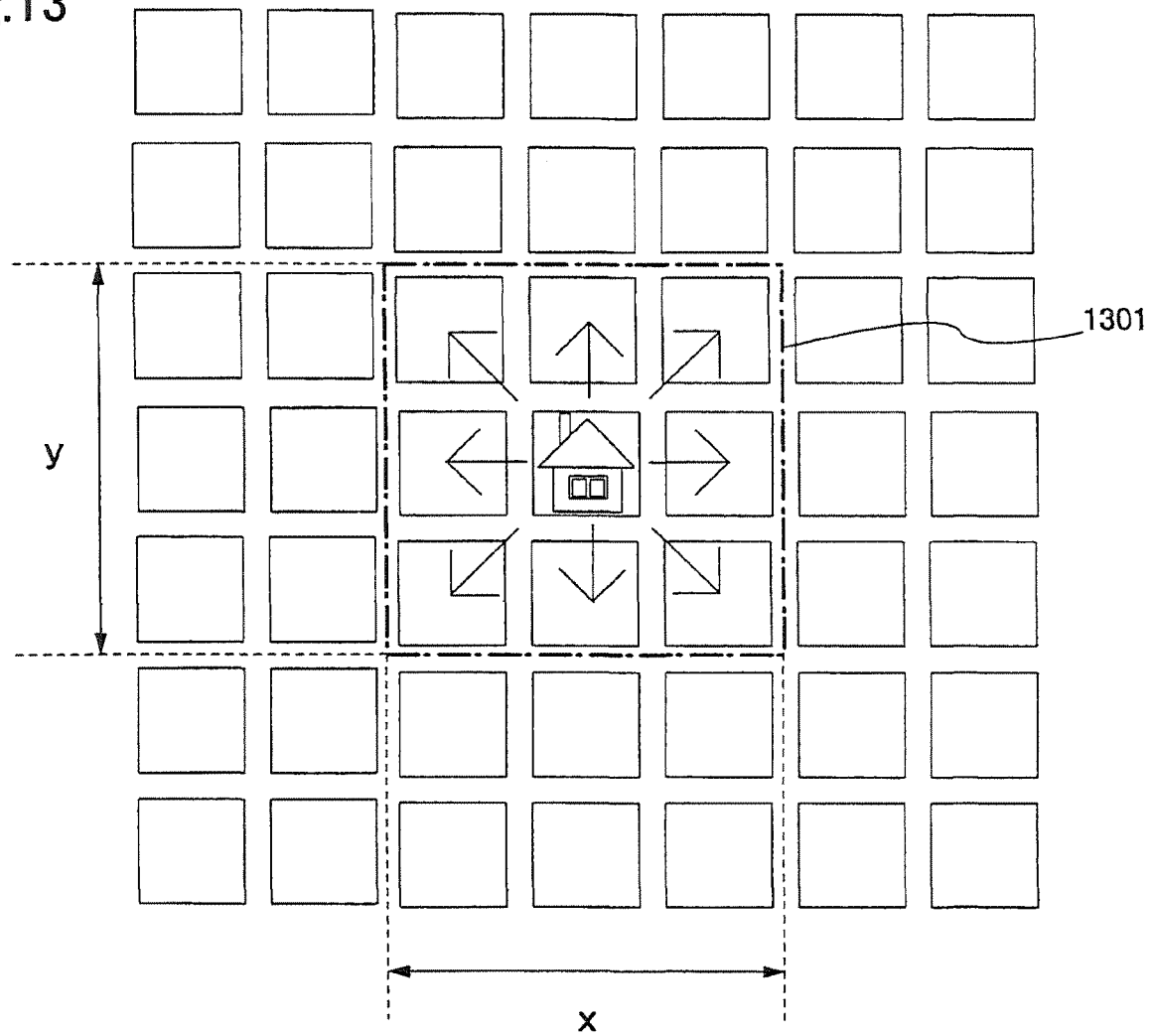
FIG. 13 is a diagram showing a shift of an icon.
Figure 14:
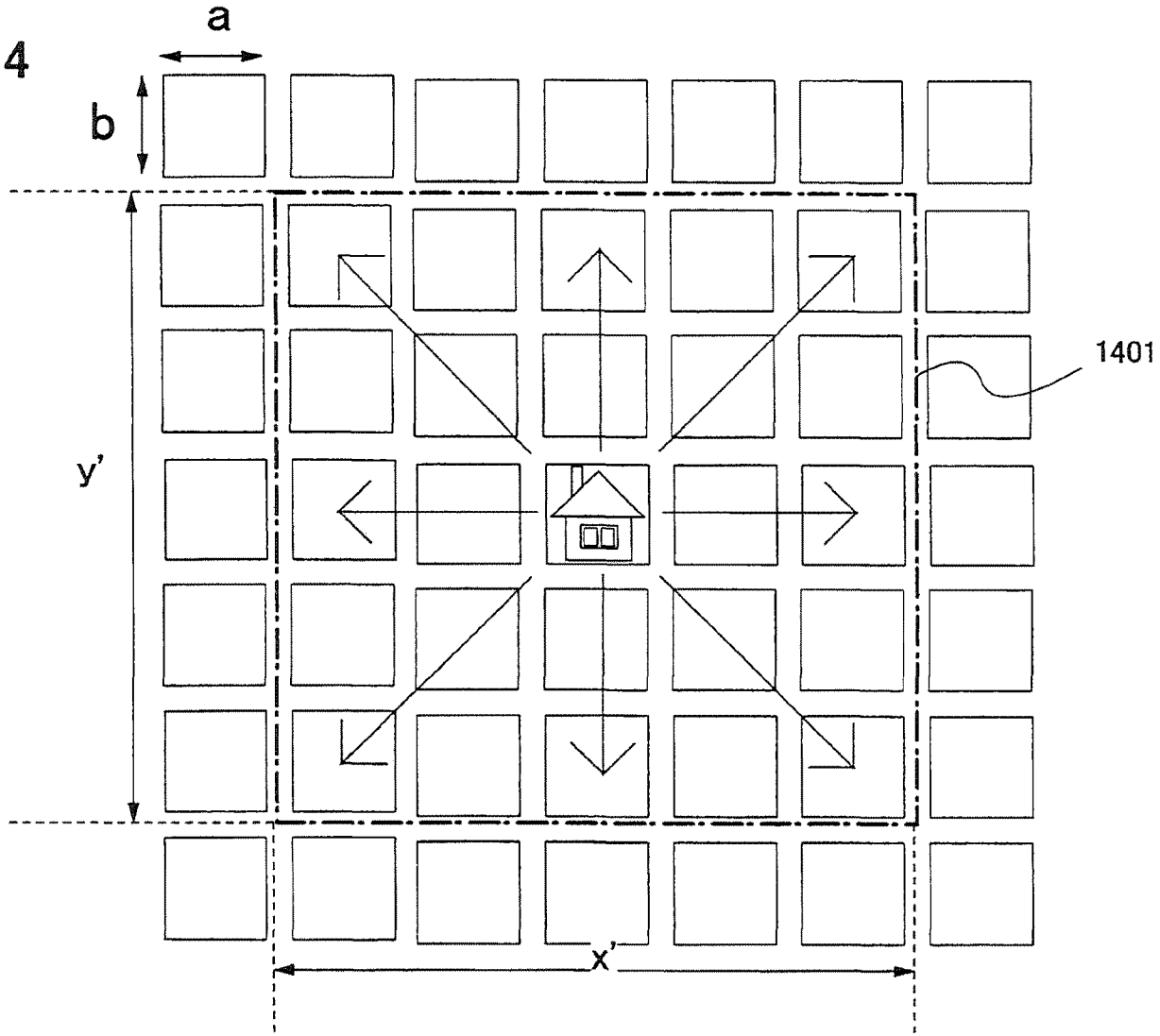
FIG. 14 is a diagram showing a shift of an icon.

It is to be noted that an icon may be shifted to an adjacent text block in every direction as shown in FIG. 13 or shifted by two text blocks as shown in FIG. 14. Note that an icon block corresponds to a collection of the smallest rectangular pixels, which can form an icon.

That is to say, when a horizontal length and a vertical length of an icon block are respectively denoted by a and b, a horizontal movement width x and a vertical movement width y of a movement region 1301 of an icon in the case of FIG. 13 satisfy $a<x\leq 3a$ and $b<y\leq 3b$, respectively. Accordingly, when text is shifted to the maximum in such a movement region as shown in FIG. 13, an icon before shifted and the icon after shifted do not overlap; therefore, the accumulated lighting time of a pixel is easily averaged. Further, a horizontal movement width x' and a vertical movement width y' of a movement region 1401 of an icon in the case of FIG. 14 satisfy $a<x'\leq 5a$ and $b<y'\leq 5b$, respectively. In such a movement region as shown in FIG. 14, the accumulated lighting time of a pixel is more easily averaged.

Figure 8:
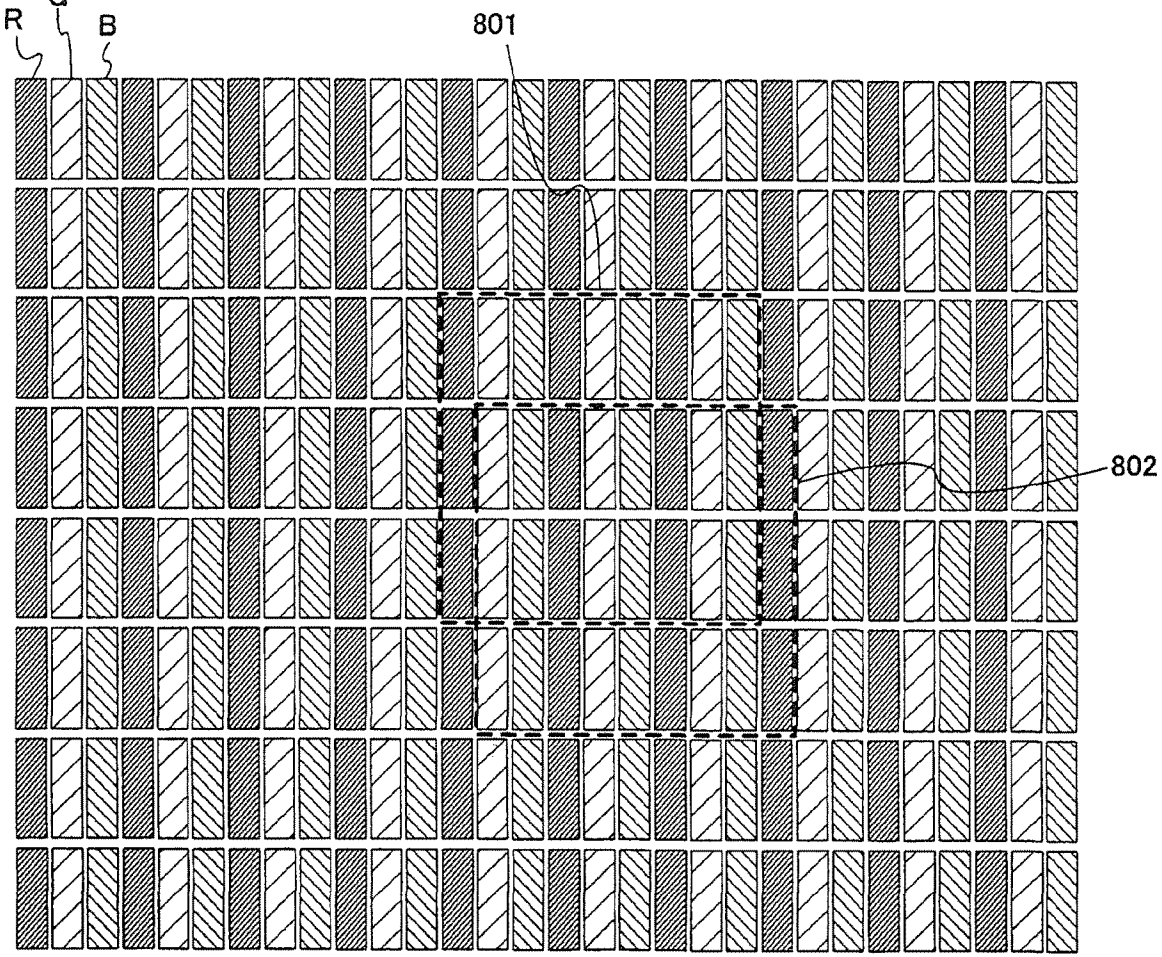
FIG. 8 is a diagram showing a shift of an image.

Text may be shifted by a color element (1 dot), by a pixel, or by several pixels. For example, in the case where a pixel is formed of color elements of R (red), G (green), and B (blue), text may be shifted by 1 dot in the right direction and by one pixel in the down direction as shown in FIG. 8. That is, when a lighting region before the text is shifted and a lighting region after the text is shifted are denoted by 801 and 802 respectively, one pixel is formed of RGB from the left before the text is shifted, whereas one pixel is formed of GBR from the left after the text is shifted.

Figure 12B:
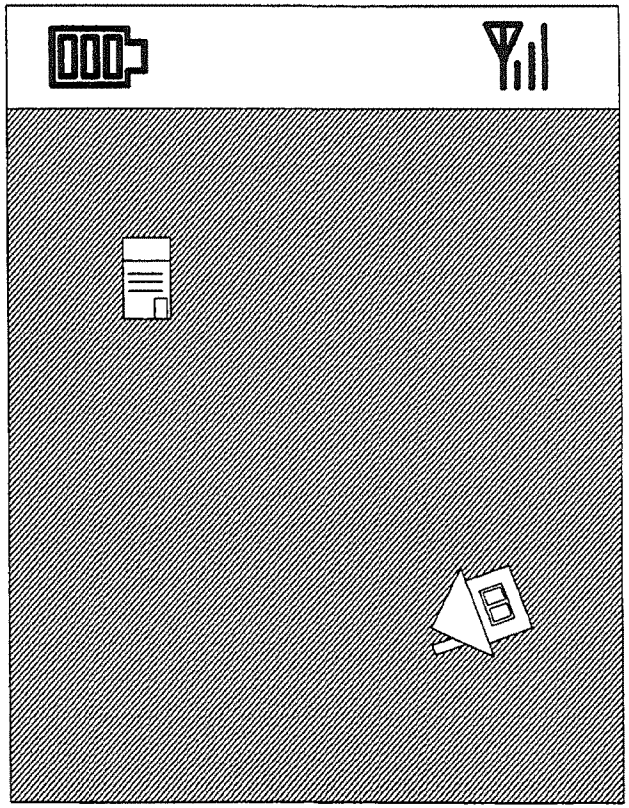
FIGS. 12A and 12B are diagrams each showing rotation of an icon.
Figure 12A:
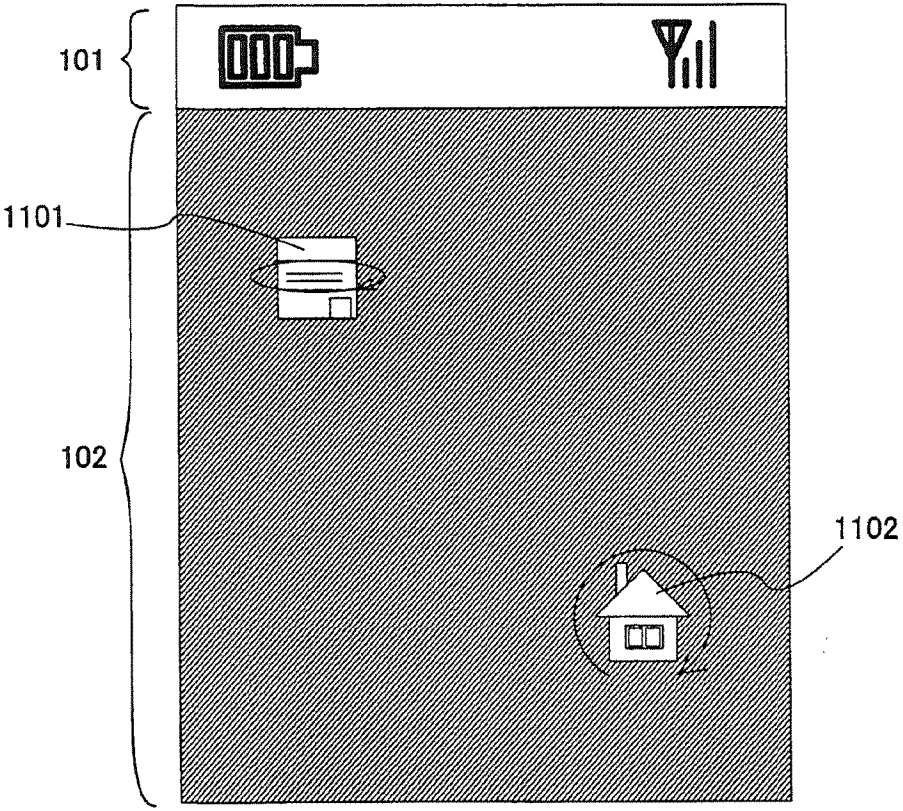

An icon is not necessarily moved. As shown in FIG. 12A, an icon itself may rotate. In FIG. 12A, an icon 1101 displayed on a plane surface rotates in a back-to-front direction. An icon 1102 displayed on the plane surface rotates around the axis of the plane surface. Therefore, the icon 1101 at a certain moment has a narrow width and the icon 1102 at another moment is inclined as shown in FIG. 12B.

It is to be noted that the condition for shifting an icon is not limited to the aforementioned. For example, an icon may be shifted by several pixels in vertical and horizontal directions constantly; per day; per hour; or when an electronic appliance remains unoperated for a certain period. Further, a color of an icon may be changed each time the icon is shifted, or an icon may be shifted while blinking. In the case where a portable terminal has a function of camera, an icon may be shifted each time a shutter button is pressed. It is preferable that the icon be shifted faster than the speed of exposure.

Further, an icon may be displayed translucently or gradation display may be carried out and gradations may be changed.

Figure 20A:
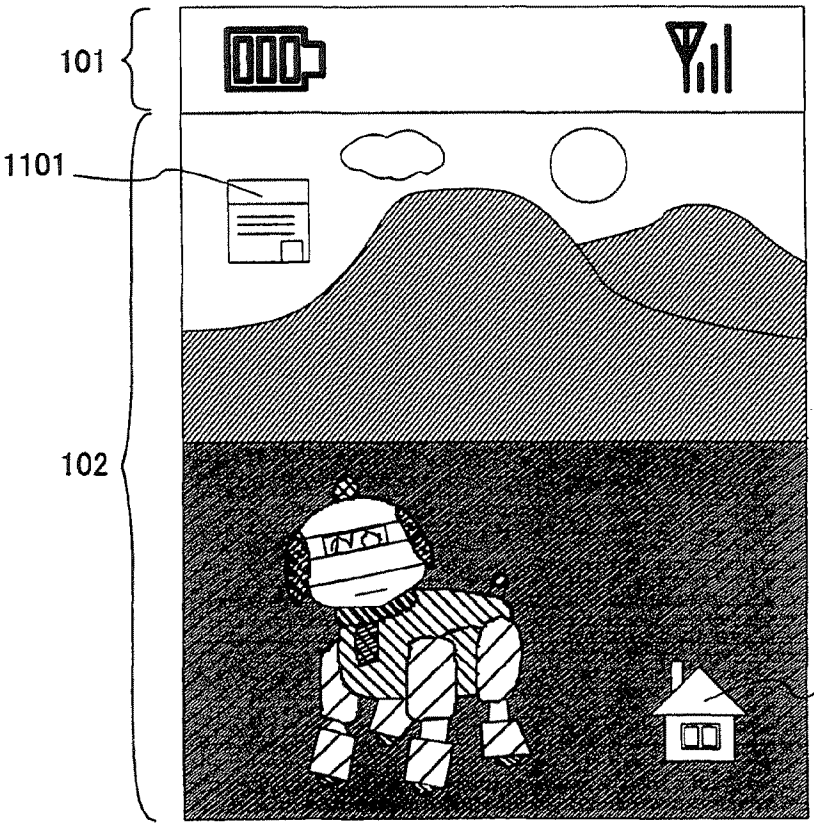
FIGS. 20A and 20B are diagrams each showing a displaying method of the invention.
Figure 20B:
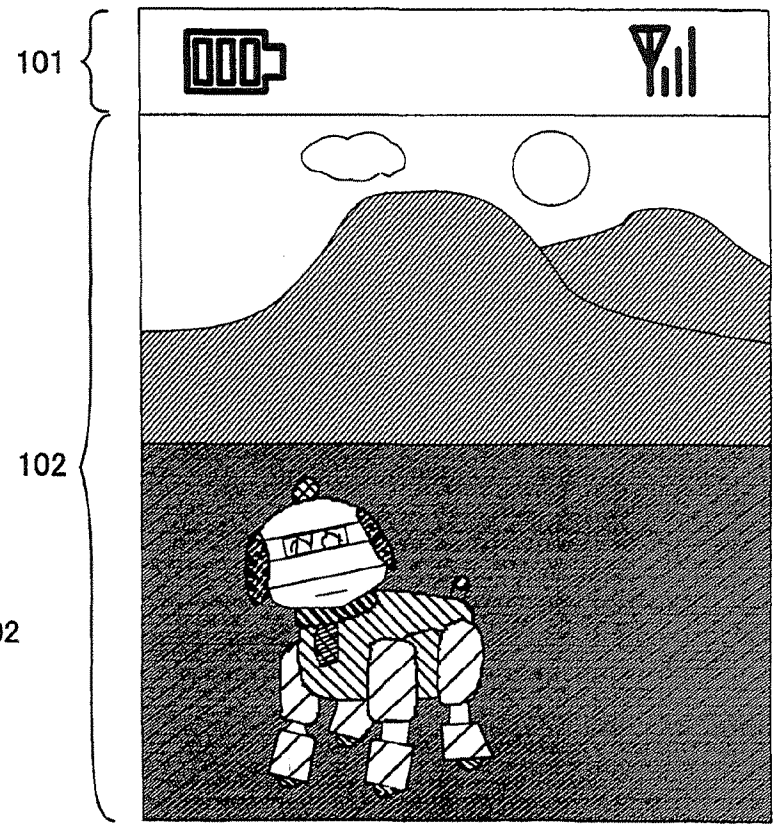

In the case where an icon 1101 and an icon 1102 are displayed in a background image of a main display region 102 as shown in FIG. 20A, the icon 1101 and the icon 1102 may be set so as not to be displayed when a portable terminal remains unoperated for a certain period. For example, the icon 1101 and the icon 1102 may be set so as not to be displayed when a portable terminal remains unoperated for approximately five to ten minutes. Meanwhile, the icon 1101 and the icon 1102 may be set so as to be displayed when the portable terminal is operated; for example, a button is pressed. Further, a color of the icon 1101 or the icon 1102 may be changed each time the button is pressed.

Further, a position where an icon is displayed may be changed on start-up or in accordance with a set date.

The time in which an icon is displayed may be counted not per pixel but per icon, and a signal to be inputted to a pixel for forming the icon may be corrected. That is, the accumulated displaying time of the icon and the accumulated lighting time of a pixel in a region where the icon is not displayed (hereinafter referred to as a reference pixel) are counted, thereby measuring the difference in deterioration between display elements of a pixel in an icon portion and a reference pixel. Then, luminance is corrected so that the luminance of the pixel in the icon portion and that of the reference pixel are equivalent. It is to be noted that the luminance of a pixel can be corrected by controlling a current or voltage applied to a display element or light emitting time.

Figure 53:
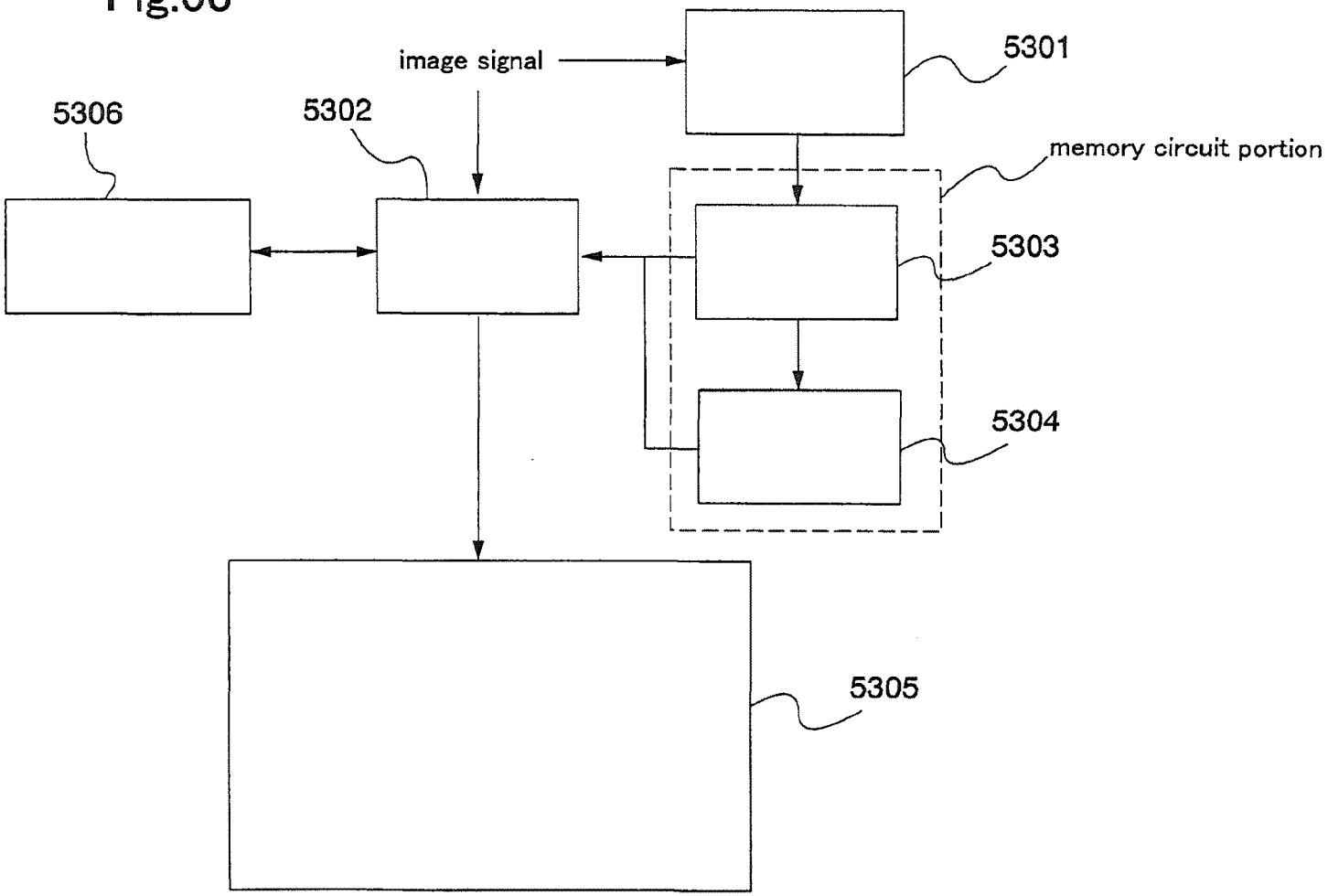
FIG. 53 is a block diagram of a display device of the invention.

Here, FIG. 53 shows a block diagram of a display device capable of counting the displaying time of an icon per icon and correcting a signal to be inputted to a pixel for forming the icon.

A display device includes a counter 5301, a correcting circuit 5302, a volatile memory 5303, a nonvolatile memory 5304, a display panel 5305, and a corrected data storage portion 5306.

First, data on changes with time of luminance characteristics of a display element included in the display panel 5305 is stored in the corrected data storage portion 5306 in advance. This data is used when a signal is corrected to make the luminance of a pixel in an icon portion and that of a reference pixel equal to each other.

The counter 5301 regularly samples an image signal and counts data of displaying/non-displaying of an icon and data of lighting/non-lighting of a reference pixel. The data counted by the counter 5301 is sequentially stored in a memory circuit portion. Here, the data is accumulated; therefore, the memory circuit portion is preferably formed using a nonvolatile memory. However, the number of writing to the nonvolatile memory is generally limited; therefore, data is stored in the volatile memory 5303 in operation of the display device while the data is written to the nonvolatile memory 5304 at a certain interval (for example, per hour, at shutdown of a power source, or the like).

Figure 54:
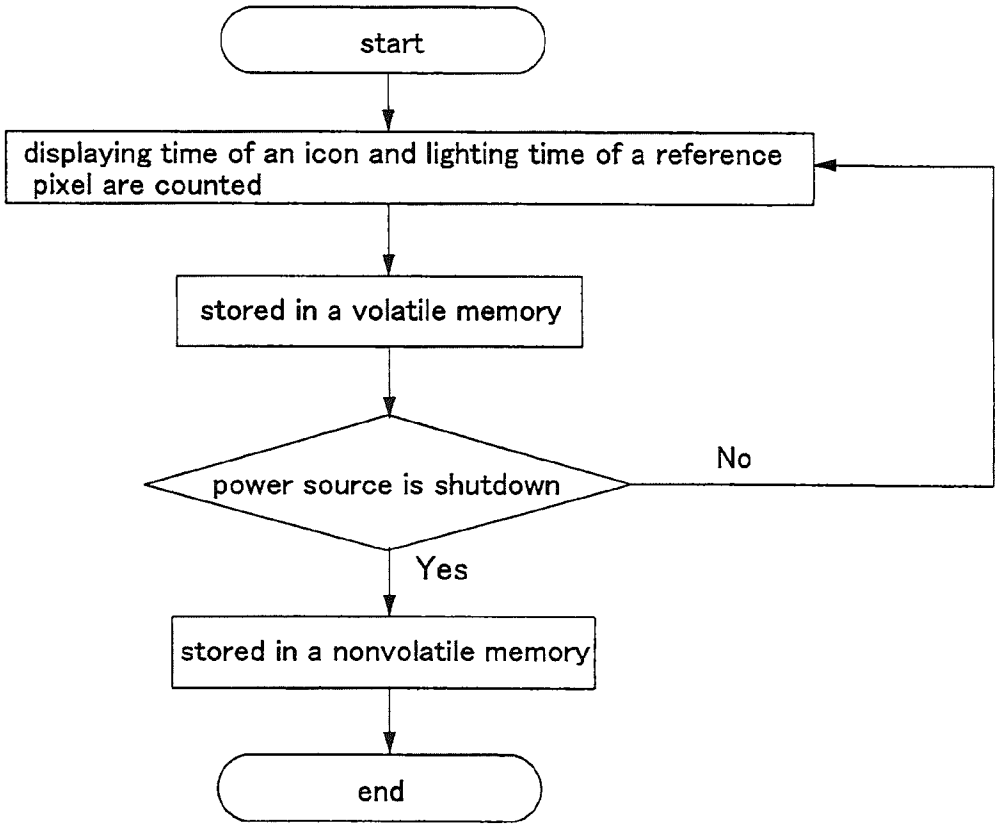
FIG. 54 is a flow chart showing a process for storing data in a memory circuit portion.
Figure 55:
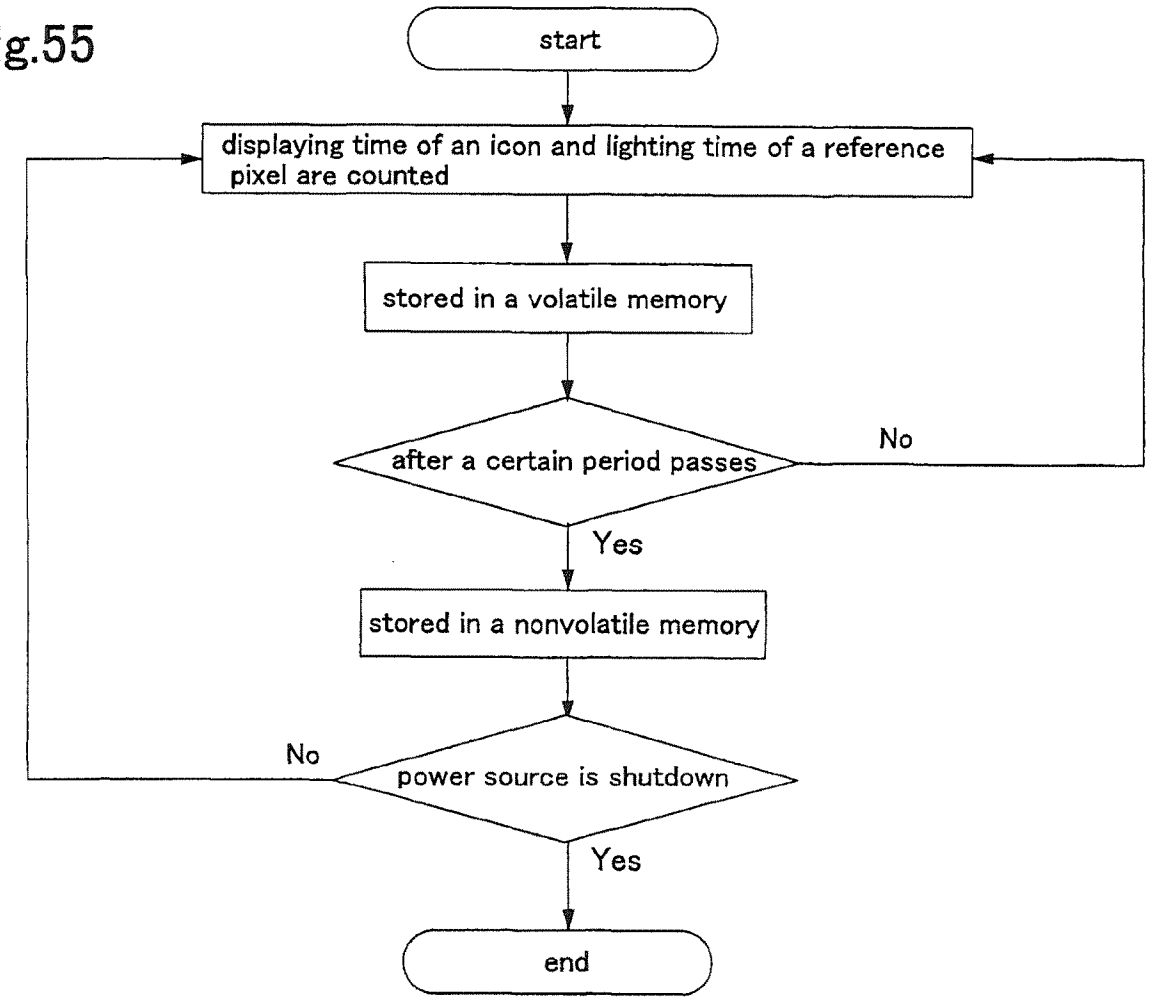
FIG. 55 is a flow chart showing a process for storing data in a memory circuit portion.

FIGS. 54 and 55 each show a flow chart representing counting operation of displaying time of an icon and lighting time of a reference pixel until a power source is shutdown and storing operation of data of the displaying time and the lighting time in the memory circuit portion.

In the case of FIG. 54, displaying time of an icon and lighting time of a reference pixel are regularly counted, and data thereof is stored in a volatile memory. When a power source is shutdown, the data stored in the volatile memory is stored in a nonvolatile memory.

In the case of FIG. 55, displaying time of an icon and lighting time of a reference pixel are regularly counted, and data thereof is stored in a volatile memory. After a certain period passes, the data stored in the volatile memory is stored in a nonvolatile memory. As long as a power source is not shutdown, the aforementioned operation is repeated. It is to be noted that the data stored in the volatile memory may be stored in the nonvolatile memory when the power source is shutdown.

In the case where a gray scale is expressed by controlling luminance with a display element, it is preferable that both the lighting time and the lighting intensity of the display element at this time be detected, and a state of deterioration be determined by the lighting time and the lighting intensity. In this case, data for correction is made in accordance with them.

As a memory used for a memory circuit, a static memory, a dynamic memory, a ferroelectric memory, a flash memory, or the like may be used; however, the memory circuit which can be applied to the display device of the invention is not limited to these. Note that in the case of using a dynamic memory for the volatile memory, a regular refresh function is additionally required.

Subsequently, correcting operation of image signals starts. The image signals and data of the accumulated displaying time of an icon and the accumulated lighting time of a reference pixel are inputted to the correcting circuit 5302. The correcting circuit 5302 measures the difference in deterioration between a pixel in an icon portion and a reference pixel from the data of the accumulated displaying time of an icon and the accumulated lighting time of a reference pixel, and corrects the inputted image signals by referring the data that is stored in the corrected data storage portion 5306 in advance. In this manner, the corrected image signals are inputted to the display panel 5305. Note that correction at this time corresponds to reduction in the difference in luminance between the pixel in the icon portion and the reference pixel.

At shutdown of the power source, the accumulated displaying time of an icon and the accumulated lighting time of a reference pixel which are stored in a volatile memory circuit are respectively added to the accumulated displaying time of an icon and the accumulated lighting time of a reference pixel which are stored in a nonvolatile memory circuit and they are stored. Accordingly, after a power source is turned on next time, the accumulated displaying time of an icon and the accumulated lighting time of a reference pixel are cumulatively counted.

As described above, the displaying time of an icon and the lighting time of a reference pixel are regularly detected and the accumulated displaying time and the accumulated lighting time are stored, thereby deterioration of a pixel in an icon portion in which display is often carried out can be corrected. That is, by correcting the image signals, the luminance of a pixel in an icon portion and that of a reference pixel can be made equal, and image burn-in of a pattern of an icon can be suppressed.

Further, the number of reference pixels may be two or more. That is, the difference between averaged deterioration of a plurality of reference pixels and deterioration of a pixel in an icon portion may be measured by the averaged accumulated lighting time of the plurality of reference pixels and the accumulated displaying time of an icon. Further, an icon to be taught may be specified by a user.

Further, setting of an icon may be changed by a user. That is, the displayed position, color, luminance, shape, kind, size, or the like of an icon may be changed by a user. Furthermore, an icon may blink or rotate, and the movement range of an icon may be set. In addition, animation (movement to continuously (or discontinuously when movements before and after a change are related) change a shape of an icon) may be made by a user.

Embodiment Mode 6

In this embodiment mode, a method for suppressing image burn-in of a pattern of a pictogram displayed in a pictogram display region is described.

Figure 15:
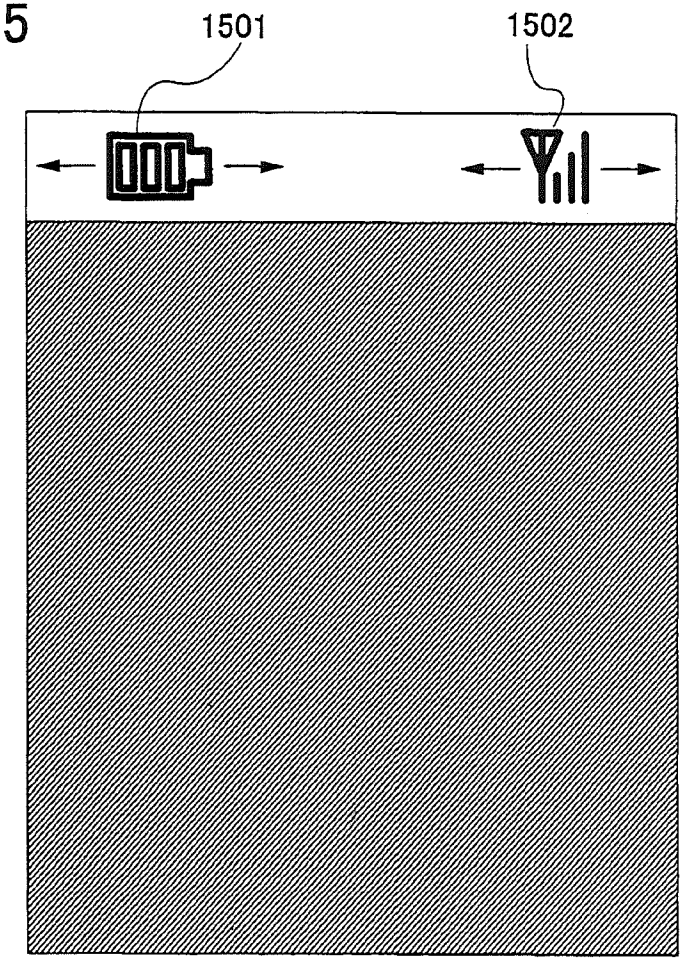
FIG. 15 is a diagram showing a shift of a pictogram.
Figure 16B:
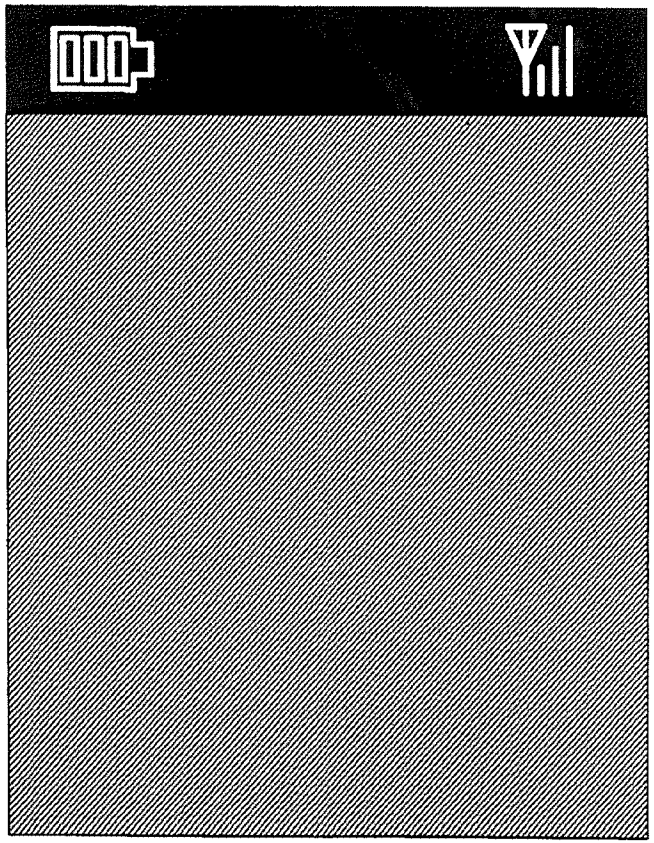
FIGS. 16A and 16B are diagrams each showing inversion of a color of text in a pictogram display region between white and black.
Figure 16A:
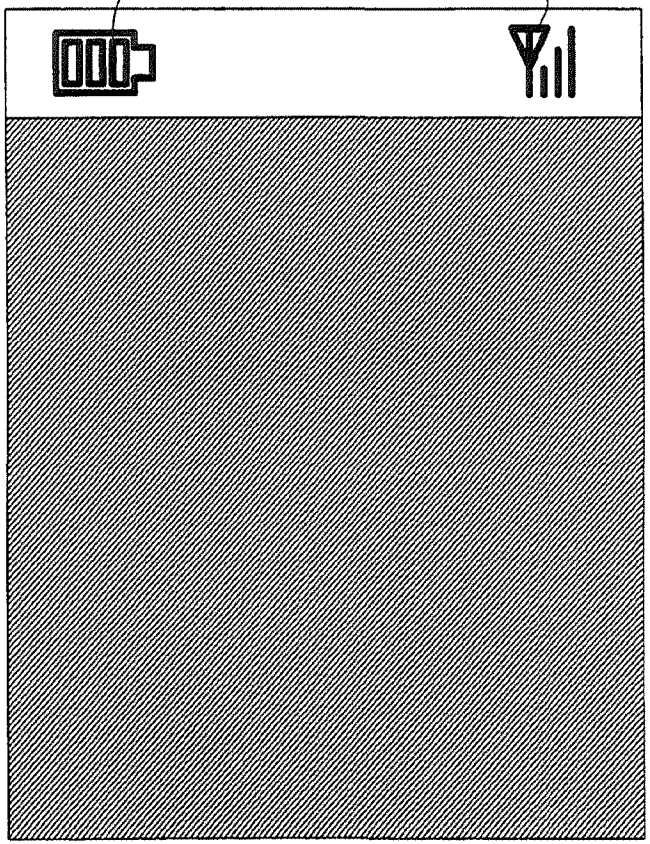

As shown in FIG. 15, a pictogram 1501 and a pictogram 1502 may be shifted in the pictogram display region 101. Note that "a pictogram is shifted" means that a combination of pixels which contribute to display of a pictogram is changed. A pictogram may be shifted in a vertical direction as well as a horizontal direction as shown in FIG. 15. Further, the pictogram 1501 and the pictogram 1502 may rotate. As shown in FIGS. 16A and 16B, a color of a pictogram display region can be inverted between white and black. As shown in FIG. 16A, a background of the pictogram display region 101 is displayed in white and the pictogram 1501 and the pictogram 1502 are displayed in black until a certain condition is fulfilled. When the certain condition is fulfilled, the background of the pictogram display region 101 is displayed in black and the pictogram 1501 and the pictogram 1502 are displayed in white. When black-and-white inverted display is carried out as described in this embodiment mode, the difference in deterioration in pixels can be reduced. As a result, variations in light emission of pixels can be suppressed.

It is to be noted that the condition for shifting a pictogram is not limited to the aforementioned. For example, a pictogram may be shifted per day, per hour, or when an electronic appliance remains unoperated for a certain period.

Further, a pattern of image burn-in of a pictogram may be prepared in advance, so that luminance in the portion may be changed by a user. That is, in the case where a background of the pictogram display region is displayed in white and the pictogram 1501 and the pictogram 1502 are displayed in black as shown in FIG. 16A, luminance of the background can be increased by operation of a user. Meanwhile, in the case where a background of the pictogram display region is displayed in black and the pictogram 1501 and the pictogram 1502 are displayed in white as shown in FIG. 16B, luminance of the pictogram 1501 and the pictogram 1502 can be increased by operation of a user.

For example, luminance of a pictogram or a background of a pictogram display region may be changed each time a button is pressed. Alternatively, luminance of a portion which is touched may be changed in a touch panel method. Description is simply made below using a flow chart.

Figure 57:
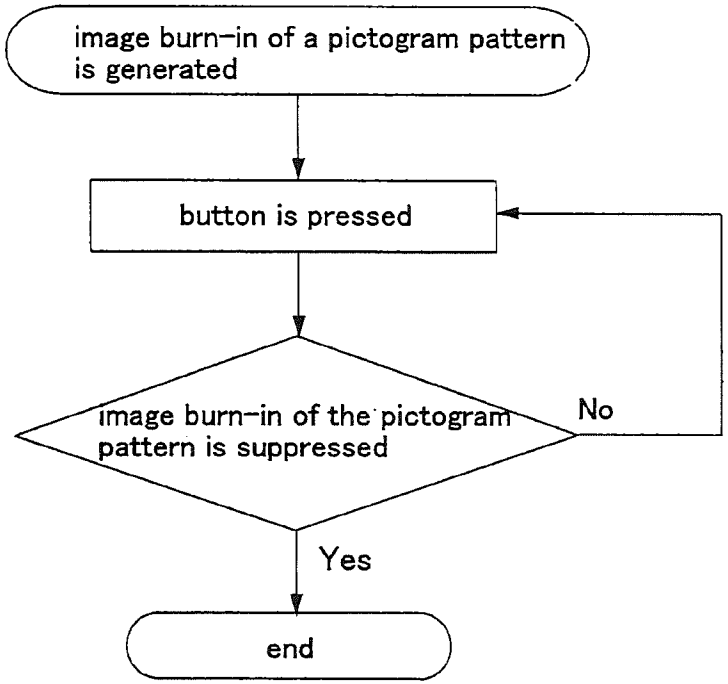

First, FIG. 57 shows a flow chart in the case where image burn-in of a pictogram pattern is corrected by operation with a button. As shown in FIG. 57, when image burn-in of a pictogram pattern is generated, a button for correcting luminance in a pictogram portion where the image burn-in pattern is generated is pressed. Luminance of a pictogram or a background behind the pictogram is changed each time the button is pressed. The button is pressed until the image burn-in of the pictogram pattern is suppressed. In this manner, the image burn-in of the pictogram pattern can be freely corrected by a user to the extent that the image burn-in of the pictogram pattern cannot be sensed.

Figure 56:
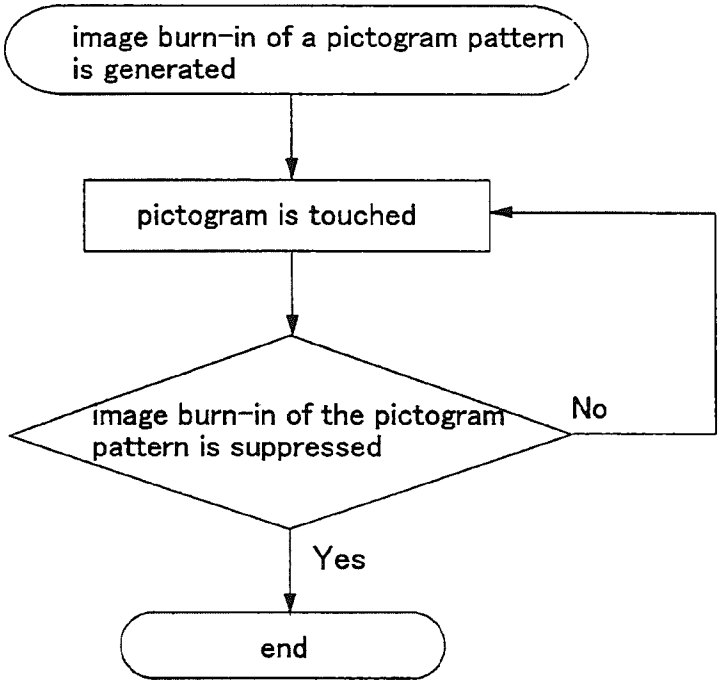

FIG. 56 shows a flow chart in the case where a touch panel method is employed and image burn-in of a pictogram pattern is corrected by touching operation. As shown in FIG. 56, when image burn-in of a pictogram pattern is generated, a pictogram portion where the image burn-in pattern is generated is touched. Luminance of a pictogram or a background behind the pictogram is changed each time the pictogram portion is touched. The pictogram portion is touched until the image burn-in of the pictogram pattern is suppressed. In this manner, the image burn-in of the pictogram pattern can be freely corrected by a user to the extent that the image burn-in of the pictogram pattern cannot be sensed.

Embodiment Mode 7

In this embodiment mode, when variations in light emission of each pixel are generated and image burn-in is generated, aging is carried out. It is to be noted that "aging" means that a current is applied to a display element of a pixel so as to actively deteriorate the display element of the pixel. That is to say, while charging or the like is carried out, a pixel is set so as to emit light, thereby a display element of the pixel is deteriorated. Thus, a pixel lagging behind in deterioration is actively deteriorated, so that the difference in deterioration of display elements in pixels of a pixel portion is reduced.

Figure 18:
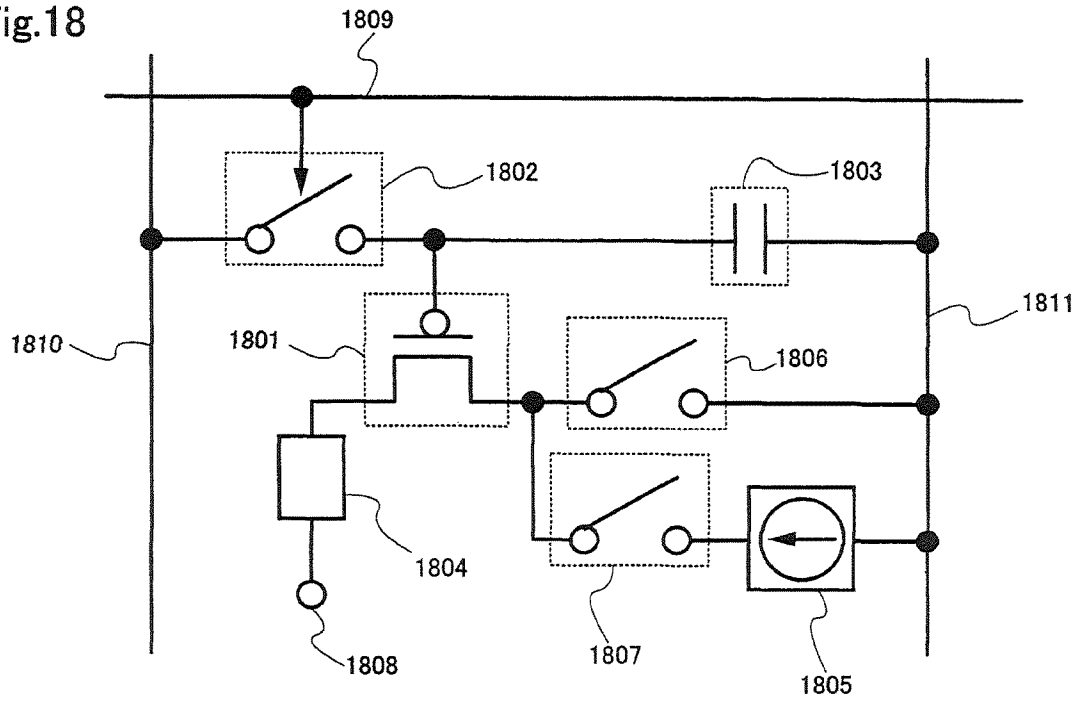
FIG. 18 is a diagram showing a pixel structure which can be applied to a display device of the invention.

FIG. 18 shows a pixel structure of a display device described in this embodiment mode. A pixel includes a transistor 1801, a first switch 1802, a capacitor 1803, a display element 1804, a current source circuit 1805, a second switch 1806, a third switch 1807, a first wire 1809, a second wire 1810, and a third wire 1811. It is to be noted that the transistor 1801 is a p-channel transistor.

The first switch 1802 is connected so that a gate terminal of the transistor 1801 and the second wire 1810 are controlled to be electrically connected or disconnected. Then, a signal supplied to the first wire 1809 is inputted to a control terminal of the first switch 1802. The first switch 1802 is turned on or off in accordance with the signal. When the first switch 1802 is in an on state, the second wire 1810 and the gate terminal of the transistor 1801 are electrically connected. On the other hand, when the first switch 1802 is in an off state, the second wire 1810 and the gate terminal of the transistor 1801 are electrically disconnected.

A gate terminal of the transistor 1801 is connected to the third wire 1811 through the capacitor 1803, a first terminal (one of a source terminal and a drain terminal) of the transistor 1801 is connected to the third wire 1811 through the second switch 1806, and a second terminal (the other of the source terminal and the drain terminal) of the transistor 1801 is connected to a pixel electrode of the display element 1804. That is to say, the second switch 1806 is connected so that the first terminal of the transistor 1801 and the third wire 1811 are controlled to be electrically connected or disconnected. When the second switch 1806 is in an on state, the first terminal of the transistor 1801 and the third wire 1811 are electrically connected. On the other hand, when the second switch 1806 is in an off state, the first terminal of the transistor 1801 and the third wire 1811 are electrically disconnected.

The third switch 1807 is connected in series to the current source circuit 1805, which are connected in parallel to the second switch 1806. That is, when the third switch 1807 is in an on state, the current source circuit 1805 and the first terminal of the transistor 1801 are electrically connected.

A predetermined potential is applied to a counter electrode 1808 of the display element 1804.

Subsequently, operation of the pixel is described.

In writing operation to a pixel, the first switch 1802 and the second switch 1806 are turned on. Then, a charge for a voltage corresponding to a video signal is accumulated in the capacitor 1803 from the second wire 1810. That is, the voltage becomes a gate-source voltage of the transistor 1801. Therefore, the transistor 1801 is controlled to be turned on or off by the voltage. Note that, a video signal inputted to turn on the transistor 1801 has a voltage with which the transistor 1801 operates in a linear region.

When the transistor 1801 is turned on, a voltage which is a potential difference of a potential supplied to the third wire 1811 and a potential applied to the counter electrode 1808 of the display element 1804 is applied between electrodes of the display element 1804. Then, a pixel is in a lighting state.

A video signal is inputted to each pixel, thereby signal writing operation is completed and each pixel is in either a lighting state or a non-lighting state. Therefore, only 2 gray scale levels can be expressed if nothing is done. By using a time gray scale method or an area gray scale method, multi-gray scale display can be carried out.

Here, a digital time gray scale method is described with reference to FIG. 27.

Figure 27:
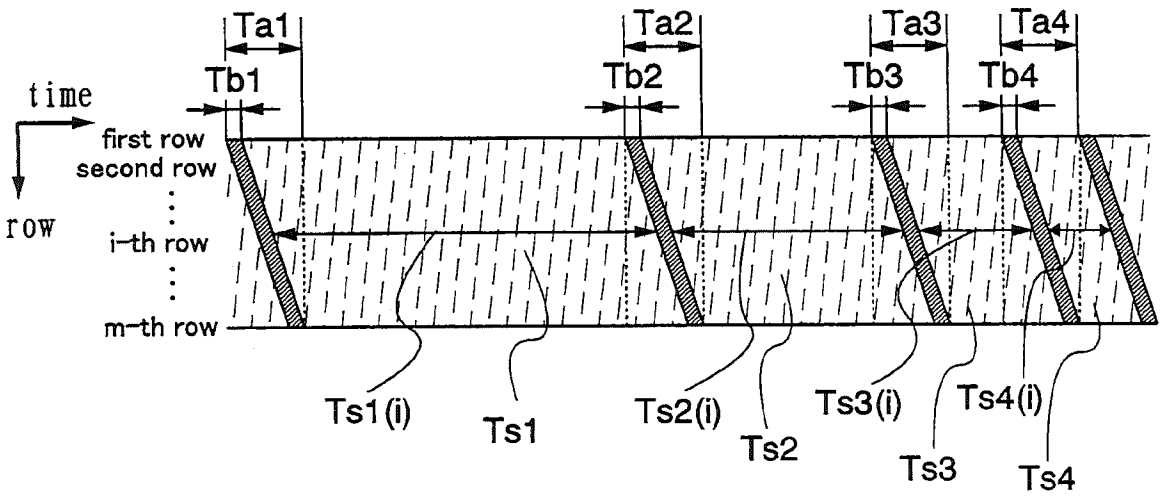
FIG. 27 is a diagram showing a driving method using a time gray scale method.

FIG. 27 is a diagram showing operation in one frame period with time. In FIG. 27, the horizontal direction indicates passage of time and the vertical direction indicates the number of scan rows of scan lines.

When images are displayed, writing operation and light emitting operation are repeated. A period in which writing operation and light emitting operation for one screen (one frame) are carried out is referred to as one frame period. Although there is no particular limitation on a process of signals for one frame, it is preferable that the number of processes be at least approximately 60 times per second so as not to make a viewer notice flickers.

As shown in FIG. 27, one frame period is time-divided into four subframe periods including address periods Ta1, Ta2, Ta3, and Ta4 and sustain periods Ts1, Ts2, Ts3, and Ts4. That is, each pixel row is time-divided into writing periods Tb1, Tb2, Tb3, and Tb4 and light emission periods Ts1(*i*), Ts2(*i*), Ts3(*i*), and Ts4(*i*). When a signal for light emission is inputted to a pixel, a light emitting element therein is in a light emission state in the sustain period. A ratio of lengths of light emission time in each subframe period is Ts1(*i*):Ts2(*i*):Ts3(*i*):Ts4(*i*)$=2^3:2^2:2^1:2^0=8:4:2:1$, thereby a 4-bit gray scale can be expressed. However, the numbers of bits and gray scale levels are not limited to those described here, for example, eight subframe periods may be provided to express an 8-bit gray scale.

Operation of one frame period is described. First, in the address period Ta1, writing operation is carried out in the writing time Tb1 of each row from the first to last rows. That is, scan signals are sequentially inputted to a scan line from the first row, thereby pixels are selected. Then, when the pixel is selected, a video signal is inputted from a signal line to the pixel. Depending on the potential thereof, each pixel is controlled to emit light or no light in the sustain period Ts1. Accordingly, start time of writing operation to a pixel differs depending on rows. In the row where the writing operation has terminated, the sustain period Ts1 sequentially starts. In the sustain period, a light emitting element of a pixel to which a signal for light emission is inputted is in a light emission state. Further, in the row where the sustain period Ts1 has terminated, signal writing operation of a next subframe period sequentially starts, and writing operation is sequentially carried out similarly from the first to the last rows in each signal writing period Tb2. In this manner, video signals are inputted to a pixel similarly in the address periods Ta2, Ta3, and Ta4, and depending on a potential thereof, each pixel is controlled to emit light or no light in the sustain periods Ts2, Ts3, and Ts4. By repeating the aforementioned operation, operation up to the sustain period Ts4 is terminated.

In this manner, accumulated light emission time in the subframe periods corresponds to light emission time of each pixel in one frame period, by which a gray scale is expressed.

It is to be noted that the subframe periods are sequentially arranged in the order from the longest sustain period; however, they are not necessarily arranged like this. For example, the subframe periods may be sequentially arranged in the order from the shortest sustain period or the subframe period with a long sustain period and the one with a short sustain period may be arranged at random.

Operation of a pixel while performing display is described above. Subsequently, description is made of operation of a pixel in the case where aging is carried out in charging an electronic appliance having a display device including the pixel of the invention for a pixel portion. For charging, first, the first switch 1802 and the second switch 1806 are turned on, a video signal to make a pixel emit light is inputted from the second wire 1810, and the transistor 1801 is turned on. Accordingly, a current is applied to the display element 1804. A current value at this time is measured. After current values of all pixels are measured, levels of deterioration of display elements in the pixels are compared with each other based on the current values flowing to the display elements in the pixels. Then, a current value depending on deterioration of the display elements in the pixels is programmed in the current source circuit 1805. When a current value flowing to a display element in a certain pixel depending on deterioration of the display element in the pixel is larger than that flowing to a display element in another pixel, the display element in the certain pixel is not deteriorated compared to the display element in the other pixel; therefore, a current value programmed in the certain pixel is set so as to be larger than that programmed in the other pixel. The comparison per pixel is preferably carried out on the basis of the most deteriorated pixel. In other words, since a pixel which is significantly deteriorated is no more required to be deteriorated, a programmed current value may be set to 0.

After programming of a pixels in the current source circuit 1805 is completed in this manner, the second switch 1806 is turned off and the third switch 1807 is turned on. Then, the first switch 1802 is turned on, and a signal to make a pixel emit light is inputted to the gate terminal of the transistor 1801. Accordingly, aging can be carried out in accordance with a level of deterioration of a pixel, thereby the difference in deterioration in pixels can be reduced. As a result, image burn-in can be suppressed.

Figure 17:
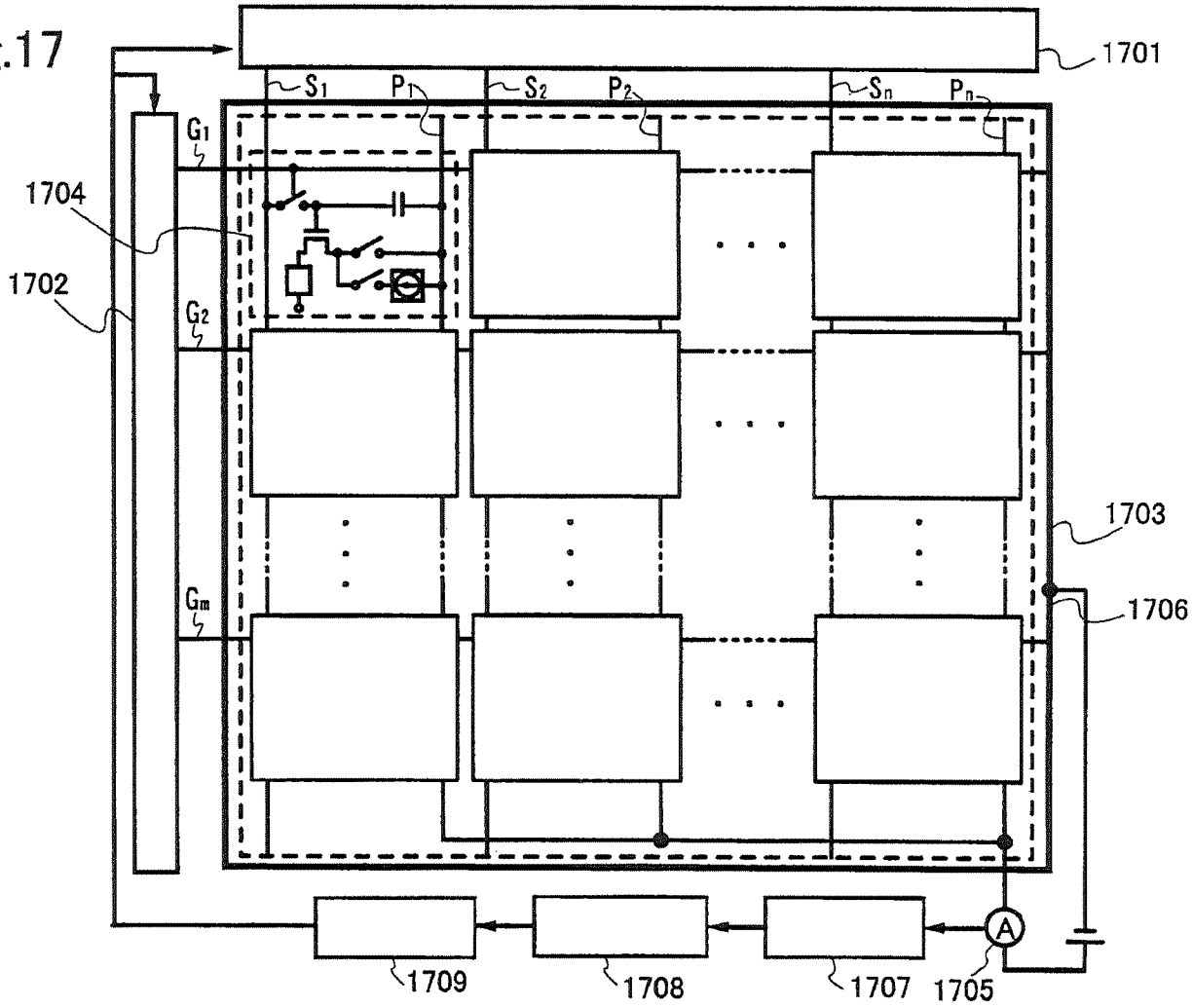
FIG. 17 is a diagram showing a structure of a display device of the invention.

It is to be noted that FIG. 17 shows a display device including the pixel in FIG. 18. The display device includes a signal line driver circuit 1701, a scan line driver circuit 1702, and a pixel portion 1703. Signal lines $S_1$ to $S_n$ extends from the signal line driver circuit 1701 to the pixel portion 1703, scan lines $G_1$ to $G_m$ extends from the scan line driver circuit 1702 to the pixel portion 1703, and pixels 1704 are arranged in matrix corresponding to the signal lines $S_1$ to $S_n$ and the scan lines $G_1$ to $G_m$. Further, power source lines $P_1$ to $P_j$ are arranged corresponding to the signal lines $S_1$ to $S_n$. In addition, a counter electrode 1706 is formed so as to cover the pixel portion 1703.

It is to be noted that the pixel shown in FIG. 18 can be applied to the pixels 1704. In this case, the first wire 1809 corresponds to the scan line $G_1$ (any one of the scan lines $G_1$ to $G_m$). The second wire 1810 corresponds to the signal line $S_j$ (any one of the signal lines $S_1$ to $S_n$). The third wire 1811 corresponds to the power source line $P_j$ (any one of the power source lines $P_1$ to $P_n$). Therefore, a pixel in an i-th row and a j-th column is selected by the scan line and a signal is written to the pixel from the signal line $S_j$. Subsequently, power is supplied from the power source line $P_j$. A counter electrode 1808 shown in FIG. 18 corresponds to a part of the counter electrode 1706 in FIG. 17.

Pixels are sequentially selected by the scan lines $G_1$ to $G_m$ and video signals are supplied from the signal lines $S_1$ to $S_n$ to the respective pixels 1704, thereby signal writing is carried out.

In the case where aging is carried out, signals to make a pixel emit light are sequentially inputted to the pixels 1704. At that time, a current value flowing between a power source line and a counter electrode is measured by an ammeter 1705. Data including information of the current value measured by the ammeter 1705 is stored in a memory 1707. The data stored in the memory 1707 is inputted to a programming current setting circuit 1708. Then, the programming current setting circuit 1708 determines progress of deterioration of a display element in each pixel based on the data. A current value is set in accordance with each pixel so that the difference in deterioration is reduced when a current is applied to each pixel for a certain period. The current value set by the programming current setting circuit 1708 is programmed in a current source circuit in the pixels 1704. While aging is carried out, a current is supplied to a display element in each pixel for a certain period so that the difference in deterioration of display elements in pixels is reduced. In this manner, image burn-in can be suppressed while charging is carried out.

Figure 19:
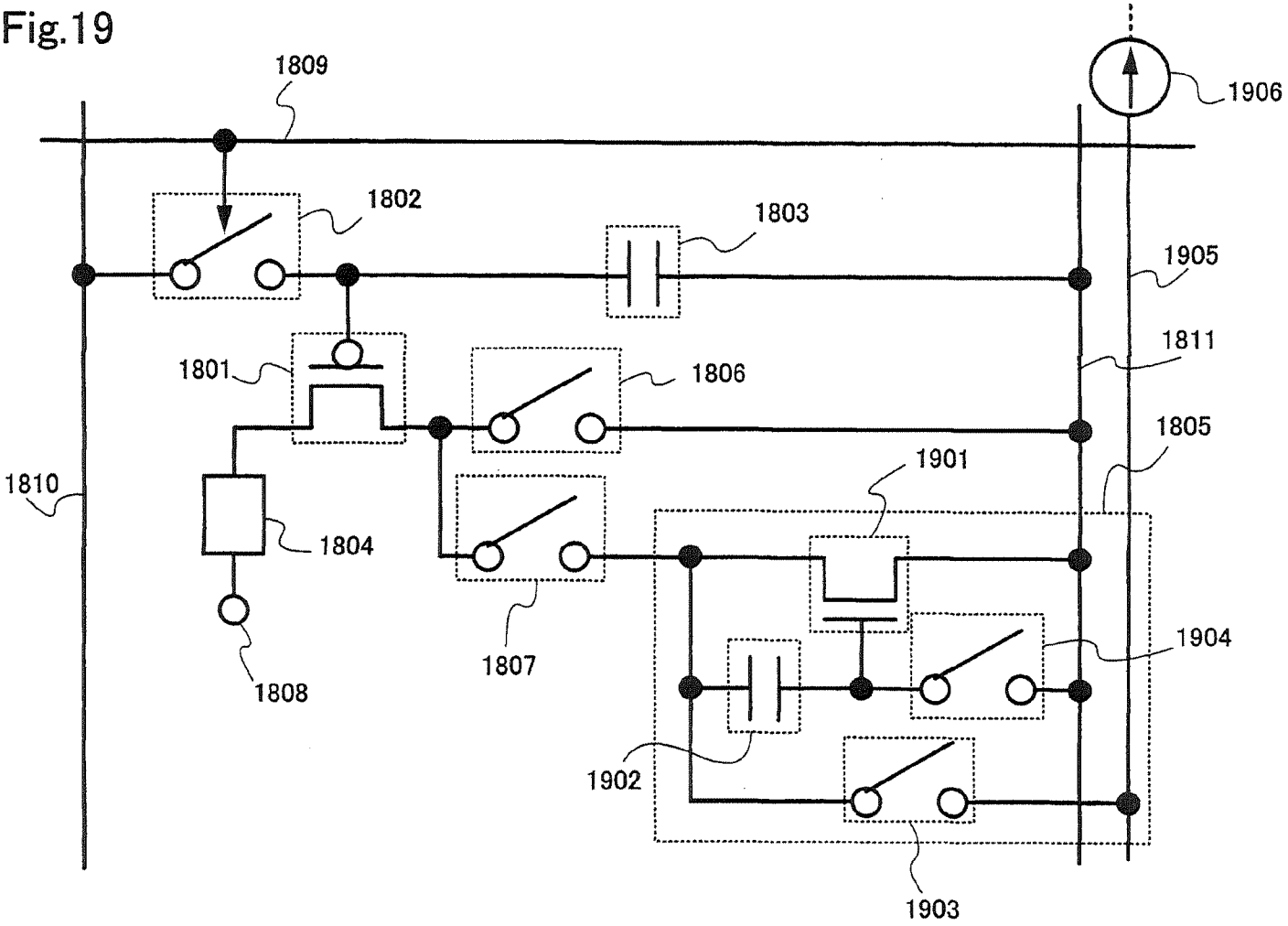
FIG. 19 is a diagram showing a pixel structure which can be applied to a display device of the invention.

It is to be noted that FIG. 19 shows an example of a structure of the current source circuit 1805 in a pixel shown in FIG. 18. Common portions to those in FIG. 18 are denoted by the same reference numerals and description thereof is omitted.

The current source circuit 1805 includes a transistor 1901, a capacitor 1902, a fourth switch 1903, and a fifth switch 1904. It is to be noted that the transistor 1901 is an n-channel transistor. A first terminal (one of a source terminal and a drain terminal) of the transistor 1901 is connected to a first terminal of the transistor 1801 through the third switch 1807. A second terminal (the other of the source terminal and the drain terminal) of the transistor 1901 is connected to the third wire 1811. A gate terminal of the transistor 1901 is connected to the third wire 1811 and the first terminal of the transistor 1901 through the fourth switch 1904 and the capacitor 1902, respectively. The first terminal of the transistor 1901 is connected to the fourth wire 1905 through the fifth switch 1903.

In the case where programming is carried out, the fourth switch 1903 and the fifth switch 1904 are turned on, thereby a current supplied from the current source 1906 to the fourth wire 1905 is written to the current source circuit 1805. That is, the first terminal of the transistor 1901 is a source terminal, and a load for a gate-source voltage of the transistor 1901 is accumulated in the capacitor 1902. On the other hand, when the fourth switch 1903 and the fifth switch 1904 are turned off, the capacitor 1902 holds the gate-source voltage of the transistor 1901. In this manner, programming in the current source circuit 1805 is completed.

Embodiment Mode 8

In this embodiment mode, description is made of a structure of a display device in the case where aging is carried out in a different method from Embodiment Mode 7 and driving method thereof.

First, a pixel which can be applied to a display device in this embodiment mode is described.

The pixel includes a transistor 2601, a switch 2602, a capacitor 2603, a display element 2604, a first wire 2605, a second wire 2606, and a third wire 2607. It is to be noted that the transistor 2601 is a p-channel transistor. The switch 2602 is connected so that the second wire 2606 and a gate terminal of the transistor 2601 are controlled to be electrically connected or disconnected to each other. That is, the switch 2602 is turned on or off in accordance with signals supplied to the first wire 2605. When the switch 2602 is in an on state, the second wire 2606 and the gate terminal of the transistor 2601 are electrically connected to each other. On the other hand, when the switch 2602 is in an off state, the second wire 2606 and the gate terminal of the transistor 2601 are electrically disconnected to each other. A first terminal (one of a source terminal and a drain terminal) and a second terminal (the other of the source terminal and the drain terminal) of the transistor 2601 are connected to the third wire 2607 and a pixel electrode of the display element 2604, respectively. Further, a gate terminal of the transistor 2601 is connected to the third wire 2607 through the capacitor 2603. Note that a predetermined potential is applied to a counter electrode 2608 of the display element 2604.

In writing operation to a pixel, the switch 2602 is turned on. Then, a charge for a voltage corresponding to a video signal is accumulated in the capacitor 2603 from the second wire 2606. That is, the voltage becomes a gate-source voltage of the transistor 2601. Therefore, the transistor 2601 is controlled to be turned on or off by the voltage. Note that, a video signal inputted to turn on the transistor 2601 has a voltage with which the transistor 2601 operates in a linear region.

When the transistor 2601 is turned on, a voltage which is a potential difference of a potential supplied to the third wire 2607 and a potential applied to the counter electrode 2608 of the display element 2604 is applied between electrodes of the display element 2604. Then, a pixel is in a lighting state.

A video signal is inputted to each pixel, thereby signal writing operation is completed and each pixel is in either a lighting state or a non-lighting state. Therefore, only 2 gray scale levels can be expressed if nothing is done. By using a time gray scale method or a region gray scale method, multi-gray scale display can be carried out.

Figure 22:
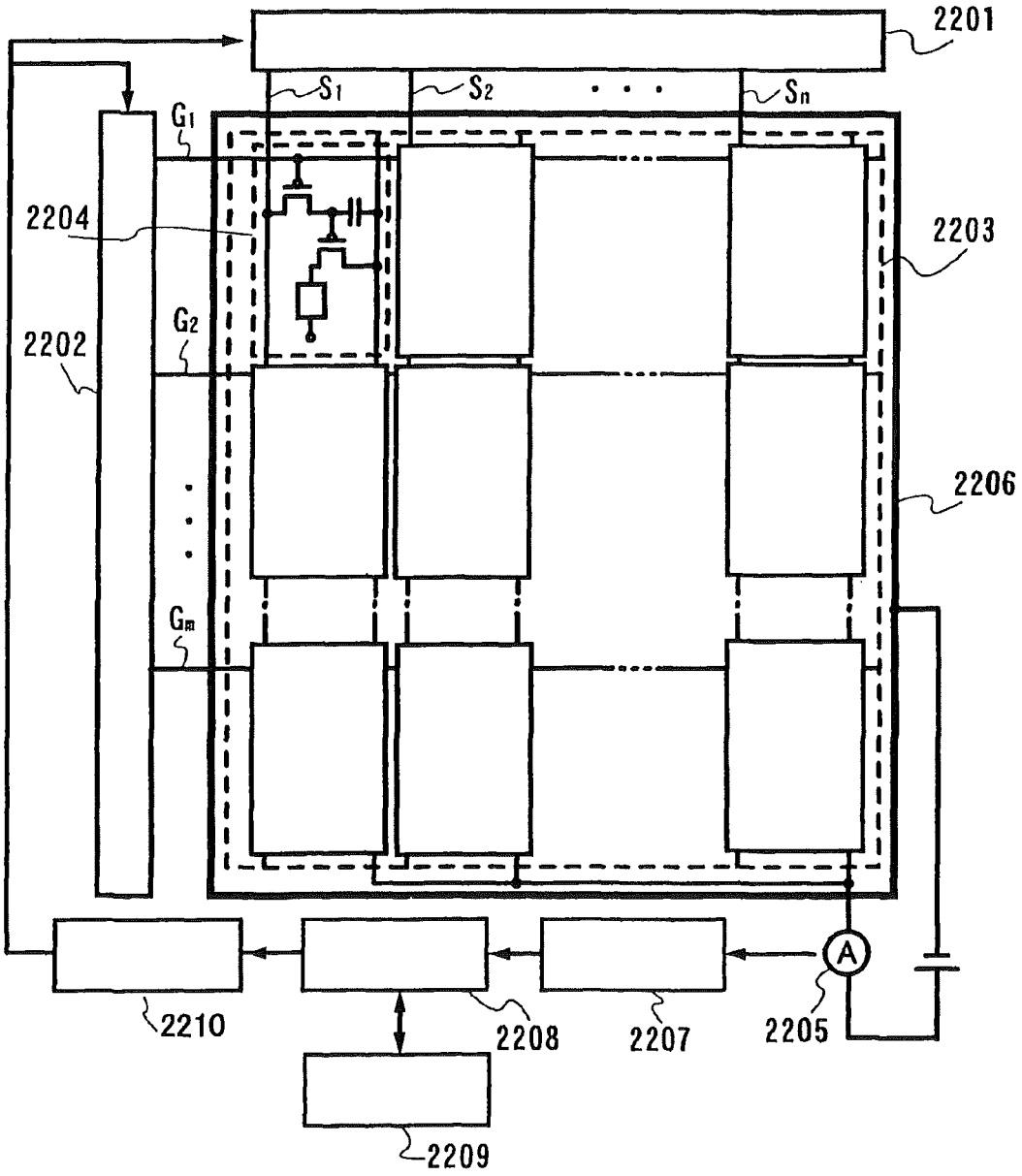
FIG. 22 is a diagram showing a structure of a display device of the invention.
Figure 26:
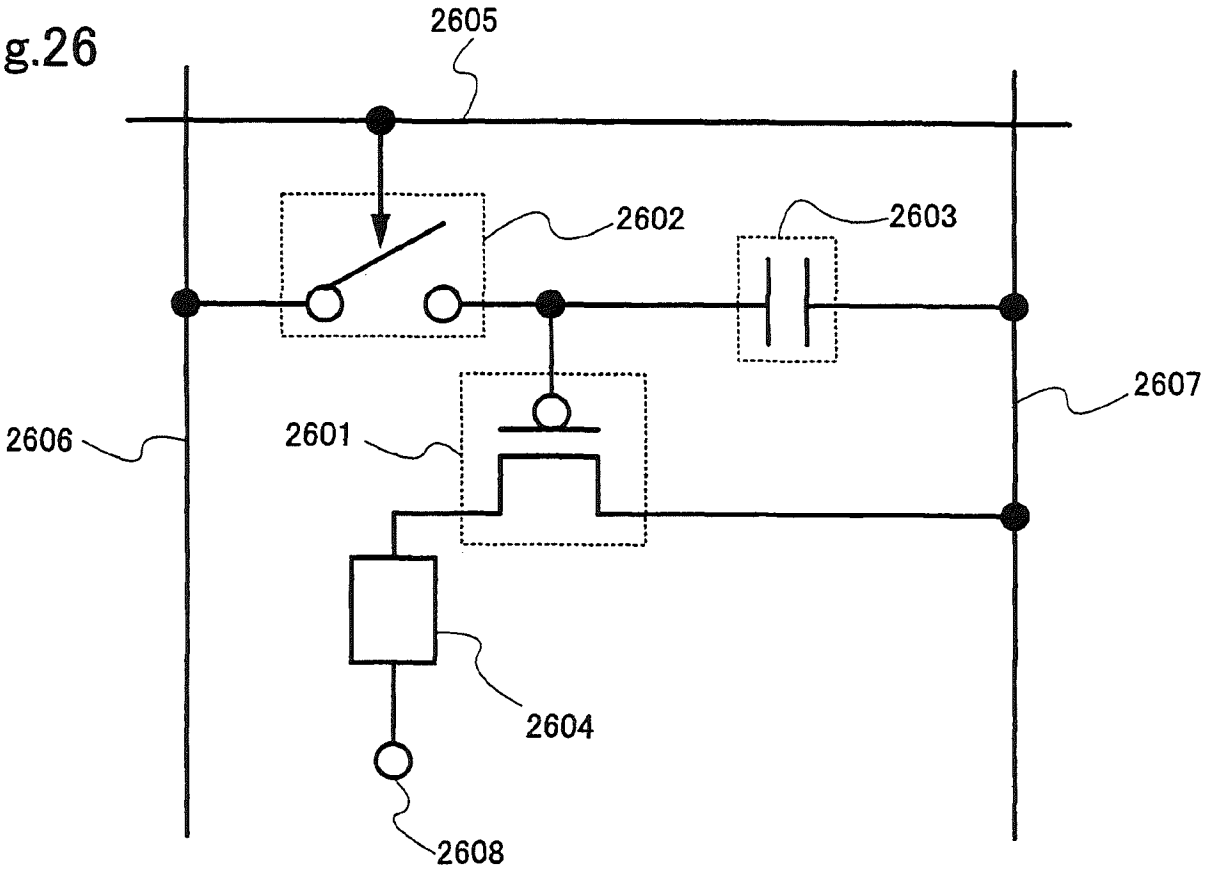
FIG. 26 is a diagram showing a pixel structure which can be applied to a display device of the invention.

Subsequently, a display device of this embodiment mode including the pixel shown in FIG. 26 is described with reference to FIG. 22. The display device includes a signal line driver circuit 2201, a scan line driver circuit 2202, and a pixel portion 2203. Signal lines S1 to Sn extends from the signal line driver circuit 2201 to the pixel portion 2203, scan lines G1 to Gm extends from the scan line driver circuit 2202 to the pixel portion 2203, and a plurality of pixels 2204 are arranged in matrix corresponding to the signal lines S1 to Sn and the scan lines G1 to Gm. In addition, a counter electrode 2206 is formed so as to cover the entire surface of the pixel portion 2203.

It is to be noted that the pixel shown in FIG. 26 can be applied to the pixels 2204. In this case, the first wire 2605 corresponds to the scan line Gi (any one of the scan lines G1 to Gm). The second wire 2606 corresponds to the signal line Sj (any one of the signal lines S1 to Sn). The third wire 2607 corresponds to a power source line Pj (any one of power source lines P1 to Pn). Therefore, a pixel in an i-th row and a j-th column is selected by the scan line Gi, and a signal is written to the pixel from the signal line Sj. Subsequently, a power source is supplied from the power source line Pj. A counter electrode 2608 shown in FIG. 26 corresponds to a part of the counter electrode 2206 in FIG. 22.

Pixels are sequentially selected by the scan lines G1 to Gm and video signals are supplied from the signal lines S1 to Sn to the respective pixels 2204, thereby signal writing is carried out.

In the case where aging is carried out, signals to put a pixel in a lighting state are sequentially inputted to the pixels 2204. At that time, a current value flowing between a power source line and a counter electrode is measured by an ammeter 2205. Data including information of the current value measured by the ammeter 2205 is stored in a memory 2207. The data stored in the memory 2207 is inputted to a correcting circuit 2208. Then, the correcting circuit 2208 determines progress of deterioration of a display element in each pixel based on the data. Then, a signal to put a pixel in a lighting state for a period in accordance with deterioration of each pixel is generated. That is, this signal is a signal of each bit, which determines a subframe period in which a pixel is put in a lighting state. The signal generated by the correcting circuit 2208 is stored in a frame memory 2209. While aging is carried out, signals stored in the frame memory 2209, which is to be inputted to each pixel, is inputted from the correcting circuit 2208 to the scan line driver circuit 2202 and the signal line driver circuit 2201. Lighting time of a pixel is controlled for a display element in each pixel so that the difference in deterioration of display elements between pixels is reduced. In this manner, image burn-in can be prevented while charging is carried out.

Embodiment Mode 9

A display panel of a display device described in this embodiment mode has a structure where an extra pixel is provided in addition to pixels for display. In other words, more pixels than those corresponding to data in one frame are provided in the display panel. Then, a pixel in which data in one frame is inputted is selected, thereby a display screen is shifted in accordance with a certain timing.

Figure 29A:
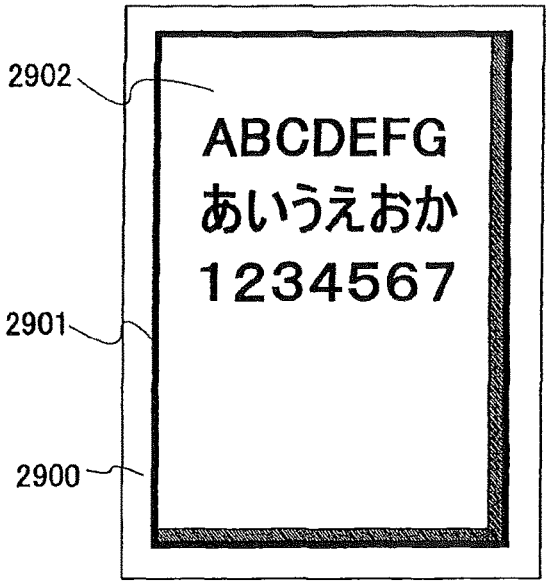
FIGS. 29A to 29D are diagrams each showing a shift of a display screen.
Figure 29B:
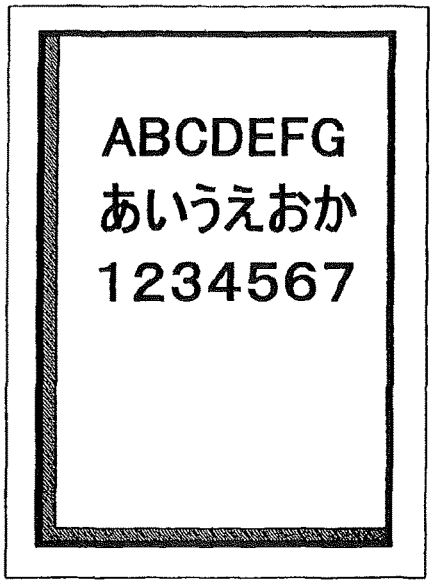
Figure 29C:
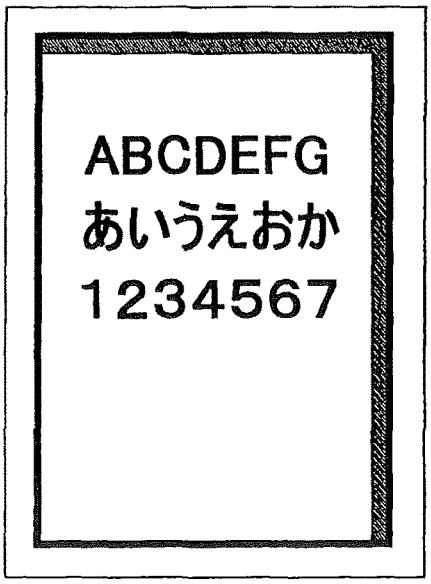
Figure 29D:
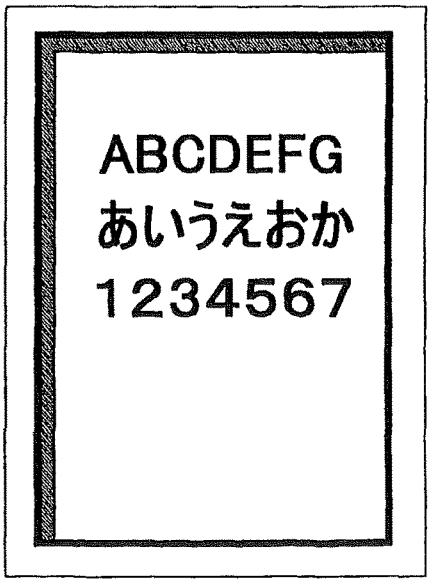

A display panel of this embodiment mode is described with reference to FIG. 29. A display panel 2900 has a pixel portion 2901 provided with a plurality of pixels. It is to be noted in the pixel portion 2901 that a region contributing to display, that is a region for a display screen, is referred to as a display region. While an image is displayed in the display panel, a display region 2902 may shift in an obliquely upper left direction in the pixel portion 2901 as shown in FIG. 29A; in an obliquely upper right direction in the pixel portion 2901 as shown in FIG. 29B; in an obliquely lower left direction in the pixel portion 2901 as shown in FIG. 29C; or in an obliquely lower right direction in the pixel portion 2901 as shown in FIG. 29D.

As a result, image burn-in in a display screen can be suppressed.

It is to be noted that FIGS. 29A to 29D are views each showing that the display region 2902 shifts to one of four corners; however, it is needless to say that the display region 2902 may be located in the center of the pixel portion 2901. The display region 2902 is set so as to be shifted in every direction.

For example, a display panel including (324×244=79056 pixels) is formed with a display panel in which resolution is QVGA (320×240=76800 pixels) provided with extra four pixels in every direction of rows and columns.

A display region is shifted in accordance with a certain timing. For example, a display region is shifted each time a display device is turned on. Note that the number of blocks by which a display region is shifted may be changed each time a display device is turned on. A display panel in which extra four pixels in every direction of rows and columns are additionally provided, that is extra two pixels are provided in each of right, left, up, and down direction, a display region can be shifted by ±two pixels in row direction and column direction. A display region can be shifted by (−2, −1, 0, 1, 2) in row direction and column direction. That is to say, there are 25 patterns in total as a shift pattern.

Figure 30:
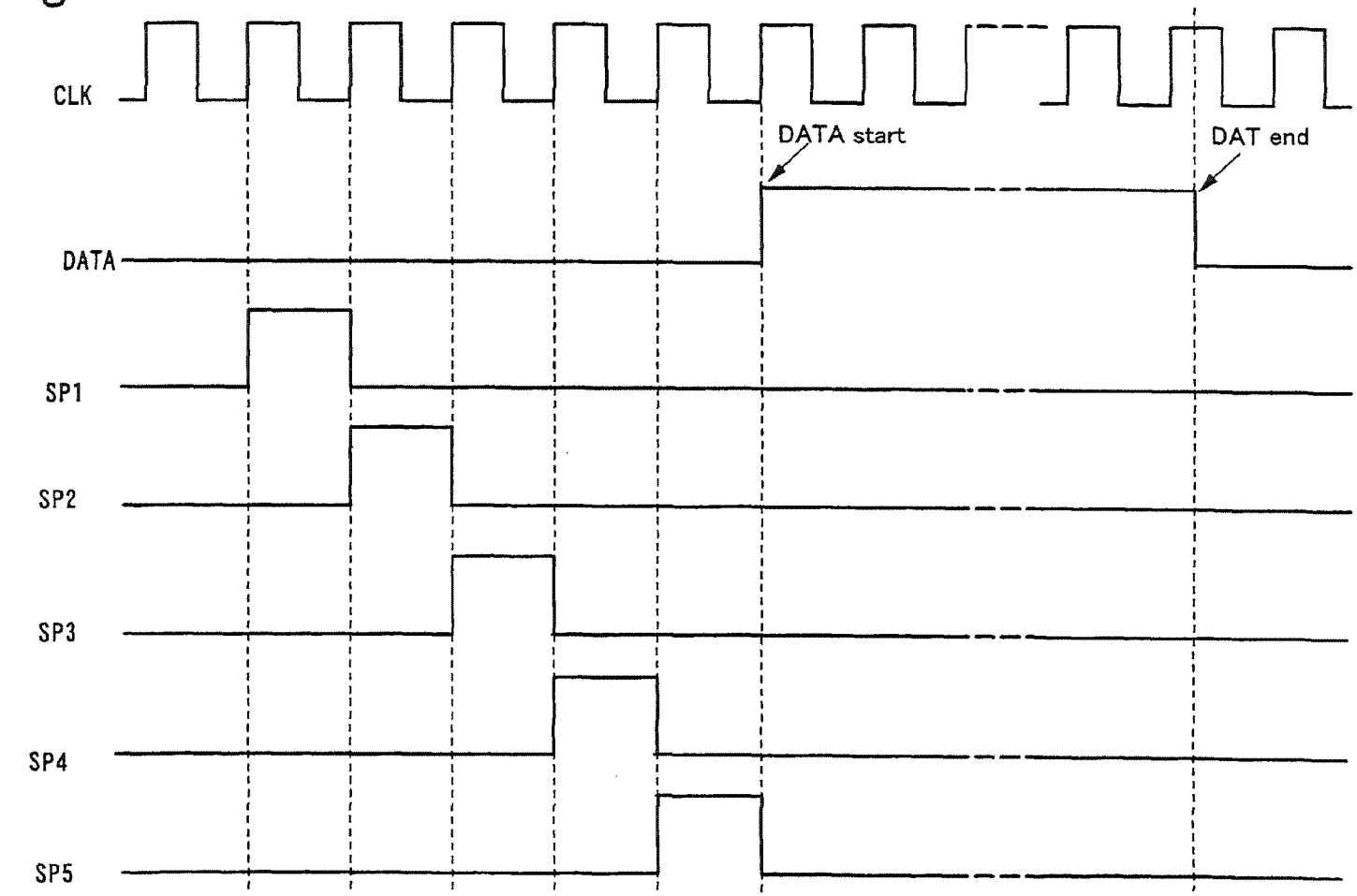
FIG. 30 is a timing chart of a start pulse signal.

A display region can be shifted by delaying the timing of a scan start signal SP. A method of shifting a display region is described with reference to a timing chart in FIG. 30. Signals SP1, SP2, SP3, SP4, and SP5 can be generated as the scan start signals SP with respect to a clock signal CLK and a DATA signal as shown in FIG. 30. That is, in the case of SP1 and SP2, a display region is shifted by +2 and +1, respectively. In the case of SP3, a display region is not shifted. In the case of SP4 and SP5, a display region is shifted by −1 and −2, respectively.

Figure 31:
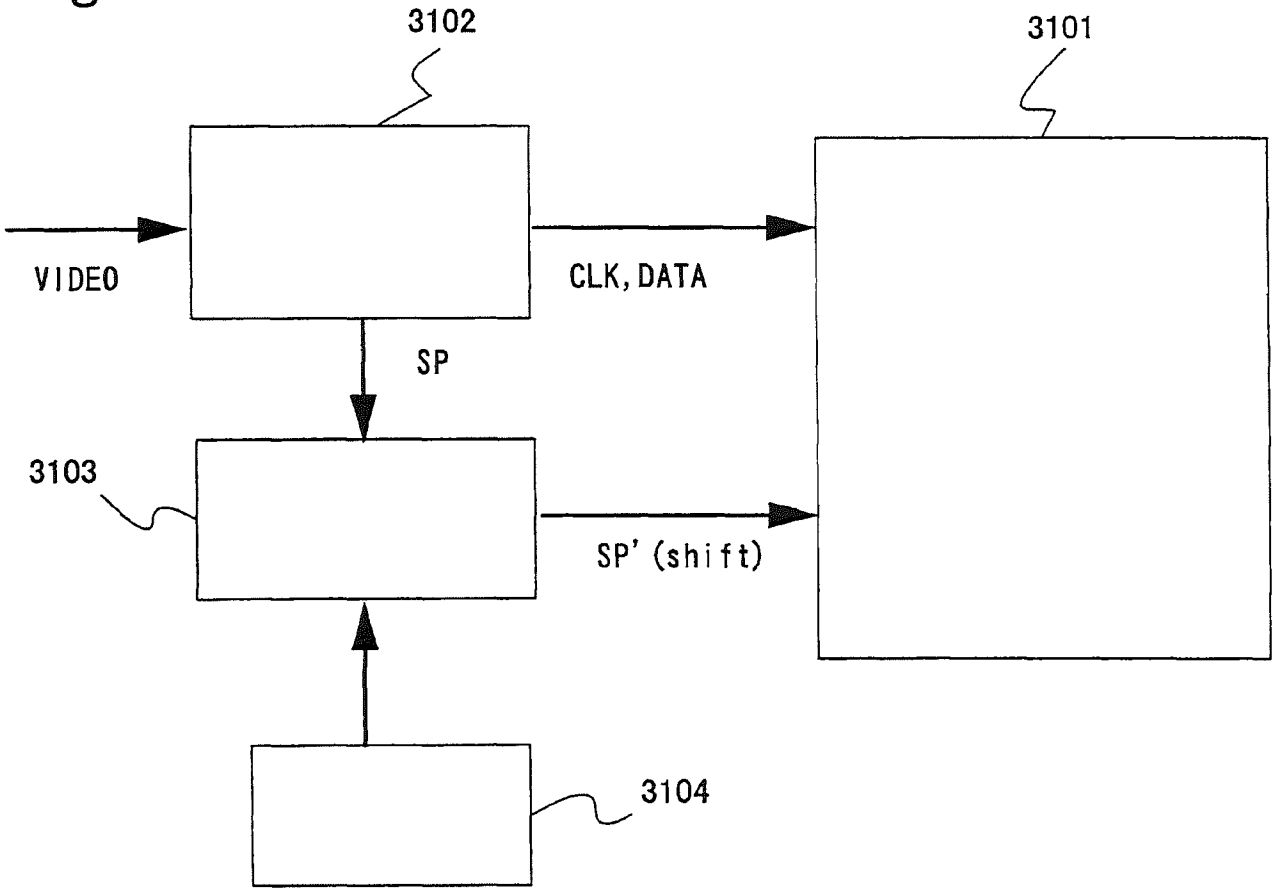
FIG. 31 is a block diagram of a display device of the invention.

Here, an example of a block diagram of a display device of this embodiment mode is described with reference to FIG. 31. The display device shown in FIG. 31 includes a display panel 3101, a controller 3102, a delay circuit 3103, and a memory 3104.

VIDEO signals are inputted to the controller 3102. Then, DATA signals and CLK signals are inputted from the controller 3102 to the display panel 3101. In addition, SP signals are inputted from the controller 3102 to the delay circuit 3103. The delay circuit 3103 delays SP signals in accordance with the amount to be delayed inputted from the memory 3104. The delayed SP' signals are inputted to the display panel 3101. At this time, for example, the amount to be delayed when the display device is turned on at previous time is stored in the memory 3104, and depending on that, the different amount to be delayed, which is outputted from the memory 3104, at this time may be determined.

Embodiment Mode 10

Figure 34:
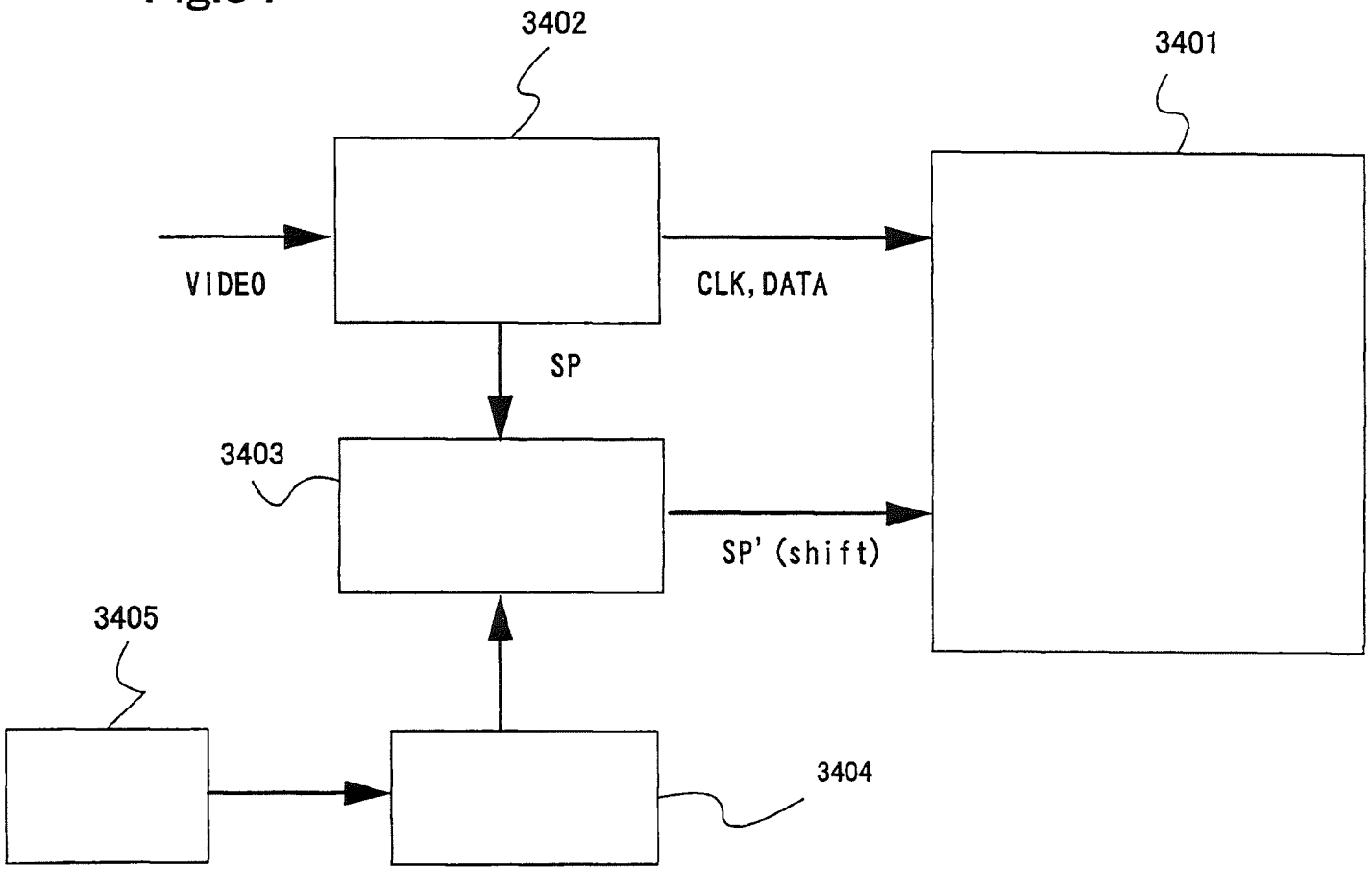
FIG. 34 is a block diagram of a display device of the invention.

In this embodiment mode, description is made of a method of shifting a display region at different timing from that for shifting a display region of a display device, which is described in Embodiment Mode 9 with reference to a block diagram of a display device shown in FIG. 34.

The display device of this embodiment mode includes a display panel 3401, a controller 3402, a delay circuit 3403, a memory 3404, and a counter 3405.

VIDEO signals are inputted to the controller 3402. Then, DATA signals and CLK signals are inputted from the controller 3402 to the display panel 3401. In addition, SP signals are inputted from the controller 3402 to the delay circuit 3403. The delay circuit 3403 delays SP signals in accordance with the amount to be delayed inputted from the memory 3404. The delayed SP' signals are inputted to the display panel 3401.

It is to be noted that the amount to be delayed inputted from the memory 3404 to the delay circuit 3403 is determined as follows. The counter 3405 counts the accumulated displaying time of the display device. Then, data of the accumulated displaying time counted by the counter 3405 is inputted to the memory 3404. The memory 3404 determines the amount to be delayed based on the data, and the amount to be delayed is inputted to the delay circuit 3403.

The amount to be delayed is determined in this manner, thereby displaying time in each delay pattern is averaged. As a result, image burn-in of a display screen can be suppressed.

The amount to be delayed is preferably determined per unit of one minute, approximately five minutes, approximately ten minutes, approximately thirty minutes, approximately one hour, or the like. This is because the shorter the unit is, the more effectively image burn-in can be prevented since displaying time in each delay pattern is more often averaged; however, if the interval is too short, a display screen flickers.

It is to be noted in this embodiment mode that a display region shifts while an image is displayed in the display device. Therefore, a display region is preferably shifted by gradation so as to be shifted inconspicuously.

Embodiment Mode 11

In this embodiment mode, specific structures of the display devices of Embodiment Modes 9 and 10 are described.

First, a case where the invention is applied to an active matrix display device is described with reference to FIG. 35.

Figure 35:
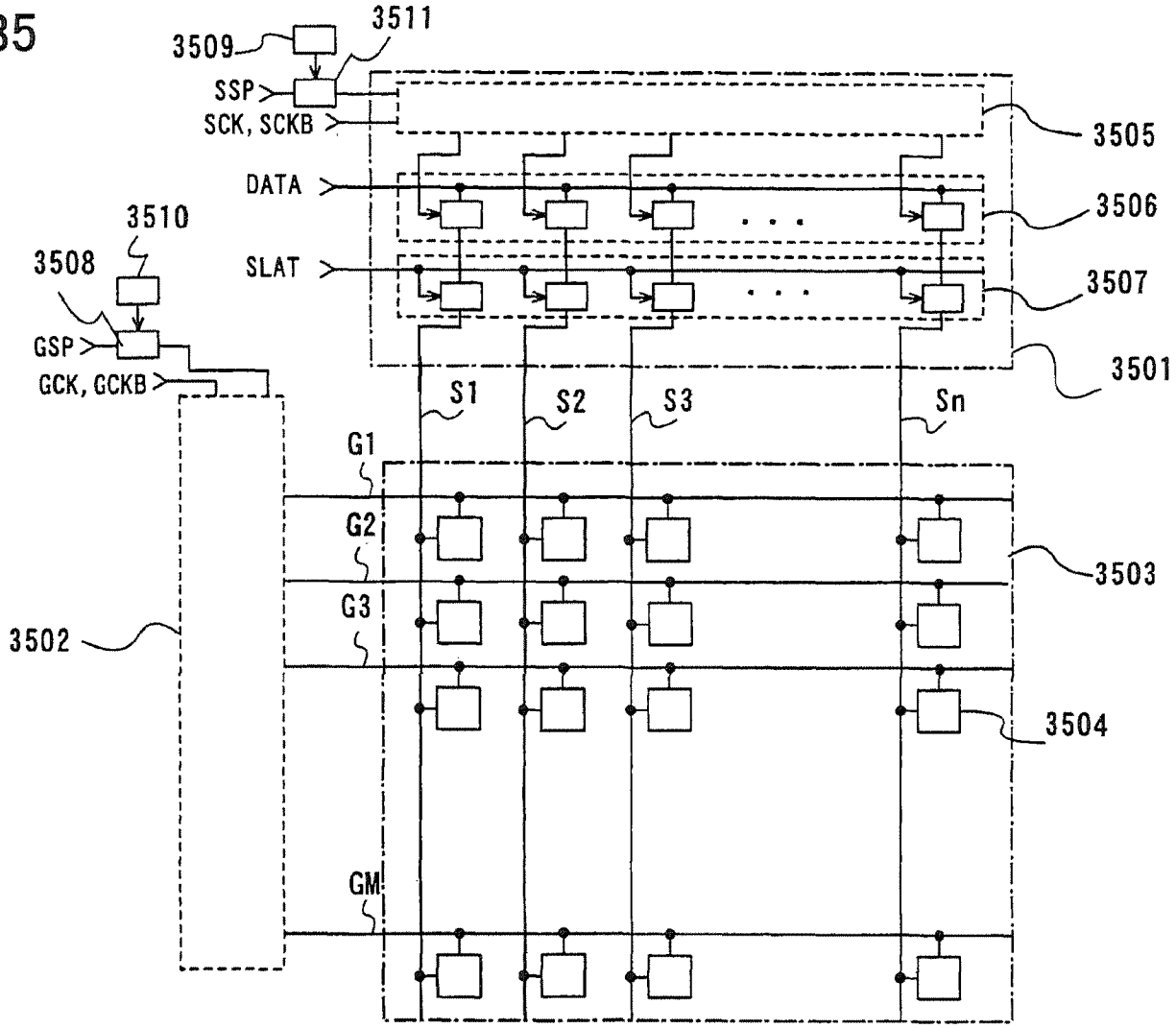
FIG. 35 is a diagram showing a display device of the invention.

The active matrix display device in FIG. 35 includes a gate signal line driver circuit 3502, a source signal line driver circuit 3501, and a pixel portion 3503. Signals are outputted from the gate signal line driver circuit 3502 to a plurality of gate signal lines $G_1$ to $G_m$ arranged in a row direction. Further, signals are outputted from the source signal line driver circuit 3501 to a plurality of source signal lines $S_1$ to $S_n$ arranged in a column direction. The pixel portion 3503 includes a plurality of pixels 3504 arranged in matrix corresponding to the gate signal lines $G_1$ to $G_m$ and the source signal lines $S_1$ to $S_n$. The pixels 3504 are provided in the row direction and column direction in addition to pixels for one frame. Preferably, 1 to 10% of pixels in the pixel portion 3503 are provided in addition to the pixels in the pixel portion 3503. More preferably, 1.5 to 7% of pixels in the pixel portion 3503 are provided in addition to the pixels in the pixel portion 3503. Still more preferably, approximately 3% of pixels in the pixel portion 3503 are provided in addition to the pixels in the pixel portion 3503. For example, 2 to 10 pixels in the case where resolution is QVGA (320×240); 4 to 10 pixels in the case where resolution is CIF (352×288); 2 to 5 pixels in the case where resolution is QCIF (176×144); 5 to 20 pixels in the case where resolution is VGA (640×480); 10 to 30 pixels in the case where resolution is SVGA (800×600); 13 to 35 pixels in the case where resolution is XGA (1024×768); 15 to 40 pixels in the case where resolution is SXGA (1280×1024); 20 to 50 pixels in the case where resolution is UXGA (1600×1200); or 25 to 60 pixels in the case where resolution is QXGA (2048×1536) are preferably provided in each of the row direction and column direction additionally.

DATA signals are serially inputted to the source signal line driver circuit 3501. SCK signals and SCKB signals are inputted to a pulse output circuit 3505. Further, SSP signals are inputted to the pulse output circuit 3505 through a delay circuit 3511, and pulses are sequentially outputted in each column of a first latch circuit 3506.

Here, the inputted SSP signals are delayed at arbitral timing in the delay circuit 3511 and inputted to the pulse output circuit 3505. That is, the amount to be delayed is inputted by a memory 3509, and depending on that, the SSP signals are delayed. Accordingly, a pixel column contributing to display in the pixel portion can be shifted depending on the amount to be delayed of the memory 3509.

That is to say, DATA signals are stored in parallel in the first latch circuit 3506 in accordance with signals outputted from the pulse output circuit 3505. At this time, a pixel column in which DATA signals are not inputted is determined depending on the amount to be delayed of the SSP signals.

After SLAT signals are inputted to the second latch circuit 3507, DATA signals stored in the first latch circuit 3506 are transmitted to the second latch circuit 3507. The DATA signals stored in the second latch circuit 3507 are outputted from the source signal line driver circuit 3501.

GCK signals and GCKB signals are inputted to the gate signal line driver circuit 3502. In addition, GSP signals are inputted to the gate signal line driver circuit 3502 through the delay circuit 3508. Accordingly, pulses are sequentially outputted from the gate signal line driver circuit 3502 to the gate signal lines $G_1$ to $G_m$, and then the gate signal lines $G_1$ to $G_m$ are sequentially selected.

Here, the inputted GSP signals are delayed at arbitral timing in the delay circuit 3508 and outputted to the gate signal line driver circuit 3502. The amount to be delayed is inputted from a memory 3510, and at timing depending on that, the GSP signals are delayed. Accordingly, a pixel row contributing to display on a display screen in the pixel portion can be shifted depending on the amount to be delayed of the memory 3510. That is, a pixel row to which DATA signals are not inputted is determined depending on the amount to be delayed of the GSP signals.

In this manner, a pixel row contributing to display can be shifted. As a result, image burn-in on a display screen of the display device can be suppressed.

A structure example of a delay circuit which can be applied to a display device of this embodiment mode is described with reference to FIG. 32. The delay circuit described in this embodiment mode can be used as the delay circuit 3103 in the block diagram of the display device in FIG. 31, the delay circuit 3403 in FIG. 34, or the like.

In the delay circuit described in this embodiment mode, DFFs 3201 to 3208 are connected in series. SP signals are inputted to a DFF in a previous row. When signals are outputted from an output 2, the SP signals are delayed by one pulse. Further, when signals are outputted from an output 3, the SP signals are delayed by two pulses. In this manner, in the case of an output 4 or 5, the SP signals are delayed by three or four pulses respectively. That is to say, supposing that an SP signal is SP1 signal in the timing chart of FIG. 30, a signal outputted from the output 2 corresponds to SP 2, a signal outputted from the output 3 corresponds to SP 3, a signal outputted from the output 4 corresponds to SP 4, and a signal outputted from the output 5 corresponds to SP 5.

That is to say, in the case where the amount to be delayed is changed each time a power source of the display device is turned on as described above, any one of the outputs 1 to 5 is preferably selected as an output from the delay circuit when the power source is turned on.

Figure 32:
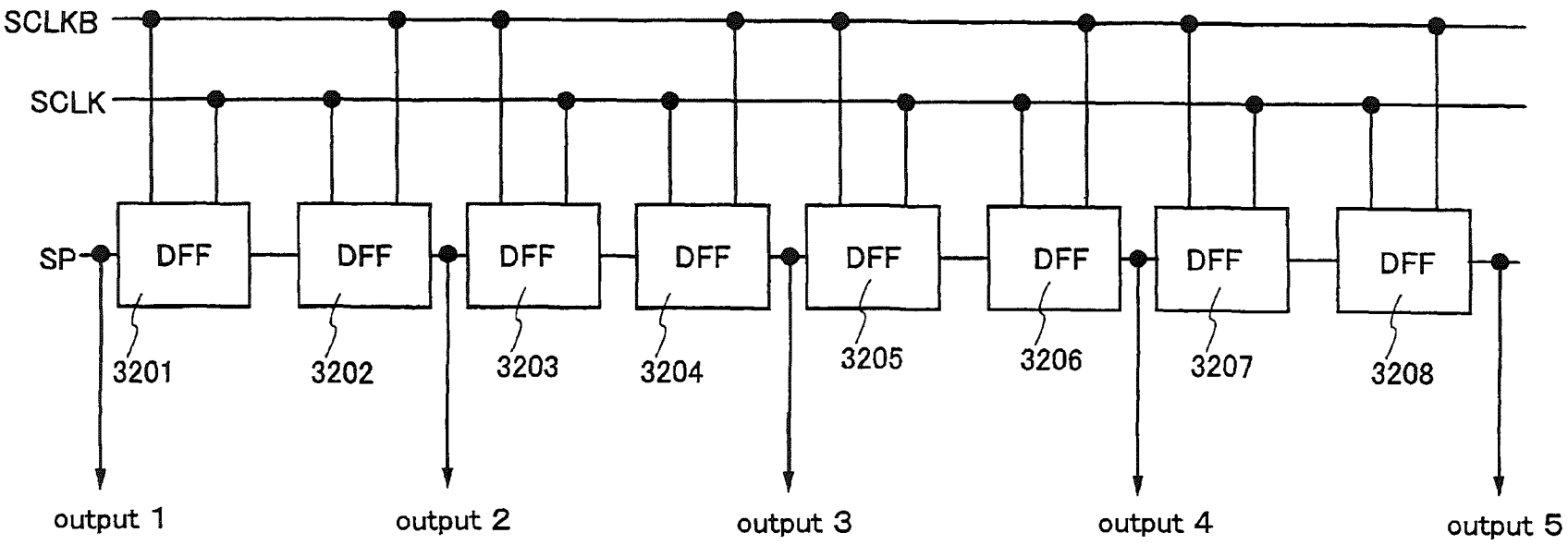
FIG. 32 is a diagram showing a structure of a delay circuit.
Figure 33:
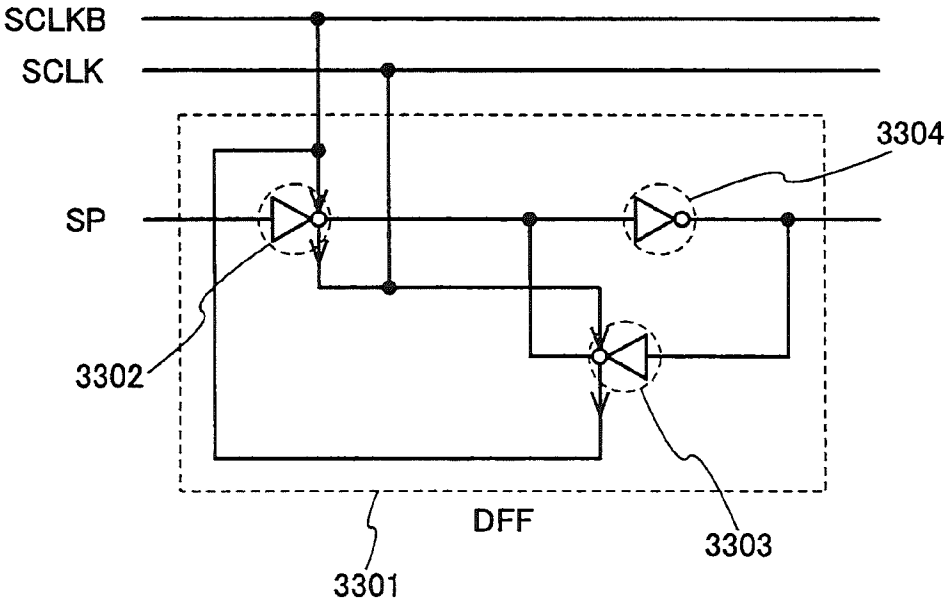
FIG. 33 is a diagram showing a structure of a DFF.

Subsequently, a structure example of the DFFs 3201 to 3208 of a delay circuit shown in FIG. 32 is shown in FIG. 33. A DFF 3301 includes a clocked inverter 3302 and a clocked inverter 3303 and an inverter 3304.

SP signals are inputted to an input terminal of the clocked inverter 3302, and an output terminal of the clocked inverter 3302 is connected to an input terminal of the inverter 3304. An output terminal of the inverter 3304 is connected to an input terminal of a DFF in a subsequent row. Further, an input terminal of the clocked inverter 3303 is connected to the output terminal of the inverter 3304. An output terminal of the clocked inverter 3303 is connected to the input terminal of the inverter 3304 and the output terminal of the clocked inverter 3302.

It is needless to say that a structure which can be applied to a delay circuit of a display device of this embodiment mode is not limited to this. FIG. 32 shows a structure example of a delay circuit.

Embodiment Mode 12

Figures 37A, 37B:
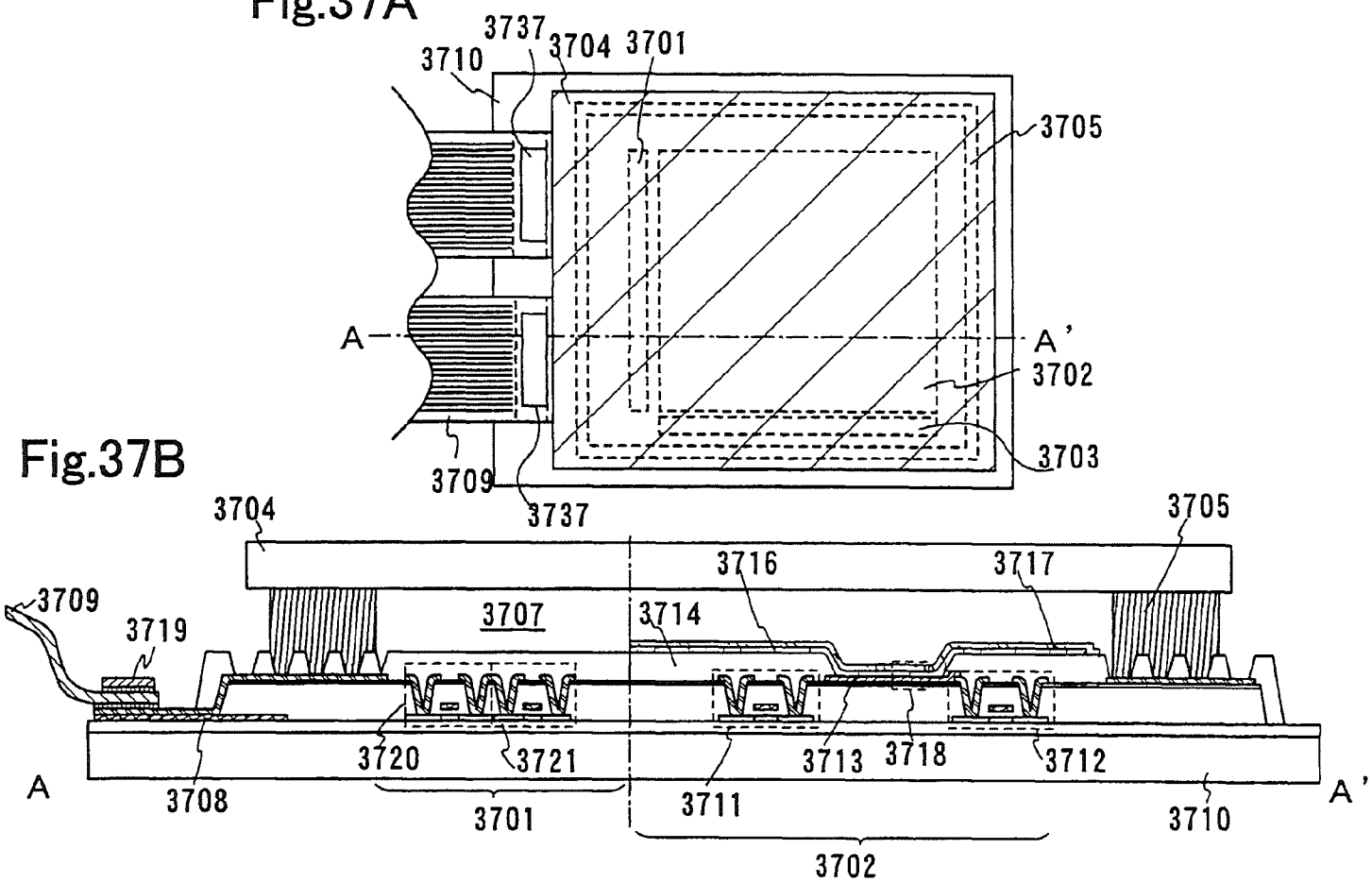
FIGS. 37A and 37B are diagrams each showing a display panel of the invention.

In this embodiment mode, description is made of a structure of a display panel to which an EL element is applied as a display element with reference to FIGS. 37A and 37B.

It is to be noted that FIG. 37A is a top plan view of the display panel and FIG. 37B is a cross sectional diagram along a line A-A' of FIG. 37A. The display panel includes a signal line driver circuit 3701, a pixel portion 3702, and a first scan line driver circuit 3703, which are shown by dotted lines. Further, a sealing substrate 3704 and a sealing material 3705 are provided. A portion surrounded by the sealing material 3705 is a space 3707.

It is to be noted that a wire 3708 is a wire for transmitting a signal inputted to the first scan line driver circuit 3703 and the signal line driver circuit 3701 and receives a video signal, a clock signal (CLK), a start pulse signal (SP), and the like from an FPC (Flexible Printed Circuit) 3709 functioning as an external input terminal. An IC chip (semiconductor chip including memory circuit, buffer circuit, and the like) 3719 is mounted over a connecting portion of the FPC 3709 and the display panel by COG (Chip On Glass) or the like. It is to be noted that only the FPC 3709 is shown here; however, a printed wiring board (PWB) may be attached to the FPC 3709. The display device in this specification includes not only a main body of the display panel but one with an FPC or a PWB attached thereto.

Next, description is made of a cross-sectional structure with reference to FIG. 37B. The pixel portion 3702 and peripheral driver circuits (the scan line driver circuit 3703 and the signal line driver circuit 3701) are formed over a substrate 3710. Here, the signal line driver circuit 3701 and the pixel portion 3702 are shown.

It is to be noted that the signal line driver circuit 3701 includes TFTs 3720 and 3721. Further, in this embodiment mode, a display panel in which the peripheral driver circuits are formed over the same substrate is shown; however, the invention is not limited to this. All or some of the peripheral driver circuits may be formed into an IC chip or the like and mounted by COG or the like.

Further, the pixel portion 3702 includes TFTs 3711 and 3712. It is to be noted that a source electrode of the TFT 3712 is connected to a first electrode (pixel electrode) 3713. An insulator 3714 is formed so as to cover end portions of the first electrode 3713. Here, a positive photosensitive acrylic resin film is used for the insulator 3714.

In order to obtain favorable coverage, the insulator 3714 is formed so that a curved surface having a curvature is formed at a top end portion or a bottom end portion of the insulator 3714. For example, in the case of using a positive photosensitive acrylic as a material for the insulator 3714, it is preferable that only the top end portion of the insulator 3714 have a curved surface having a curvature radius (0.2 to 3 μm). Moreover, either a negative photosensitive acrylic which becomes insoluble in etchant by light or a positive photosensitive acrylic which becomes soluble in etchant by light can be used as the insulator 3714.

A layer 3716 containing an organic compound and a second electrode (counter electrode) 3717 are formed over the first electrode 3713. Here, it is preferable to use a material having a high work function as a material used for the first electrode 3713 which functions as an anode. For example, a single layer of an ITO (indium tin oxide) film, an indium zinc oxide (IZO) film, a titanium nitride film, a chromium film, a tungsten film, a Zn film, a Pt film, or the like; a stacked layer of a titanium nitride film and a film containing aluminum as a main component; a three-layer structure of a titanium nitride film, a film containing aluminum as a main component, and a titanium nitride film; or the like can be used. It is to be noted that with a stacked layer structure, resistance as a wire is low, favorable ohmic contact can be obtained, and a function as an anode can be obtained.

The layer 3716 containing an organic compound is formed by vapor deposition using a deposition mask, or ink-jet. A metal complex belonging to group 4 of the periodic table of elements is used for a part of the layer 3716 containing an organic compound. Besides, a low molecular material or a high molecular material may be used in combination as well. Further, as a material used for the layer 3716 containing an organic compound, a single layer or a stacked layer of an organic compound is often used; however, in this embodiment mode, an inorganic compound may be used in a part of a film formed of an organic compound. Moreover, a known triplet material can also be used.

Further, as a material used for the second electrode 3717 which is formed over the layer 3716 containing an organic compound, a material having a low work function (Al, Ag, Li, Ca, or an alloy thereof such as MgAg, MgIn, AlLi, $CaF_2$, or $Ca_3N_2$) may be used. In the case where light generated from the layer 3716 containing an organic compound is transmitted through the second electrode 3717, a stacked layer of a metal thin film with a thinner thickness and a light-transmissive conductive film (ITO (indium tin oxide alloy), indium oxide zinc oxide alloy ($In_2O_3$—ZnO), zinc oxide (ZnO), or the like) is preferably used.

Further, by attaching the sealing substrate 3704 to the substrate 3710 with the sealing material 3705, an EL element 3718 is provided in the space 3707 surrounded by the substrate 3710, the sealing substrate 3704, and the sealing material 3705. It is to be noted that the space 3707 may be filled with the sealing material 3705 as well as an inert gas (nitrogen, argon, or the like).

It is to be noted that an epoxy-based resin is preferably used for the sealing material 3705. Further, it is preferable that these materials should not transmit moisture or oxygen as much as possible. As a material for the sealing substrate 3704, a glass substrate, a quartz substrate, a plastic substrate formed of FRP (Fiberglass-Reinforced Plastics), PVF (polyvinylfluoride), myler, polyester, acrylic, or the like can be used.

As described above, a display panel having a pixel structure of the invention can be obtained. Note that the structure described above is one example, and a structure of a display panel of the invention is not limited to this.

As shown in FIGS. 37A and 37B, the cost of the display device can be reduced by forming the signal line driver circuit 3701, the pixel portion 3702, and the first scan line driver circuit 3703 over one substrate.

Figure 43B:
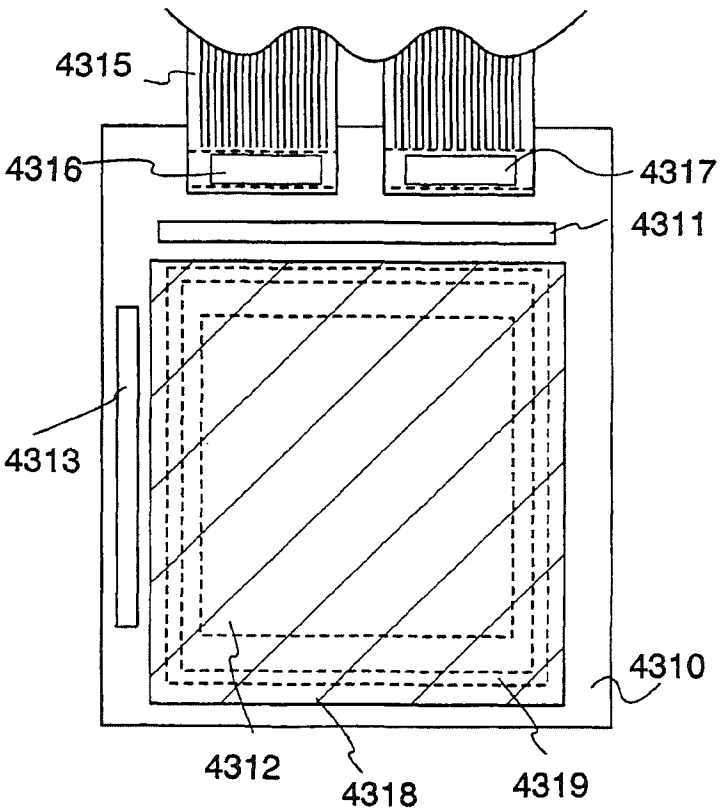
FIGS. 43A and 43B are diagrams each showing a display panel of the invention.
Figure 43A:
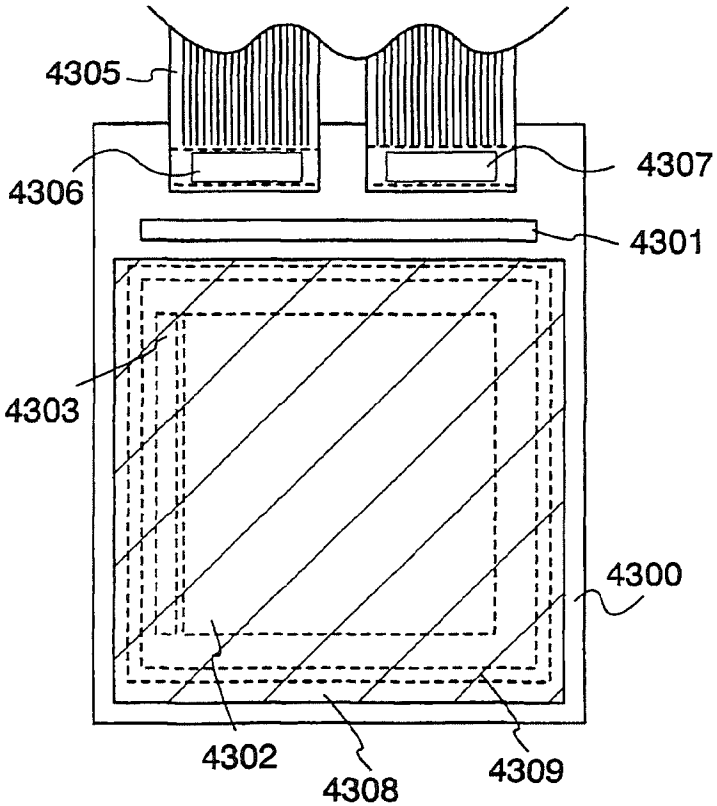

It is to be noted that the structure of the display panel is not limited to the structure shown in FIG. 37A where the signal line driver circuit 3701, the pixel portion 3702, and the scan line driver circuit 3703 are formed over the same substrate, and a signal line driver circuit 4301 shown in FIG. 43A corresponding to the signal line driver circuit 3701 may be formed into an IC chip and mounted on the display panel by COG, or the like. It is to be noted that a substrate 4300, a pixel portion 4302, a scan line driver circuit 4303, an FPC 4305, IC chips 4306 and 4307, a sealing substrate 4308, and a sealing material 4309 in FIG. 43A correspond to the substrate 3710, the pixel portion 3702, the scan line driver circuit 3703, the FPC 3709, the IC chips 3719 and 3722, the sealing substrate 3704, and the sealing material 3705 in FIG. 37A, respectively.

That is, only the signal line driver circuit which is required to operate at high speed is formed into an IC chip using a CMOS or the like, thereby lower power consumption is achieved. Further, by using a semiconductor chip of a silicon wafer or the like as the IC chip, higher-speed operation and lower power consumption can be realized.

By forming the scan line driver circuit 4303 and the pixel portion 4302 over the same substrate, cost reduction can be achieved.

In this manner, cost reduction of a high definition display device can be realized. Further, by mounting an IC chip including a functional circuit (memory or buffer) at a connecting portion of the FPC 4305 and the substrate 4300, a substrate area can be efficiently utilized.

Moreover, a signal line driver circuit 4311 and a scan line driver circuit 4313 shown in FIG. 43B corresponding to the signal line driver circuit 4301 and the scan line driver circuit 4303 shown in FIG. 43A may be formed into an IC chip and mounted on a display panel by COG or the like. In this case, lower power consumption of a high definition display device can be realized. Therefore, in order to obtain a display device with less power consumption, it is preferable to use polysilicon for a semiconductor layer of a transistor used in the pixel portion. It is to be noted that a substrate 4310, a pixel portion 4312, an FPC 4315, IC chips 4316 and 4317, a sealing substrate 4318, and a sealing material 4319 in FIG. 43B correspond to the substrate 4300, the pixel portion 4302, the FPC 4305, the IC chips 4306 and 4307, the sealing substrate 4308, and the sealing material 4309 in FIG. 43A, respectively.

Further, by using amorphous silicon for a semiconductor layer of a transistor of the pixel portion 4312, cost reduction can be achieved. Moreover, a large display panel can be manufactured.

Further, the scan line driver circuit and the signal line driver circuit are not necessarily provided in a row direction and a column direction of the pixels. For example, as shown in FIG. 44A, a peripheral driver circuit 4401 formed in an IC chip may have functions of the scan line driver circuit 4313 and the signal line driver circuit 4311 shown in FIG. 43B. It is to be noted that a substrate 4400, a pixel portion 4402, an FPC 4404, IC chips 4405 and 4406, a sealing substrate 4407, and a sealing material 4408 in FIG. 44A correspond to the substrate 4310, the pixel portion 4312, the FPC 4315, the IC chips 4316 and 4317, the sealing substrate 4318, and the sealing material 4319 in FIG. 43B, respectively.

Figure 44B:
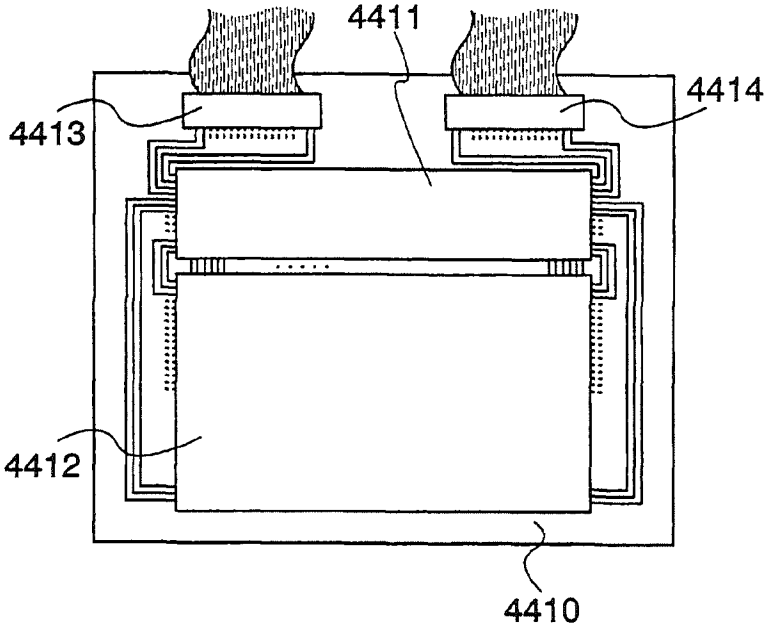
FIGS. 44A and 44B are diagrams each showing a display panel of the invention.
Figure 44A:
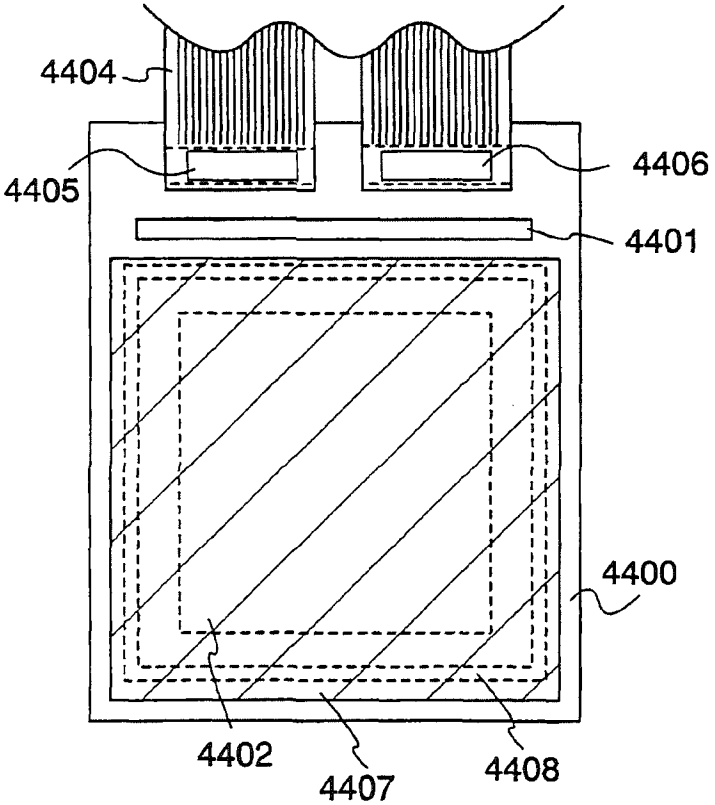

FIG. 44B is a schematic diagram showing connections of wires of the display device shown in FIG. 44A. A substrate 4410, a peripheral driver circuit 4411, a pixel portion 4412, and FPCs 4413 and 4414 are provided. Signals and a power source potential are externally inputted from the FPC 4413 to the peripheral driver circuit 4411. An output from the peripheral driver circuit 4411 is inputted to wires in the row direction and wires in the column direction, which are connected to the pixels in the pixel portion 4412.

Figure 38A:
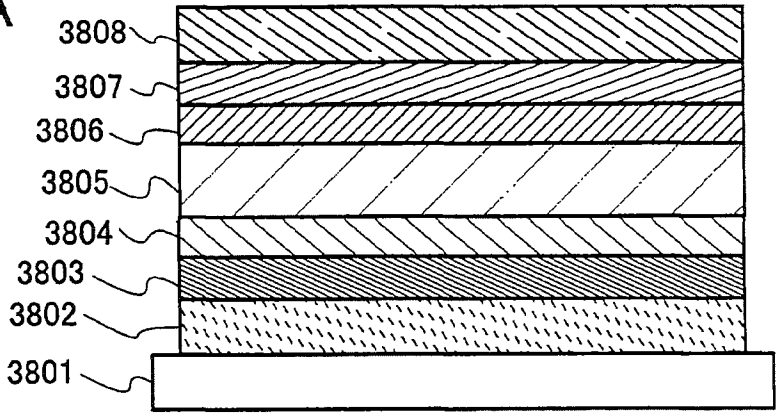
FIGS. 38A and 38B are diagrams each showing a light emitting element which can be applied to a display device of the invention.
Figure 38B:
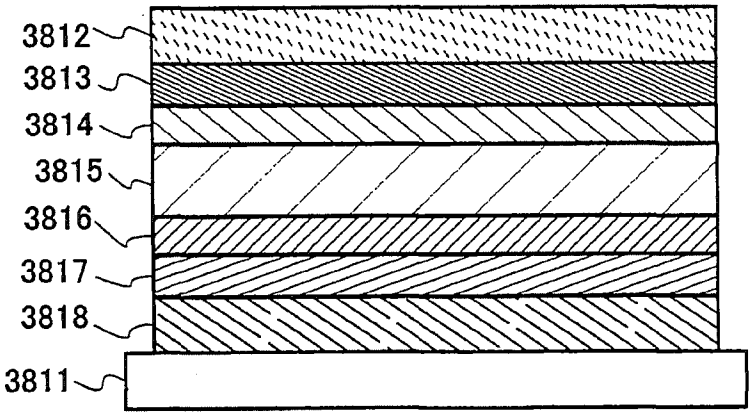

Further, FIGS. 38A and 38B show examples of an EL element which can be applied to the EL element 3718. That is, description is made of structures of an EL element which can be applied to the pixels described in Embodiment Modes 1 to 4 with reference to FIGS. 38A and 38B.

In an EL element shown in FIG. 38A, an anode 3802, a hole injecting layer 3803 formed of a hole injecting material, a hole transporting layer 3804 formed of a hole transporting material, a light emitting layer 3805, an electron transporting layer 3806 formed of an electron transporting material, an electron injecting layer 3807 formed of an electron injecting material, and a cathode 3808 are stacked over a substrate 3801 in this order. Here, the light emitting layer 3805 may be formed of only one kind of light emitting material; however, it may also be formed of two or more kinds of materials. The structure of the element of the invention is not limited to this.

In addition to the stacked layer structure shown in FIG. 38A where each functional layer is stacked, there are wide variations such as an element formed of a high molecular compound, a high efficiency element which utilizes a triplet light emitting material which emits light from a triplet excitation state in a light emitting layer. It is also possible to apply to a white EL element which can be obtained by dividing a light emitting region into two regions by controlling a recombination region of carriers using a hole blocking layer, and the like.

The element of the invention shown in FIG. 38A can be formed by sequentially depositing a hole injecting material, a hole transporting material, and a light emitting material over the substrate 3801 having the anode 3802 (ITO). Next, an electron transporting material and an electron injecting material are deposited, and finally the cathode 3808 is deposited.

Materials suitable for the hole injecting material, the hole transporting material, the electron transporting material, the electron injecting material, and the light emitting material are as follows.

As the hole injecting material, an organic compound such as a porphyrin-based compound, a phthalocyanine (hereinafter referred to as "$H_2Pc$"), copper phthalocyanine (hereinafter referred to as "CuPc"), or the like is effective. Further, a material that has a smaller value of an ionization potential than that of the hole transporting material to be used and has a hole transporting function can also be used as the hole injecting material. There is also a material obtained by chemically doping a conductive high molecular compound, which includes polyaniline and polyethylene dioxythiophene (hereinafter referred to as "PEDOT") doped with polystyrene sulfonate (hereinafter referred to as "PSS"). Also, a high molecular compound of an insulator is effective in terms of planarization of an anode, and polyimide (hereinafter referred to as "PI") is often used. Further, an inorganic compound is also used, which includes an ultra-thin film of aluminum oxide (hereinafter referred to as "alumina") in addition to a thin film of a metal such as gold or platinum.

It is an aromatic amine-based (that is, one having a bond of benzene ring-nitrogen) compound that is most widely used as the hole transporting material. A material that is widely used includes 4,4'-bis(diphenylamino)-biphenyl (hereinafter referred to as "TAD"), derivatives thereof such as 4,4'-bis[N-(3-methylphenyl)-N-phenyl-amino]-biphenyl (hereinafter referred to as "TPD"), 4,4'-bis[N-(1-naphthyl)-N-phenyl-amino]-biphenyl (hereinafter referred to as "α-NPD"), and star burst aromatic amine compounds such as 4,4',4"-tris(N,N-diphenyl-amino)-triphenylamine (hereinafter referred to as "TDATA") and 4,4',4"-tris[N-(3-methylphenyl)-N-phenyl-amino]-triphenylamine (hereinafter referred to as "MTDATA").

As the electron transporting material, a metal complex is often used, which includes a metal complex having a quinoline skeleton or a benzoquinoline skeleton such as Alq, BAlq, tris(4-methyl-8-quinolinolato)aluminum (hereinafter referred to as "Almq"), or bis(10-hydroxybenzo[h]-quinolinato)beryllium (hereinafter referred to as "BeBq"), and in addition, a metal complex having an oxazole-based or thiazole-based ligand such as bis[2-(2-hydroxyphenyl)-benzoxazolato]zinc (hereinafter referred to as "$Zn(BOX)_2$") or bis[2-(2-hydroxyphenyl)-benzothiazolato]zinc (hereinafter referred to as "$Zn(BTZ)_2$"). Further, in addition to the metal complexes, oxadiazole derivatives such as 2-(4-biphenylyl)-5-(4-tert-butylphenyl)-1,3,4-oxadiazole (hereinafter referred to as "PBD") and OXD-7, triazole derivatives such as TAZ and 3-(4-tert-butylphenyl)-4-(4-ethylphenyl)-5-(4-biphenylyl)-2,3,4-triazole (hereinafter referred to as "p-EtTAZ"), and phenanthroline derivatives such as bathophenanthroline (hereinafter referred to as "BPhen") and BCP have an electron transporting property.

As the electron injecting material, the above-mentioned electron transporting materials can be used. In addition, an extra-thin film of an insulator, for example, metal halide such as calcium fluoride, lithium fluoride, or cesium fluoride, alkali metal oxide such as lithium oxide, or the like is often used. Further, an alkali metal complex such as lithium acetyl acetonate (hereinafter referred to as "Li(acac)") or 8-quinolinolato-lithium (hereinafter referred to as "Liq") is also effective.

As the light emitting material, in addition to the above-mentioned metal complexes such as Alq, Almq, BeBq, BAlq, $Zn(BOX)_2$, and $Zn(BTZ)_2$, various fluorescent pigments are effective. The fluorescent pigments include 4,4'-bis(2,2-diphenyl-vinyl)-biphenyl, which is blue, and 4-(dicyanomethylene)-2-methyl-6-(p-dimethylaminostyryl)-4H-pyran, which is red-orange, and the like. Also, a triplet light emitting material is available, which mainly includes a complex with platinum or iridium as a central metal. As the triplet light emitting material, tris(2-phenylpyridine)iridium, bis(2-(4'-tolyl)pyridinato-N,$C^{2'}$)acetylacetonato iridium (hereinafter referred to as "$acacIr(tpy)_2$"), 2,3,7,8,12,13,17,18-octaethyl-21H,23Hporphyrin-platinum, and the like are known.

By using the materials each having the function as described above in combination, a highly reliable EL element can be formed.

Further, an EL element in which layers are formed in a reverse order to that of FIG. 38A can be used as shown in FIG. 38B. That is, a cathode 3818, an electron injecting layer 3817 formed of an electron injecting material, an electron transporting layer 3816 formed of an electron transporting material, a light emitting layer 3815, a hole transporting layer 3814 formed of a hole transporting material, a hole injecting layer 3813 formed of a hole injecting material, and an anode 3812 are stacked in this order over a substrate 3811.

In addition, in order to extract light emission of an EL element, at least one of an anode and a cathode is required to transmit light. A TFT and an EL element are formed over a substrate and there are EL elements having a top emission structure where light emission is taken out through a surface opposite to the substrate, having a bottom emission structure where light emission is taken out through a surface on the substrate side, and having a dual emission structure where light emission is taken out through a surface opposite to the substrate and a surface on the substrate side respectively. The pixel structure of the invention can be applied to the EL element having any emission structure.

Figures 39A, 39B, 39C:
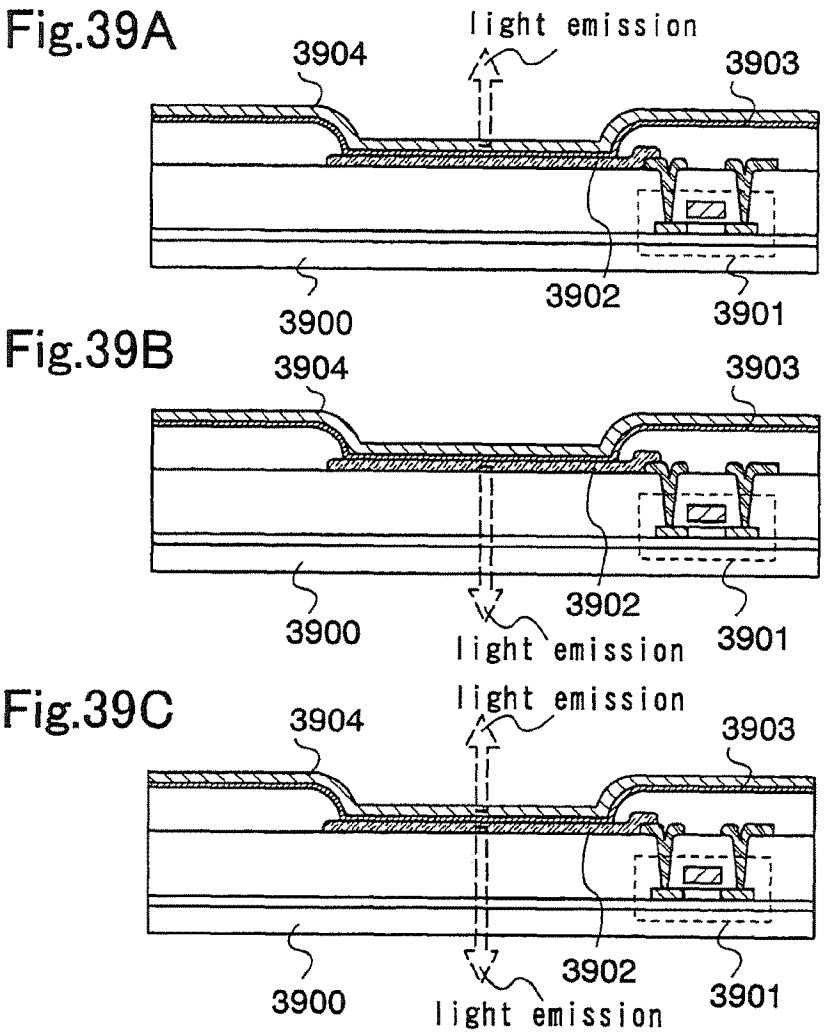
FIGS. 39A to 39C are diagrams each showing a display panel of the invention.

Description is made with reference to FIG. 39A of an EL element with a top emission structure.

A driving TFT 3901 is formed over a substrate 3900 and a first electrode 3902 is formed in contact with a source electrode of the driving ITT 3901, over which a layer 3903 containing an organic compound and a second electrode 3904 are formed.

Further, the first electrode 3902 is an anode of a EL element. The second electrode 3904 is a cathode of the EL element. That is, a region where the layer 3903 containing an organic compound is interposed between the first electrode 3902 and the second electrode 3904 corresponds to the EL element.

Further, as a material used for the first electrode 3902 which functions as an anode, a material having a high work function is preferably used. For example, a single layer of a titanium nitride film, a chromium film, a tungsten film, a Zn film, a Pt film, or the like, a stacked layer of a titanium nitride film and a film containing aluminum as a main component, a stacked layer of three layers of a titanium nitride film, a film containing aluminum as a main component, and a titanium nitride film, or the like can be used. With a stacked layer structure, the resistance as a wire is low, a preferable ohmic contact can be obtained, and further a function as an anode can be obtained. By using a metal film which reflects light, an anode which does not transmit light can be formed.

As a material used for the second electrode 3904 which functions as a cathode, a stacked layer of a metal thin film formed of a material having a low work function (Al, Ag, Li, Ca, or an alloy thereof such as MgAg, MgIn, AlLi, $CaF_2$, or $Ca_3N_2$) and a light-transmissive conductive film (of ITO (indium tin oxide), indium zinc oxide (IZO), zinc oxide (ZnO), or the like) is preferably used. By using a metal thin film and a light-transmissive conductive film in this manner, a cathode which can transmit light can be formed.

In this manner, light from the EL element can be extracted to the top surface as shown by an arrow in FIG. 39A. That is, in the case of applying to the display panel shown in FIGS. 37A and 37B, light is emitted to the sealing substrate 3704 side. Therefore, in the case of using a EL element with a top emission structure to a display device, a substrate which transmits light is used as the sealing substrate 3704.

In the case of providing an optical film, an optical film may be provided over the sealing substrate 2204.

It is to be noted that a metal film formed of a material which functions as a cathode and has a low work function, such as MgAg, MgIn, or AlLi can be used for the first electrode 3902. For the second electrode 3904, a light-transmissive conductive film such as an ITO (indium tin oxide) film or an indium zinc oxide (IZO) film can be used. Accordingly, with this structure, the transmittance of the top light emission can be improved.

Further, description is made of an EL element with a bottom emission structure with reference to FIG. 39B. The same reference numerals as those in FIG. 39A are used since the structures are the same except for the light emission structure.

Here, as a material used for the first electrode 3902 which functions as an anode, a material having a high work function is preferably used. For example, a light-transmissive conductive film such as an ITO (indium tin oxide) film or an indium zinc oxide (IZO) film can be used. By using a light-transmissive conductive film, an anode which can transmit light can be formed.

As a material used for the second electrode 3904 which functions as a cathode, a metal film formed of a material having a low work function (Al, Ag, Li, Ca, or an alloy thereof such as MgAg, MgIn, AlLi, $CaF_2$, or $Ca_3N_2$) can be used. By using a metal film which reflects light, a cathode which does not transmit light can be formed.

In this manner, light from the EL element can be extracted to a bottom surface as shown by an arrow in FIG. 39B. That is, in the case of applying to the display panel shown in FIGS. 37A and 37B, light is emitted to the substrate 3710 side. Therefore, in the case of using an EL element with a bottom emission structure for a display device, a substrate which transmits light is used as the sealing substrate 3704.

In the case of providing an optical film, an optical film may be provided over the substrate 3710.

Description is made with reference to FIG. 39C of a EL element with a dual emission structure. The same reference numerals as those in FIG. 39A are used since the structures are the same except for the light emission structure.

Here, as a material used for the first electrode 3902 which functions as an anode, a material having a high work function is preferably used. For example, a light-transmissive conductive film such as an ITO (indium tin oxide) film or an indium zinc oxide (IZO) film can be used. By using a light-transmissive conductive film, an anode which can transmit light can be formed.

As a material used for the second electrode 3904 which functions as a cathode, a stacked layer of a metal thin film formed of a material having a low work function (Al, Ag, Li, Ca, or an alloy thereof such as MgAg, MgIn, AlLi, $CaF_2$, or $Ca_3N_2$), and a light-transmissive conductive film (ITO (indium tin oxide), indium oxide zinc oxide ($In_2O_3$—ZnO) alloy, zinc oxide (ZnO), or the like) is preferably used. By using a metal thin film and a light-transmissive conductive film in this manner, a cathode which can transmit light can be formed.

In this manner, light from the EL element can be extracted to the both surfaces as shown by arrows of FIG. 39C. That is, in the case of applying to the display panel shown in FIGS. 37A and 37B, light is emitted to the substrate 3710 side and the sealing substrate 3704 side. Therefore, in the case of applying a EL element with a dual emission structure to a display device, substrates which transmit light are used as the substrate 3710 and the sealing substrate 3704.

In the case of providing an optical film, optical films may be provided over both the substrate 3710 and the sealing substrate 3704.

The invention can also be applied to a display device which realizes full color display by using a white EL element and a color filter.

Figure 40:
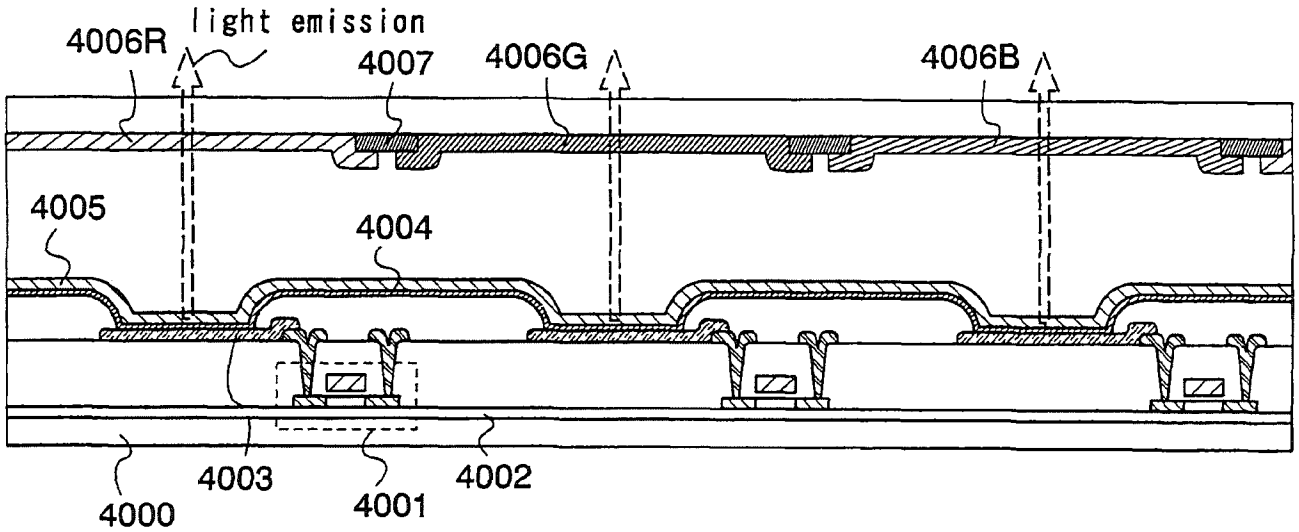
FIG. 40 is a diagram showing a display panel of the invention.

As shown in FIG. 40, a base film 4002 is formed over a substrate 4000 and a driving TFT 4001 is formed thereover. A first electrode 4003 is formed in contact with a source electrode of the driving TFT 4001 and a layer 4004 containing an organic compound and a second electrode 4005 are formed thereover.

The first electrode 4003 is an anode of an EL element. The second electrode 4005 is a cathode of the EL element. That is, a region where the layer 4004 containing an organic compound is interposed between the first electrode 4003 and the second electrode 4005 corresponds to the EL element. In the structure shown in FIG. 40, white light is emitted. A red color filter 4006R, a green color filter 4006G, and a blue color filter 4006B are provided over the EL element, thereby full color display can be carried out. Further, a black matrix (also referred to as BM) 4007 for separating these color filters is provided.

The aforementioned structures of the EL element can be used in combination and can be appropriately used for the display device having the pixel structure of the invention. The structures of the display panel and the EL elements which are described above are examples and it is needless to say that the pixel structure of the invention can be applied to display devices having other structures.

Next, a partial cross-sectional view of a pixel portion of a display panel is described.

First, description is made of the case of using a crystalline semiconductor film (polysilicon (p-Si) film) as a semiconductor layer of a transistor with reference to FIGS. 41A and 41B and FIGS. 42A and 42B.

Here, the semiconductor layer is obtained by, for example, forming an amorphous silicon (a-Si) film over a substrate by a known film deposition method. Note that the semiconductor film is not limited to the amorphous silicon film, and any semiconductor film having an amorphous structure (including a microcrystalline semiconductor film) may be used. Further, a compound semiconductor film having an amorphous structure, such as an amorphous silicon germanium film may be used.

Then, the amorphous silicon film is crystallized by laser crystallization, thermal crystallization using RTA or an annealing furnace, thermal crystallization using a metal element which promotes crystallization, or the like. Needless to say, such crystallization may be carried out in combination.

As a result of the aforementioned crystallization, a crystallized region is formed in a part of the amorphous semiconductor film.

In addition, the crystalline semiconductor film having a partially increased crystallinity is patterned into a desired shape, and an island-shaped semiconductor film is formed using the crystallized region. This semiconductor film is used as the semiconductor layer of the transistor. Note that patterning is to process a film shape, which means forming a film pattern by a photolithography technique (including forming contact hole in photosensitive acrylic and processing photosensitive acrylic so as to be a spacer), forming a mask pattern by a photolithography technique and etching with the use of the mask pattern, or the like.

Figure 41A:
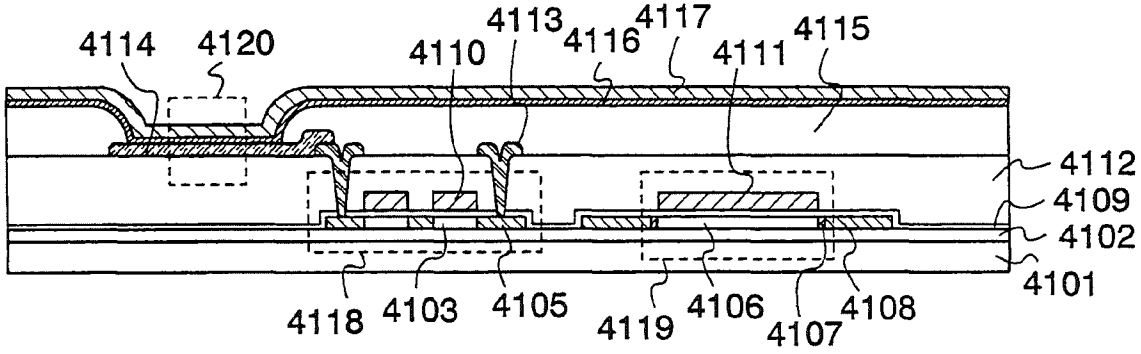
FIGS. 41A and 41B are diagrams each showing a structure of a transistor and a capacitor which can be applied to a pixel of the invention.
Figure 41B:
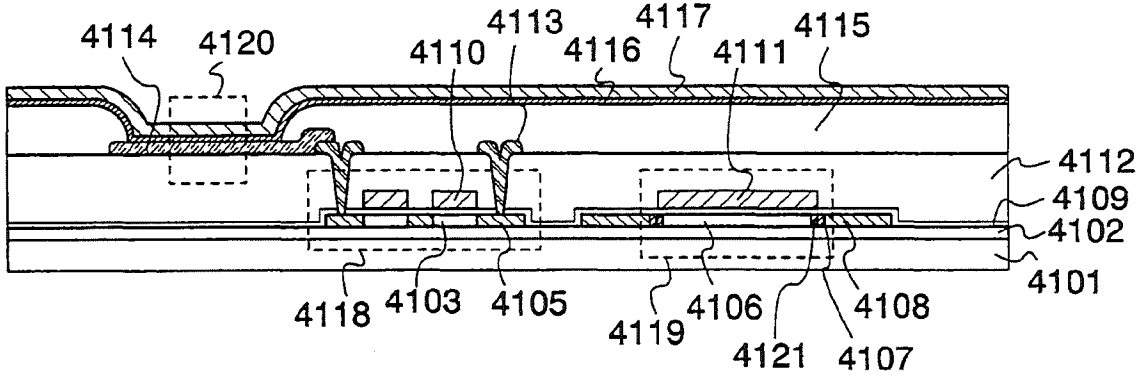

As shown in FIGS. 41A and 41B, a base film 4102 is formed over a substrate 4101, and a semiconductor layer is formed thereover. The semiconductor layer includes a channel forming region 4103 and an impurity region 4105 functioning as a source or drain region, which are in a driving transistor 4118, and a channel forming region 4106, an LDD region 4107, and an impurity region 4108 functioning as a lower electrode, which are in a capacitor 4119. Note that channel doping may be carried out to the channel forming regions 4103 and 4106.

As the substrate, a glass substrate, a quartz substrate, a ceramic substrate, a plastic substrate, or the like can be used. The base film 4102 can be formed using a single layer of aluminum nitride (AlN), silicon oxide ($SiO_2$), silicon oxynitride ($SiO_xN_y$), or the like, or stacked layers thereof.

A gate electrode 4110 and an upper electrode 4111 of the capacitor are formed over the semiconductor layer with a gate insulating film 4109 interposed therebetween.

An interlayer insulating film 4112 is formed so as to cover the driving transistor 4118 and the capacitor 4119. Then, a contact hole is formed in the interlayer insulating film 4112, through which a wire 4113 is in contact with the impurity region 4105. A pixel electrode 4114 is formed in contact with the wire 4113, and an insulator 4115 is formed so as to cover end portions of the pixel electrode 4114 and the wire 4113. Here, the insulator 4115 is formed using a positive photosensitive acrylic resin film. Then, a layer 4116 containing an organic compound and a counter electrode 4117 are formed over the pixel electrode 4114. Thus, an EL element 4120 corresponds to a region where the layer 4116 containing an organic compound is interposed between the pixel electrode 4114 and the counter electrode 4117.

In addition, the LDD region which forms a part of the lower electrode of the capacitor 4119 may overlap the upper electrode 4111. That is, the capacitor 4119 may have a region 4123 as shown in FIG. 41B. Note that common portions to those in FIG. 41A are denoted by the same reference numerals, and description thereof is omitted.

Figure 42A:
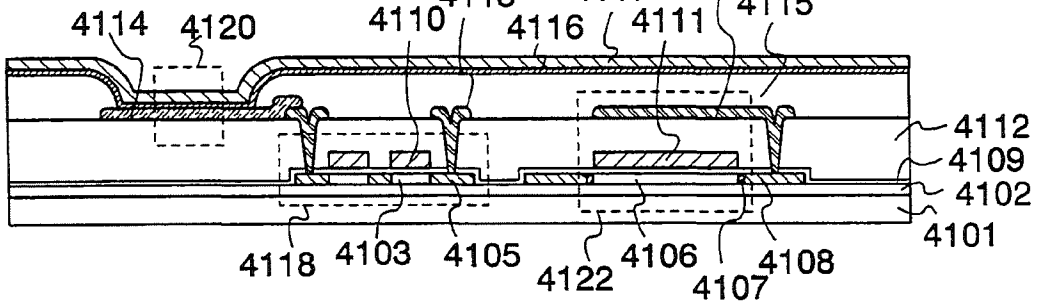
FIGS. 42A and 42B are diagrams each showing a structure of a transistor and a capacitor which can be applied to a pixel of the invention.

In addition, as shown in FIG. 42A, a second upper electrode 4121 may be provided, which is formed in the same layer as the wire 4113 in contact with the impurity region 4105 of the driving transistor 4118. Note that common portions to those in FIG. 41A are denoted by the same reference numerals, and description thereof is omitted. A second capacitor is formed by interposing the interlayer insulating film 4112 between the second upper electrode 4121 and the upper electrode 4111. In addition, since the second upper electrode 4121 is in contact with the impurity region 4108, a first capacitor having such a structure that the gate insulating film 4109 is interposed between the upper electrode 4111 and the channel forming region 4106, and the second capacitor having such a structure that the interlayer insulating film 4112 is interposed between the upper electrode 4111 and the second upper electrode 4121 are connected in parallel, so that a capacitor 4122 having the first and second capacitors is obtained. Since the capacitor 4122 has a total capacitance of those of the first and second capacitors, the capacitor having a large capacitance can be formed in a small area. That is, using the capacitor in the pixel structure of the invention will lead to a further improved aperture ratio.

Figure 42B:
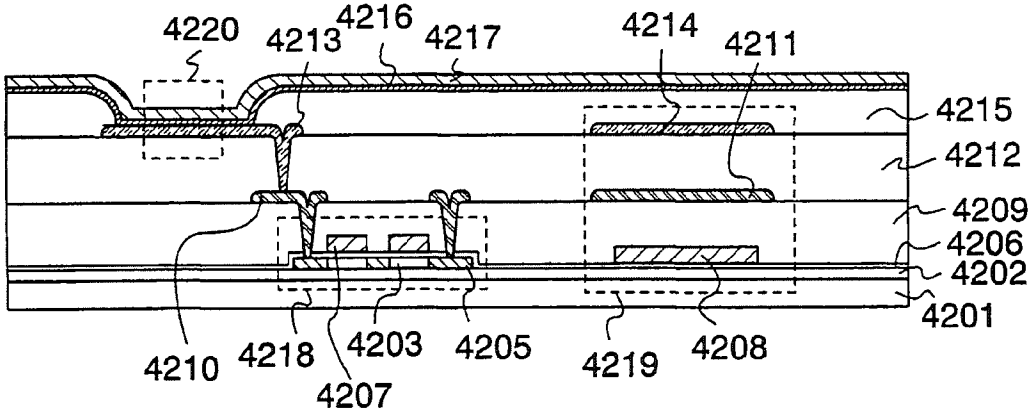

Alternatively, a structure of a capacitor as shown in FIG. 42B may be adopted. A base film 4202 is formed over a substrate 4201, and a semiconductor layer is formed thereover. The semiconductor layer includes a channel forming region 4203 and an impurity region 4205 functioning as a source or drain region of a driving transistor 4218. Note that channel doping may be carried out to the channel forming region 4203.

As the substrate, a glass substrate, a quartz substrate, a ceramic substrate, a plastic substrate, or the like can be used. The base film 4202 can be formed using a single layer of aluminum nitride (AlN), silicon oxide ($SiO_2$), silicon oxynitride ($SiO_xN_y$), or the like or stacked layers thereof.

A gate electrode 4207 and a first electrode 4208 are formed over the semiconductor layer with a gate insulating film 4206 interposed therebetween.

A first interlayer insulating film 4209 is formed so as to cover the driving transistor 4218 and the first electrode 4208. Then, a contact hole is formed in the first interlayer insulating film 4209, through which a wire 4210 is in contact with the impurity region 4205. In addition, a second electrode 4211 is formed in the same layer and with the same material as the wire 4210.

Furthermore, a second interlayer insulating film 4212 is formed so as to cover the wire 4210 and the second electrode 4211. Then, a contact hole is formed in the second interlayer insulating film 4212, through which a pixel electrode 4213 is formed in contact with the wire 4210. A third electrode 4214 is formed in the same layer and with the same material as the pixel electrode 4213. Here, a capacitor 4219 is formed of the first electrode 4208, the second electrode 4211, and the third electrode 4214.

An insulator 4215 is formed so as to cover an end portion of the pixel electrode 4213 and the third electrode 4214, and a layer 4216 containing an organic compound and a counter electrode 4217 are formed over the third insulator 4215 and the third electrode 4214. Then, an EL element 4220 corresponds to a region where the layer 4216 containing an organic compound is interposed between the pixel electrode 4213 and the counter electrode 4217.

As described above, each of the structures shown in FIGS. 41A and 41B and FIGS. 42A and 42B can be given as a structure of a transistor using a crystalline semiconductor film for its semiconductor layer. Note that the transistors having the structures shown in FIGS. 41A and 41B and FIGS. 42A and 42B are examples of transistors with a top-gate structure. That is, the transistor may be either a p-channel transistor or an n-channel transistor. In the case where the transistor is an n-channel transistor, the LDD region may be formed either so as to overlap the gate electrode or not to overlap, or a part of the LDD region may be formed so as to overlap the gate electrode. Further, the gate electrode may have a tapered shape and the LDD region may be provided below the tapered portion of the gate electrode in a self-aligned manner. In addition, the number of gate electrodes is not limited to two, and a multi-gate structure with three or more gate electrodes may be employed, or a single gate structure may also be employed.

Next, as a structure of a transistor which uses polysilicon (p-Si) for its semiconductor layer, FIGS. 45A and 45B each show a partial cross-sectional view of a display panel using a transistor which has a structure where a gate electrode is interposed between a substrate and a semiconductor layer, that is, a transistor with a bottom-gate structure where a gate electrode is located below a semiconductor layer.

A base film 4502 is formed over a substrate 4501. Then, a gate electrode 4503 is formed over the base film 4502. A first electrode 4504 is formed in the same layer and with the same material as the gate electrode. As a material of the gate electrode 4503, polycrystalline silicon to which phosphorus is added can be used. Besides polycrystalline silicon, silicide which is a compound of metal and silicon may be used.

Then, a gate insulating film 4505 is formed so as to cover the gate electrode 4503 and the first electrode 4504. As the gate insulating film 4505, a silicon oxide film, a silicon nitride film, or the like is used.

A semiconductor layer is formed over the gate insulating film 4505. The semiconductor layer includes a channel forming region 4506, an LDD region 4507, and an impurity region 4508 functioning as a source or drain region, which are in a driving transistor 4522, and a channel forming region 4509, an LDD region 4510, and an impurity region 4511, which function as a second electrode of a capacitor 4523. Note that channel doping may be carried out to the channel forming regions 4506 and 4509.

As the substrate, a glass substrate, a quartz substrate, a ceramic substrate, a plastic substrate, or the like can be used. The base film 4502 can be formed using a single layer of aluminum nitride (AlN), silicon oxide ($SiO_2$), silicon oxynitride ($SiO_xN_y$), or the like or stacked layers thereof.

A first interlayer insulating film 4512 is formed so as to cover the semiconductor layer. Then, a contact hole is formed in the first interlayer insulating film 4512, through which a wire 4513 is in contact with the impurity region 4508. A third electrode 4514 is formed in the same layer and with the same material as the wire 4513. The capacitor 4523 is formed with the first electrode 4504, the second electrode, and the third electrode 4514.

In addition, an opening portion 4515 is formed in the first interlayer insulating film 4512. A second interlayer insulating film 4516 is formed so as to cover the driving transistor 4522, the capacitor 4523, and the opening portion 4515. Then, a contact hole is formed in the second interlayer insulating film 4516, through which a pixel electrode 4517 is formed. Then, an insulator 4518 is formed so as to cover end portions of the pixel electrode 4517. For example, a positive photosensitive acrylic resin film can be used. Subsequently, a layer 4519 containing an organic compound and a counter electrode 4520 are formed over the pixel electrode 4517. Thus, an EL element 4521 corresponds to a region where the layer 4519 containing an organic compound is interposed between the pixel electrode 4517 and the counter electrode 4520. The opening portion 4515 is located below the EL element 4521. That is, in the case where light emitted from the EL element 4521 is extracted from the substrate side, the transmittance can be improved due to the existence of the opening portion 4515.

Figure 45A:
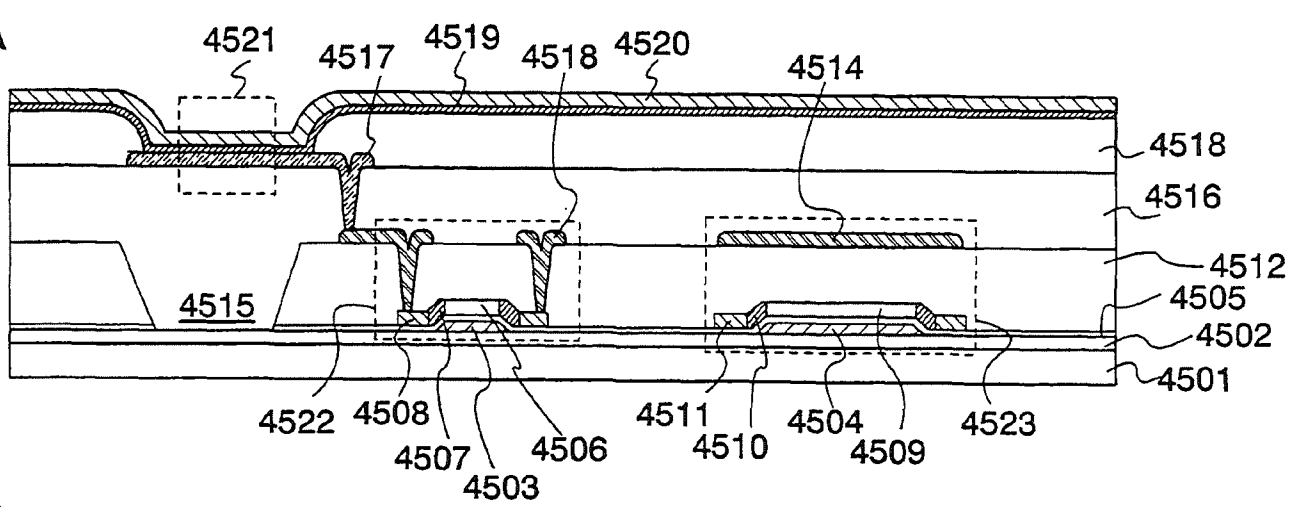
FIGS. 45A and 45B are diagrams each showing a structure of a transistor and a capacitor which can be applied to a pixel of the invention.
Figure 45B:
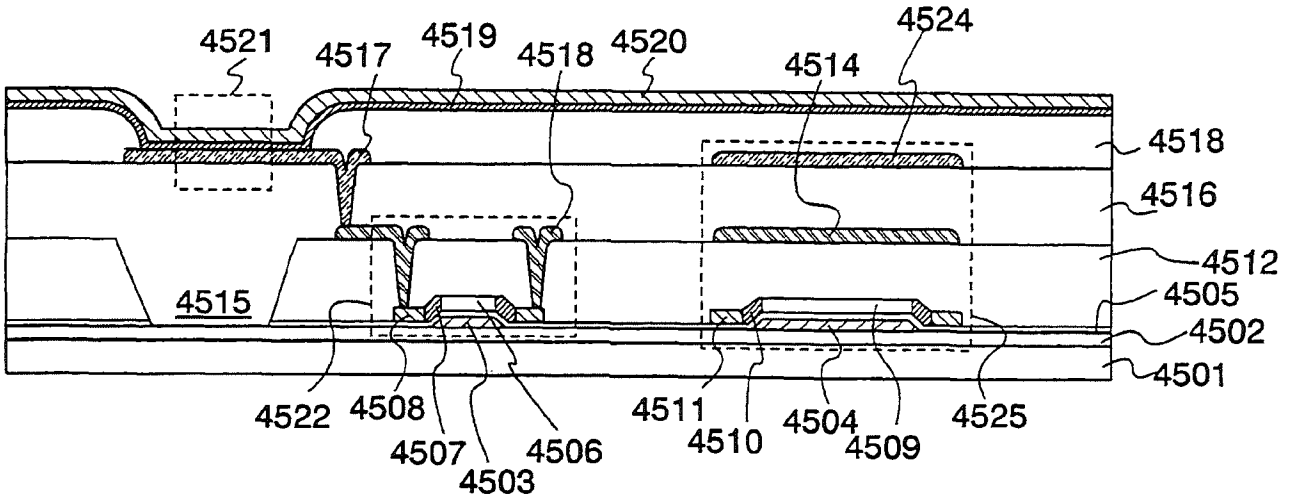

Furthermore, a fourth electrode 4524 may be formed in the same layer and with the same material as the pixel electrode 4517 in FIG. 45A so as to obtain a structure shown in FIG. 45B. In this case, a capacitor 4525 can be formed by the first electrode 4504, the second electrode, the third electrode 4514, and the fourth electrode 4524.

Figure 46A:
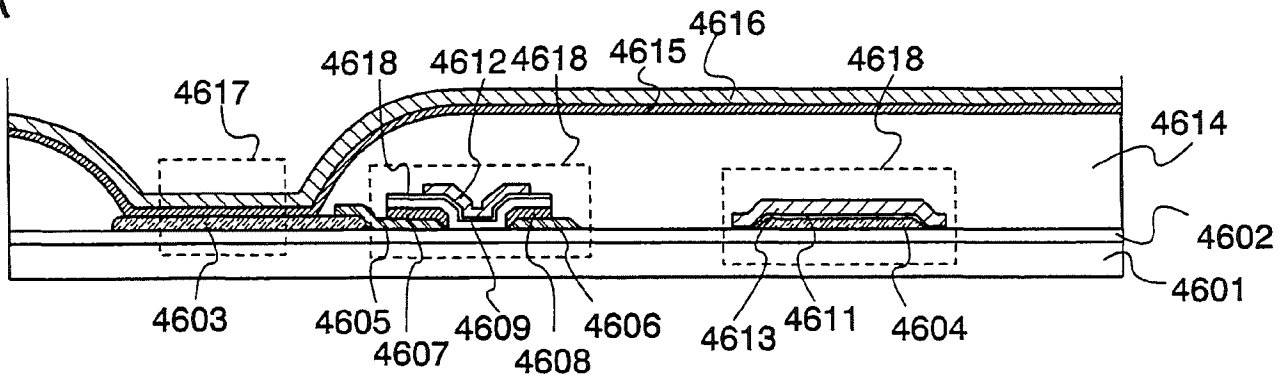
FIGS. 46A and 46B are diagrams each showing a structure of a transistor and a capacitor which can be applied to a pixel of the invention.
Figure 46B:
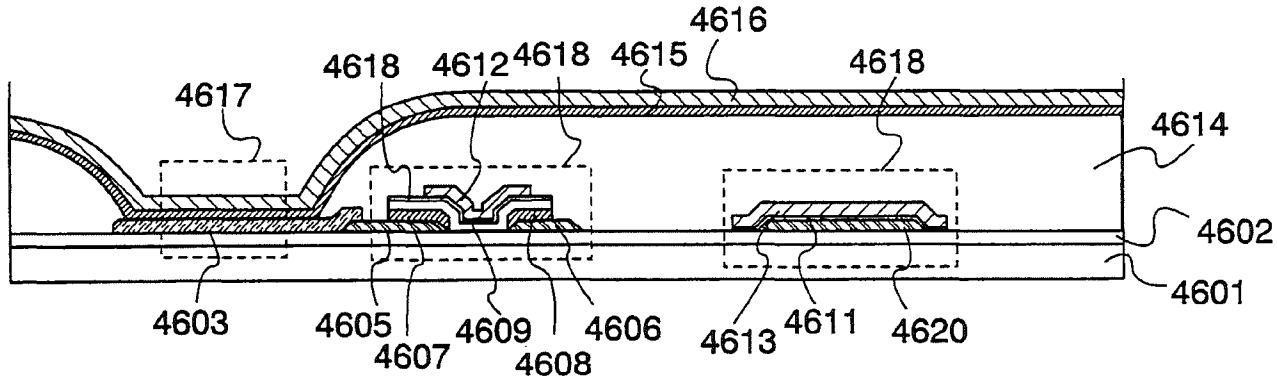

Next, description is made of the case of using an amorphous silicon (a-Si:H) film as a semiconductor layer of a transistor. FIGS. 46A and 46B show cases of a top-gate transistor, and FIGS. 47A, 47B, 45A, and 45B show cases of a bottom-gate transistor.

FIG. 46A shows a cross sectional view of a transistor having a forward staggered structure, which uses amorphous silicon for its semiconductor layer. A base film 4602 is formed over a substrate 4601. Further, a pixel electrode 4603 is formed over the base film 4602. In addition, a first electrode 4604 is formed in the same layer and with the same material as the pixel electrode 4603.

As the substrate, a glass substrate, a quartz substrate, a ceramic substrate, a plastic substrate, or the like can be used. The base film 4602 can be formed using a single layer of aluminum nitride (MN), silicon oxide ($SiO_2$), silicon oxynitride ($SiO_xN_y$), or the like or stacked layers thereof.

Wires 4605 and 4606 are formed over the base film 4602, and an end portion of the pixel electrode 4603 is covered with the wire 4605. N-type semiconductor layers 4607 and 4608 each having N-type conductivity are formed over the wires 4605 and 4606 respectively. In addition, a semiconductor layer 4609 is formed between the wires 4605 and 4606 and over the base film 4602. The semiconductor layer 4609 is partially extended so as to cover the N-type semiconductor layers 4607 and 4608. Note that this semiconductor layer is formed by an amorphous semiconductor film such as an amorphous silicon (a-Si:H) film or a microcrystalline semiconductor (μ-Si:H) film. Then, a gate insulating film 4610 is formed over the semiconductor layer 4609, and an insulating film 4611 is formed in the same layer and with the same material as the gate insulating film 4610, and also over the first electrode 4604. Note that as the gate insulating film 4610, a silicon oxide film, a silicon nitride film, or the like is used.

A gate electrode 4612 is formed over the gate insulating film 4610. In addition, a second electrode 4613 is formed in the same layer and with the same material as the gate electrode, and over the first electrode 4604 with the insulating film 4611 interposed therebetween. A capacitor 4619 corresponds to a region where the insulating film 4611 is interposed between the first electrode 4604 and the second electrode 4613. An interlayer insulating film 4614 is formed so as to cover end portions of the pixel electrode 4603, the driving transistor 4618, and the capacitor 4619.

A layer 4615 containing an organic compound and a counter electrode 4616 are formed over the interlayer insulating film 4614 and the pixel electrode 4603 located in an opening portion of the interlayer insulating film 4614. Thus, a EL element 4617 corresponds to a region where the layer 4615 containing an organic compound is interposed between the pixel electrode 4603 and the counter electrode 4616.

The first electrode 4604 shown in FIG. 46A may be formed like a first electrode 4620 as shown in FIG. 46B. The first electrode 4620 is formed in the same layer and with the same material as the wires 4605 and 4606.

Figure 47A:
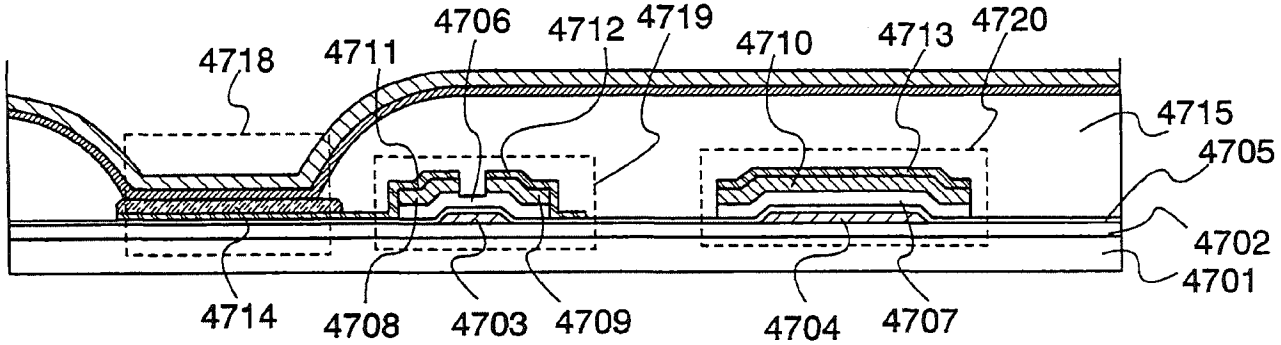
FIGS. 47A and 47B are diagrams each showing a structure of a transistor and a capacitor which can be applied to a pixel of the invention.
Figure 47B:
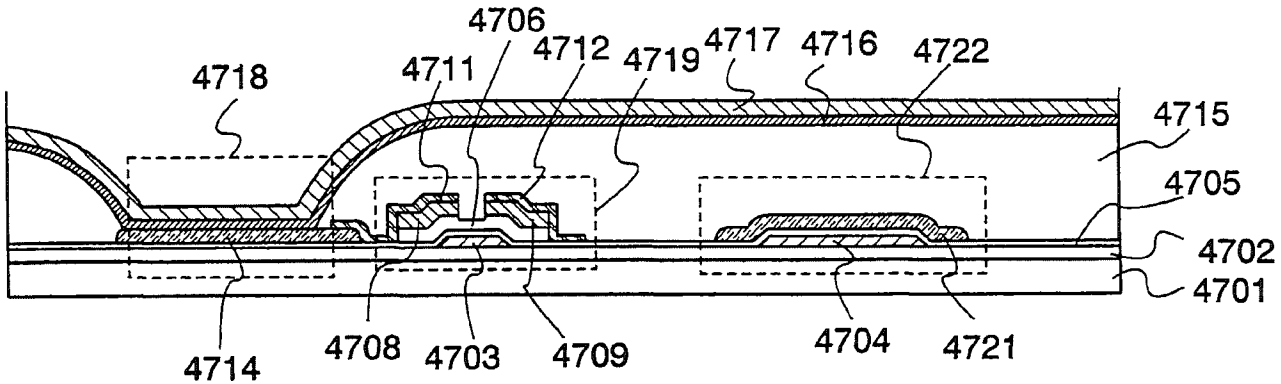

FIGS. 47A and 47B are partial cross-sectional views of a display panel having a bottom-gate transistor which uses amorphous silicon as its semiconductor layer.

A base film 4702 is formed over a substrate 4701. A gate electrode 4703 is formed over the base film 4702. A first electrode 4704 is formed in the same layer and with the same material as the gate electrode. As a material of the gate electrode 4703, polycrystalline silicon to which phosphorus is added can be used. Besides polycrystalline silicon, silicide which is a compound of metal and silicon may be used.

Then, a gate insulating film 4705 is formed so as to cover the gate electrode 4703 and the first electrode 4704. As the gate insulating film 4705, a silicon oxide film, a silicon nitride film, or the like is used.

A semiconductor layer 4706 is formed over the gate insulating film 4705. In addition, a semiconductor layer 4707 is formed in the same layer and with the same material as the semiconductor layer 4706.

As the substrate, a glass substrate, a quartz substrate, a ceramic substrate, a plastic substrate, or the like can be used. The base film 4702 can be formed using a single layer of aluminum nitride (AlN), silicon oxide ($SiO_2$), silicon oxynitride ($SiO_xN_y$), or the like or stacked layers thereof.

N-type semiconductor layers 4708 and 4709 having N-type conductivity are formed over the semiconductor layer 4706, and an N-type semiconductor layer 4710 is formed over the semiconductor layer 4707.

Wires 4711 and 4712 are formed over the N-type semiconductor layers 4708 and 4709 respectively, and a conductive layer 4713 is formed in the same layer and with the same material as the wires 4711 and 4712, over the N-type semiconductor layer 4710.

Thus, a second electrode is formed by the semiconductor layer 4707, the N-type semiconductor layer 4710, and the conductive layer 4713. Note that a capacitor 4720 having a structure where the gate insulating film 4705 is interposed between the second electrode and the first electrode 4704 is formed.

One end portion of the wire 4711 is extended, and a pixel electrode 4714 is formed so as to be in contact with an upper potion of the extended wire 4711.

In addition, an insulator 4715 is formed so as to cover end portions of the pixel electrode 4714, a driving transistor 4719, and the capacitor 4720.

Then, a layer 4716 containing an organic compound and a counter electrode 4717 are formed over the pixel electrode 4714 and the insulator 4715. An EL element 4718 corresponds to a region where the layer 4716 containing an organic compound is interposed between the pixel electrode 4714 and the counter electrode 4717.

The semiconductor layer 4707 and the N-type semiconductor layer 4710 to be a part of the second electrode of the capacitor are not necessarily required. That is, the second electrode may be the conductive layer 4713, so that the capacitor may have such a structure that the gate insulating film 4705 is interposed between the first electrode 4704 and the conductive layer 4713.

Note that the pixel electrode 4714 is formed before the wire 4711 in FIG. 47A is formed, thereby a capacitor 4722 as shown in FIG. 47B can be obtained, which has a structure where the gate insulating film 4705 is interposed between the first electrode 4704 and a second electrode 4721 formed of the pixel electrode 4714.

Although FIGS. 47A and 47B show inverted staggered channel-etched transistors, a channel-protective transistor may be used. Description of channel-protective transistors is made with reference to FIGS. 48A and 48B.

Figure 48A:
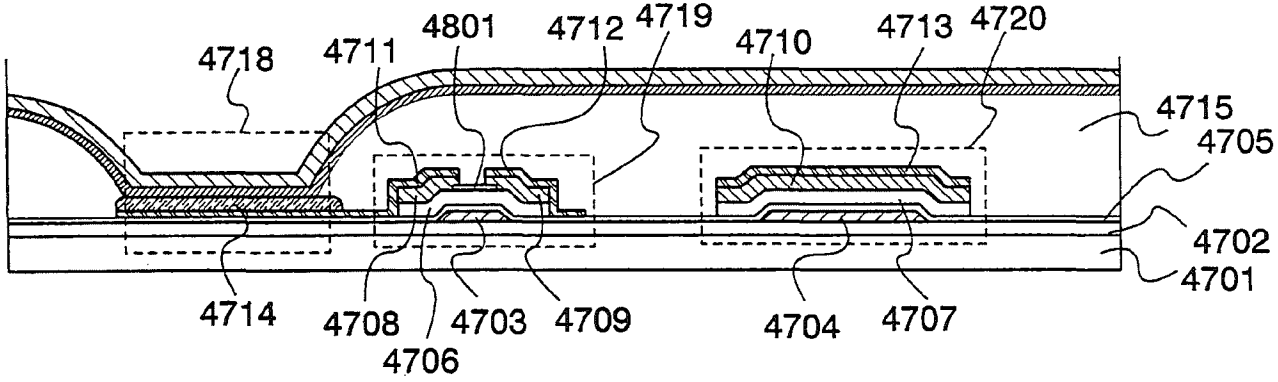
FIGS. 48A and 48B are diagrams each showing a structure of a transistor and a capacitor which can be applied to a pixel of the invention.
Figure 48B:
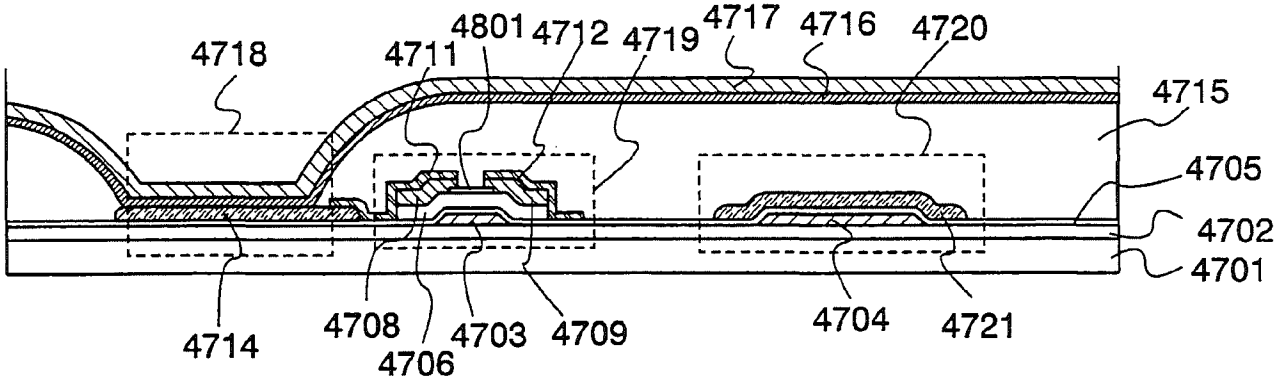

A channel-protective transistor shown in FIG. 48A is different from the channel-etched driving transistor 4719 shown in FIG. 47A in that an insulator 4801 functioning as an etching mask is provided over the channel forming region in the semiconductor layer 4706. Common portions except that point are denoted by the same reference numerals.

Similarly, a channel-protective transistor shown in FIG. 45B is different from the channel-etched driving transistor 4719 shown in FIG. 47B in that the insulator 4801 functioning as an etching mask is provided over the channel forming region in the semiconductor layer 4706. Common portions except that point are denoted by the same reference numerals.

By using an amorphous semiconductor film as a semiconductor layer (channel forming region, source region, drain region, and the like) of a transistor included in a pixel, the manufacturing cost can be reduced.

Note that structures of the transistors and capacitors which can be applied to the display panel of the invention can be applied are not limited to those described above, and various structures of transistors and capacitors can be used.

Embodiment Mode 7

The display device of the invention can be applied to various electronic appliances, specifically a display portion of electronic appliances. The electronic appliances include cameras such as a video camera and a digital camera, a goggle-type display, a navigation system, an audio reproducing device (car audio component stereo, audio component stereo, or the like), a computer, a game machine, a portable information terminal (mobile computer, mobile phone, mobile game machine, electronic book, or the like), an image reproducing device having a recording medium (specifically, a device for reproducing a recording medium such as a digital versatile disc (DVD) and having a display for displaying the reproduced image) and the like.

Figure 49A:
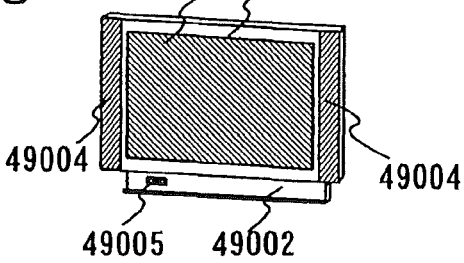
FIGS. 49A to 49H are diagrams each showing an electronic appliance to which a display device of the invention can be applied.

FIG. 49A shows a display which includes a housing 49001, a supporting base 49002, a display portion 49003, a speaker portion 49004, a video inputting terminal 49005, and the like. The display device of the invention can be used for the display portion 49003. Note that the display includes all display devices for displaying information such as for a personal computer, receiving television broadcasting, and displaying an advertisement. A display using the display device of the invention for the display portion 49003 can suppress image burn-in on a display screen.

In recent years, the need to grow in size of a display has been increased. In accordance with the enlargement of a display, rise in price becomes a problem. Therefore, it is an object to reduce the manufacturing cost as much as possible and to provide a high quality product at as low price as possible.

Figure 49B:
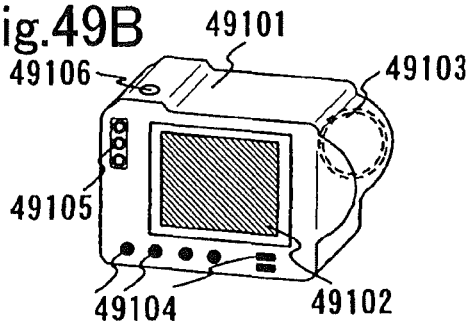

FIG. 49B shows a camera which includes a main body 49101, a display portion 49102, an image receiving portion 49103, operating keys 49104, an external connection port 49105, a shutter 49106, and the like.

In recent years, in accordance with advance in performance of a digital camera and the like, competitive manufacturing thereof has been intensified. Thus, it is important to provide a higher-performance product at as low price as possible. A digital camera using the display device of the invention for the display portion 49102 can suppress image burn-in on a display screen.

Figure 49C:
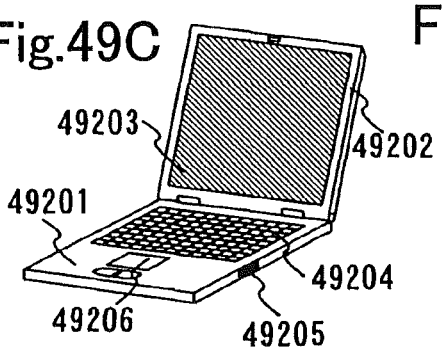

FIG. 49C shows a computer which includes a main body 49201, a housing 49202, a display portion 49203, a keyboard 49204, an external connection port 49205, a pointing mouse 49206, and the like. A computer using the display device of the invention for the display portion 49203 can prevent image burn-in on a display screen.

Figure 49D:
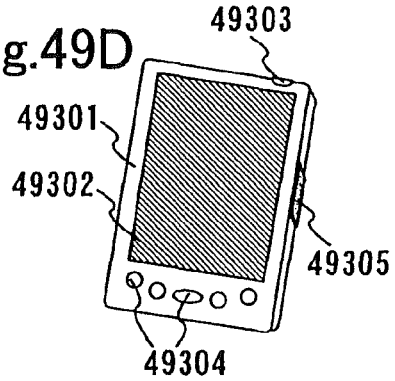

FIG. 49D shows a mobile computer which includes a main body 49301, a display portion 49302, a switch 49303, operating keys 49304, an infrared port 49305, and the like. A mobile computer using the display device of the invention for the display portion 49302 can suppress image burn-in on a display screen.

Figure 49E:
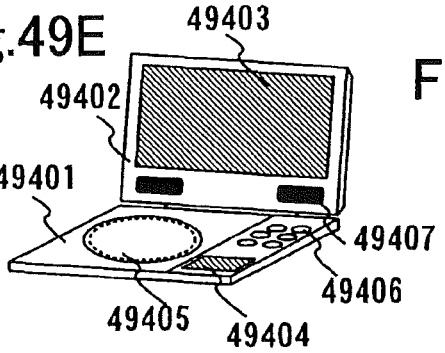

FIG. 49E shows a portable image reproducing device having a recording medium (specifically, a DVD reproducing device), which includes a main body 49401, a housing 49402, a display portion A 49403, a display portion B 49404, a recording medium (DVD or the like) reading portion 49405, an operating key 49406, a speaker portion 49407, and the like. The display portion A 49403 mainly displays image data and the display portion B 49404 mainly displays text data. An image reproducing device using the display device of the invention for the display portions A 49403 and B 49404 can prevent image burn-in on a display screen.

Figure 49F:
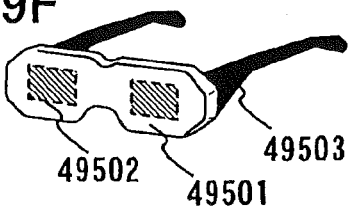

FIG. 49F shows a goggle-type display which includes a main body 49501, a display portion 49502, and an arm portion 49503. A goggle type display using the display device of the invention for the display portion 49502 can suppress image burn-in on a display screen.

Figure 49G:
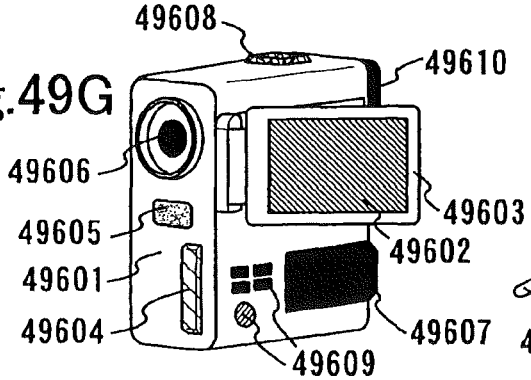

FIG. 49G shows a video camera which includes a main body 49601, a display portion 49602, a housing 49603, an external connection port 49604, a remote control receiving portion 49605, an image receiving portion 49606, a battery 49607, an audio input portion 49608, operating keys 49609, an eye piece portion 49610, and the like. A video camera using the display device of the invention for the display portion 49602 can suppress image burn-in on a display screen.

Figure 49H:
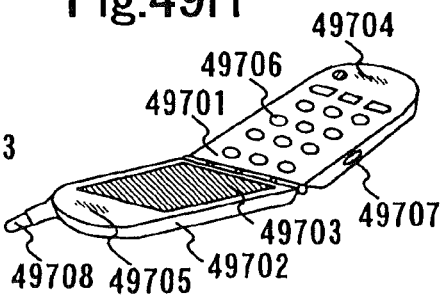

FIG. 49H shows a mobile phone which includes a main body 49701, a housing 49702, a display portion 49703, an audio inputting portion 49704, an audio outputting portion 49705, operating keys 49706, an external connection port 49707, an antenna 49708, and the like.

Thus, the invention can be applied to various electronic appliances.

Embodiment Mode 14

Figure 52:
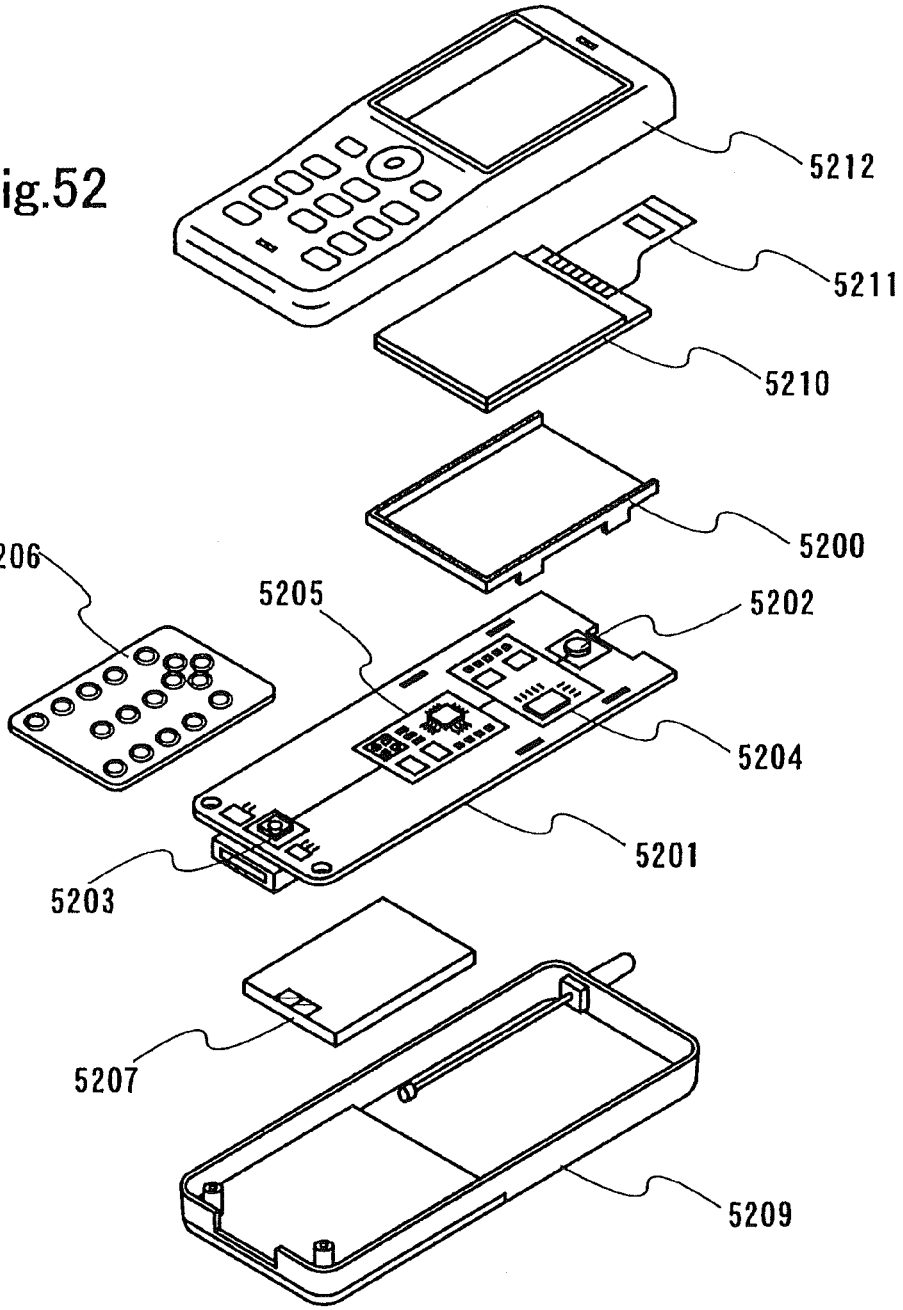
FIG. 52 is a diagram showing a structure example of a mobile phone.

In this embodiment mode, description is made of an example of a structure of a mobile phone having the display device of the invention for a display portion with reference to FIG. 52.

A display panel 5210 is incorporated in a housing 5200 so as to be freely attached and detached. The shape and size of the housing 5200 can be appropriately changed in accordance with the size of the display panel 5210. The housing 5200 provided with the display panel 5210 is fitted in a printed circuit board 5201 so as to be assembled as a module.

The display panel 5210 is connected to the printed circuit board 5201 through an FPC 5211. A speaker 5202, a microphone 5203, a transmitting and receiving circuit 5204, and a signal processing circuit 5205 including a CPU, a controller, and the like are formed over the printed circuit board 5201. Such a module, an inputting means 5206, and a battery 5207 are combined, which is stored in a housing 5209. A pixel portion of the display panel 5210 is disposed so as to be seen from an opening window formed in the housing 5209.

The display panel 5210 may be formed by forming a pixel portion and a part of peripheral driver circuits (a driver circuit whose operation frequency is low among a plurality of driver circuits) using TFTs over the same substrate; forming a part of the peripheral driver circuits (a driver circuit whose operation frequency is high among the plurality of driver circuits) into an IC chip; and mounting the IC chip on the display panel 5210 by COG (Chip On Glass). The IC chip may be, alternatively, connected to a glass substrate by using TAB (Tape Automated Bonding) or a printed circuit board. It is to be noted that FIG. 43A shows an example of structure of such a display panel that a part of peripheral driver circuits is formed over the same substrate as a pixel portion and an IC chip provided with the other part of the peripheral driver circuits is mounted by COG or the like. By employing the above-described structure, power consumption of a display device can be reduced and the life per charge of a mobile phone can be made long. In addition, cost reduction of the mobile phone can be achieved.

It is to be noted that the structure described in this embodiment mode is an example of a mobile phone, and the display device of the invention can be applied not only to a mobile phone having the above-described constitution but also to mobile phones having various structures.

Embodiment Mode 15

Figure 50:
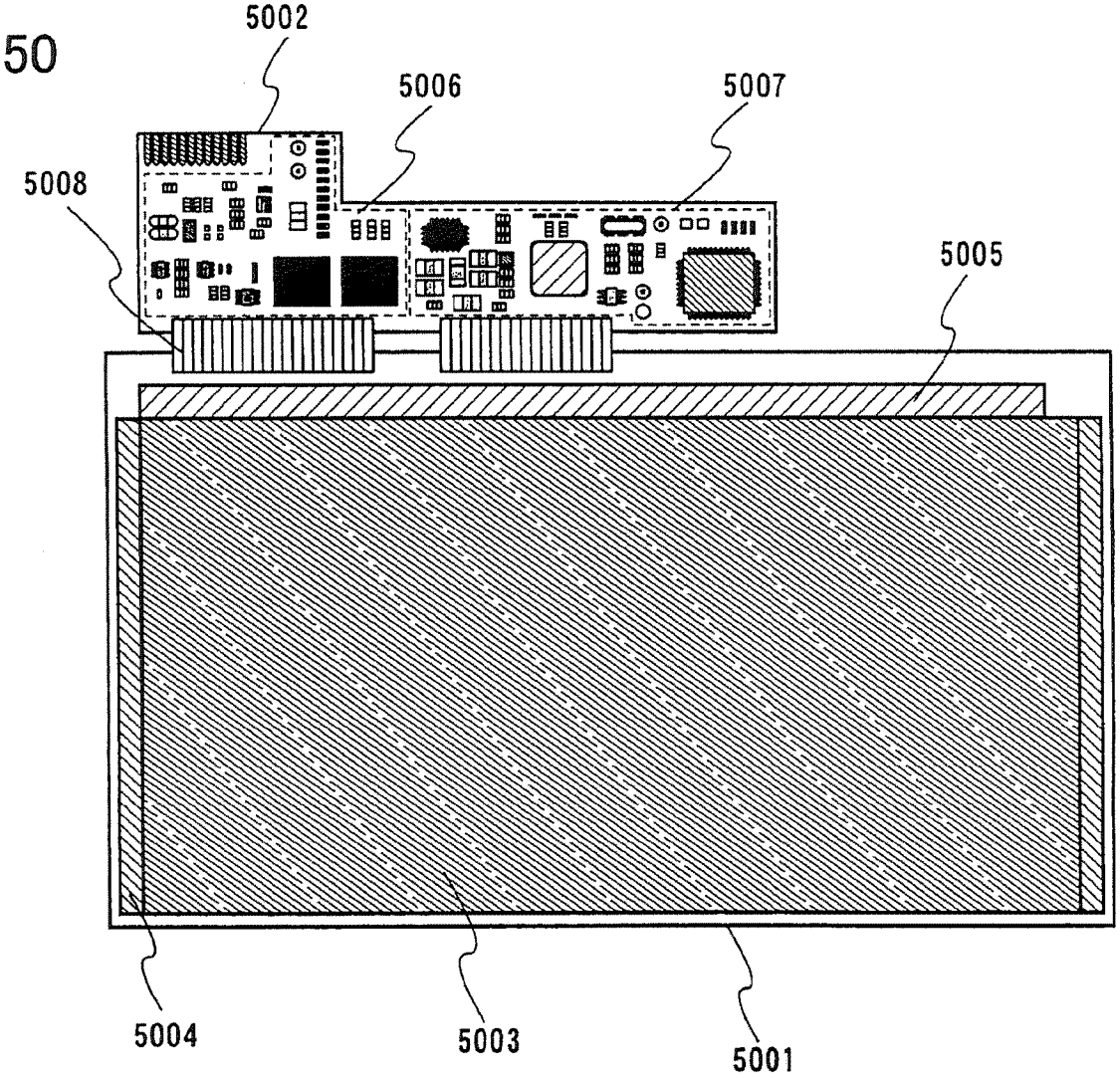
FIG. 50 is a diagram showing an example of an EL module.

FIG. 50 shows an EL module combining a display panel 5001 and a circuit board 5002. The display panel 5001 includes a pixel portion 5003, a scan line driver circuit 5004, and a signal line driver circuit 5005. A control circuit 5006, a signal dividing circuit 5007, and the like are formed over the circuit board 5002. The display panel 5001 and the circuit board 5002 are connected to each other by a connecting wire 5008. As the connecting wire, an FPC or the like can be used.

The display panel 5001 may be formed by forming a pixel portion and a part of peripheral driver circuits (a driver circuit whose operation frequency is low among a plurality of driver circuits) using TFTs over the same substrate; forming a part of the peripheral driver circuits (a driver circuit whose operation frequency is high among the plurality of driver circuits) into an IC chip; and mounting the IC chip on the display panel 5001 by COG (Chip On Glass) or the like. The IC chip may be, alternatively, mounted on the display panel 5001 by using TAB (Tape Automated Bonding) or a printed circuit board. It is to be noted that FIG. 43A shows an example of structure where a part of peripheral driver circuits is formed over the same substrate as a pixel portion and an IC chip provided with the other part of the peripheral driver circuits is mounted by COG or the like.

In addition, in order to further reduce the power consumption, the pixel portion may be formed using TFTs over a glass substrate, all of the peripheral driver circuits may be formed into an IC chip, and the IC chip may be mounted on the display panel by COG (Chip On Glass) or the like.

It is preferable that, in the case where an amorphous semiconductor film is applied to a semiconductor layer of a transistor constituting a pixel, the pixel portion be formed using TFTs over a substrate, all of the peripheral driver circuits be formed into an IC chip, and the IC chip be mounted on the display panel by COG (Chip On Glass). Note that FIG. 43B shows an example of the structure where a pixel portion is formed over a substrate and an IC chip provided with a peripheral driver circuit is mounted on the substrate by COG or the like.

Figure 51:
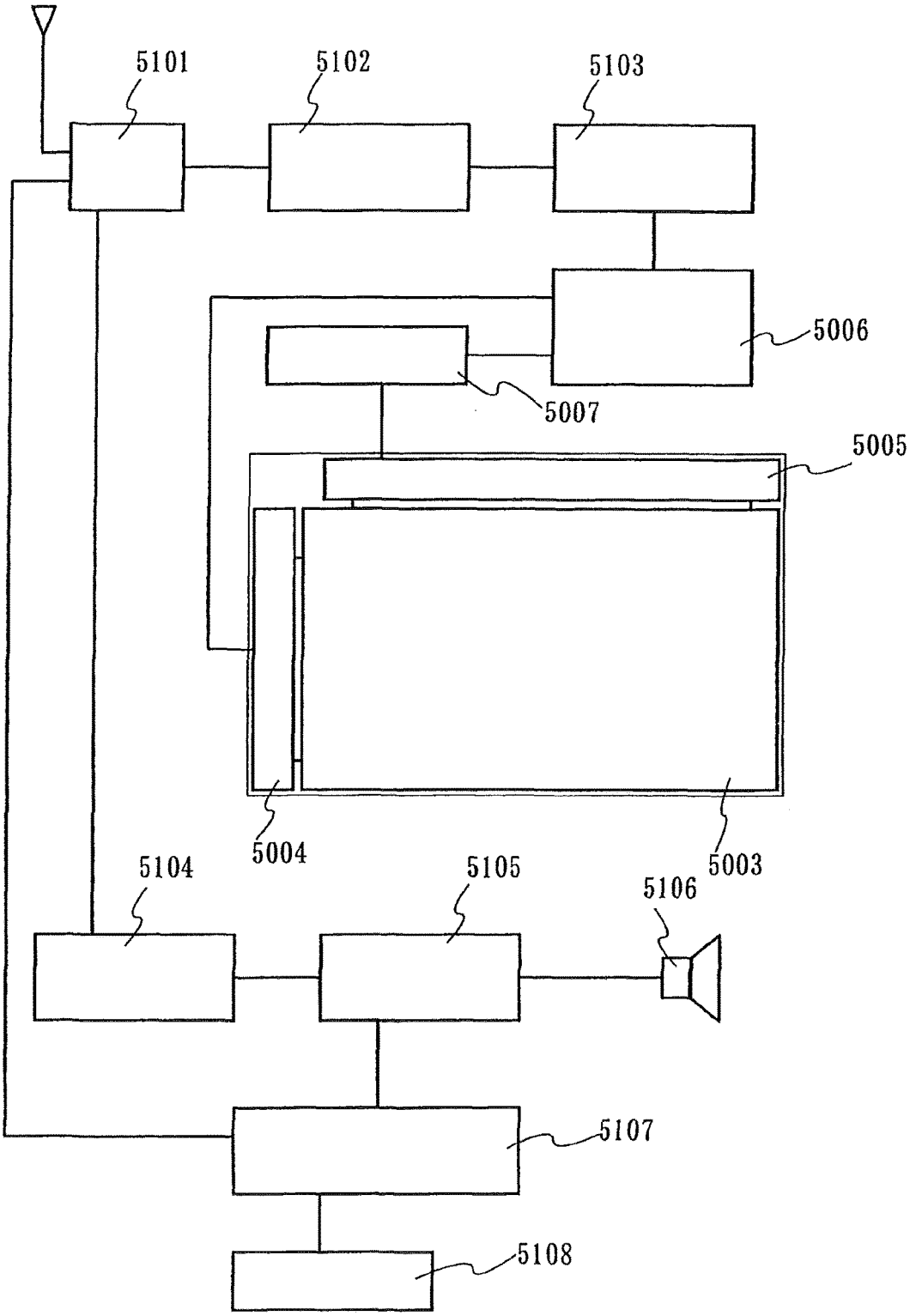
FIG. 51 is a block diagram showing a main structure of an EL television receiver.

An EL television receiver can be completed with the above-described EL module. FIG. 51 is a block diagram showing a main structure of an EL television receiver. A tuner 5101 receives a video signal and an audio signal. The video signals are processed by a video signal amplifier circuit 5102, a video signal processing circuit 5103 for converting a signal outputted from the video signal amplifier circuit 5102 into a color signal corresponding to each color of red, green and blue, and the control circuit 5006 for converting the video signal into the input specification of a driver circuit. The control circuit 5006 outputs a signal to each of the scan line side and the signal line side. In the case of driving in a digital manner, a structure where the signal dividing circuit 5007 is provided on the signal line side to supply an input digital signal by dividing into m number of signals may be employed.

An audio signal received by the tuner 5101 is transmitted to an audio signal amplifier circuit 5104, an output thereof is supplied to a speaker 5106 through an audio signal processing circuit 5105. A control circuit 5107 receives receiving station (received frequency) and volume control data from an input portion 5108, and transmits signals to the tuner 5101 and the audio signal processing circuit 5105.

By incorporating the EL module shown in FIG. 50 into the housing 49001, a TV receiver can be completed as shown in FIG. 49A. The display portion 49003 is constituted by the EL module. In addition, the speaker portion 49004, the video inputting terminal 49005, and the like are provided appropriately.

It is needless to say that the invention can also be applied to various appliances other than the TV receiver, such as a monitor of a personal computer, and in particular a large display medium such as an information display panel at the station or the airport, and an advertisement board on the street.

This application is based on Japanese Patent Application serial no. 2005-234649 filed in Japan Patent Office on 12, Aug. 2005, the entire contents of which are hereby incorporated by reference.

What is claimed is:

1. A display device comprising:
a first and a second wires; and
a pixel comprising:
a first transistor;
a first to a third switches;
a display element; and
a current source circuit,
wherein the first wire is electrically connected to a gate terminal of the first transistor via the first switch,
wherein the second wire is electrically connected to the display element via the second switch and the first transistor, the second switch and the first transistor being connected in series between the second wire and the display element,
wherein the second wire is electrically connected to the first transistor via the third switch and the current source circuit, the third switch and the current source circuit being connected in series between the second wire and the first transistor and in parallel with the second switch.

2. The display device according to claim 1,
wherein the current source circuit is programmable.

3. The display device according to claim 1, further comprising:
a third wire; and
comprised in the current source circuit:
a second transistor;
a fourth and a fifth switch; and
a capacitor,
wherein the second wire is electrically connected to the third switch via the second transistor,
wherein the second wire is electrically connected to a gate terminal of the second transistor via the fourth switch,
wherein the capacitor is electrically connected between the gate terminal and a node between the second transistor and the third switch,
wherein the third wire is electrically connected to the node via the fifth switch.

4. The display device according to claim 1,
wherein the display device is configured to set on the second switch and to set off the third switch during an image display operation, and
wherein the display device is configured to set off the second switch and to set on the third switch during a display element aging operation.

5. The display device according to claim 4,
wherein the display device is configured to carry out the display element aging operation while charging.

6. The display device according to claim 1,
wherein the display device is configured to display an icon,
wherein the display device is configured to suppress image burn-in by shifting the icon in a horizontal direction by a distance that is a multiple integer of a width of the icon or in a vertical direction by a distance that is a multiple integer of a height of the icon.

7. The display device according to claim 1,
wherein the display device is configured to display an icon,
wherein the display device is configured to suppress image burn-in by shifting the icon in a horizontal direction by a distance that is a multiple integer of a width of an icon block or in a vertical direction by a distance that is a multiple integer of a height of the icon block.

8. The display device according to claim 1,
wherein the display device is configured to display an icon,
wherein the display device is configured to shifting the icon in a horizontal direction by a distance that is a multiple integer of a width of an icon block or in a vertical direction by a distance that is a multiple integer of a height of the icon block.

9. The display device according to claim 1,
wherein the display device is configured to display an icon,
wherein the display device is configured to rotating the icon.

10. The display device according to claim 1,
wherein the display device is configured to display an icon,
wherein the display device is configured to suppress image burn-in by rotating the icon.

* * * * *